US012371953B2

(12) United States Patent
Zhang et al.

(10) Patent No.: US 12,371,953 B2
(45) Date of Patent: Jul. 29, 2025

(54) AUTOMATIC SMALL REPAIR OPERATION SYSTEM FOR OIL FIELD

(71) Applicant: SHENGLI OILFIELD SHENGJI PETROLEUM EQUIPMENT CO., LTD., Shandong (CN)

(72) Inventors: Xiqing Zhang, Shandong (CN); Duanguang Zhang, Shandong (CN); Junfang Shen, Shandong (CN); Qiuling Wang, Shandong (CN); Hailong Lv, Shandong (CN); Jiaojiao Zhang, Shandong (CN); Xiaonan Zhang, Shandong (CN); Yanli Jia, Shandong (CN); Wenping Han, Shandong (CN)

(73) Assignee: Shengli Oilfield Shengji Petroleum Equipment Co., Ltd., Dongying (CN)

( * ) Notice: Subject to any disclaimer, the term of this patent is extended or adjusted under 35 U.S.C. 154(b) by 180 days.

(21) Appl. No.: 18/331,907

(22) Filed: Jun. 8, 2023

(65) Prior Publication Data

US 2024/0018835 A1 Jan. 18, 2024

Related U.S. Application Data

(63) Continuation-in-part of application No. PCT/CN2021/136799, filed on Dec. 9, 2021.

(30) Foreign Application Priority Data

Dec. 9, 2020 (CN) ..... 202011463305.8
Jan. 4, 2021 (CN) ..... 202120001464.X
(Continued)

(51) Int. Cl.
*E21B 19/06* (2006.01)
*E21B 15/00* (2006.01)
(Continued)

(52) U.S. Cl.
CPC ..... *E21B 19/165* (2013.01); *E21B 19/06* (2013.01)

(58) Field of Classification Search
CPC ..... E21B 19/165; E21B 19/06; E21B 18/15; E21B 19/16; E21B 19/24; E21B 15/00
(Continued)

(56) References Cited

U.S. PATENT DOCUMENTS 6,079,490 A * 6/2000 Newman ..... E21B 41/00 702/6
6,926,097 B1 8/2005 Blake
(Continued)

FOREIGN PATENT DOCUMENTS

CN 102174879 A 9/2011
CN 102359346 A 2/2012
(Continued)

OTHER PUBLICATIONS

First Search of Priority Application in Application No. 2021105031970 dated Jun. 22, 2021 in 2 pages.
(Continued)

*Primary Examiner* — Nicole Coy
*Assistant Examiner* — Douglas S Wood
(74) *Attorney, Agent, or Firm* — Knobbe, Martens, Olson & Bear, LLP

(57) ABSTRACT

The present disclosure provides an automatic minor repair operation system for an oil field, a pipe column conveying and discharging device for use in an automatic minor repair operation apparatus system, an anti-opening mechanism for an elevator and a turnover elevator, a manipulator and a workover operation device for a workover operation, an integrated automatic wellhead operation apparatus, and a power slip for an oil field workover operation. The automatic minor repair operation apparatus system includes: a workover machine, a pipe column conveying and discharg-
(Continued)

ing device, an elevator for a workover operation, a manipulator for a workover operation, an integrated automatic wellhead operation apparatus, and a power slip for an oil field workover operation. The workover machine is arranged along a first direction of the automatic minor repair operation apparatus system, such that a longitudinal direction of the workover machine is parallel to the first direction, and a tail of the workover machine is arranged to be spaced a predetermined distance from a wellhead center in the first direction, where the first direction is a direction passing through the wellhead center along a radial direction of the wellhead. The pipe column conveying and discharging device is arranged on a first side of a second direction of the automatic minor repair operation apparatus system, where the second direction is a direction passing through the wellhead center and perpendicular to the first direction. The elevator for a workover operation, the manipulator for a workover operation, and the integrated automatic wellhead operation apparatus are arranged on the tail of the workover machine, are carried by the workover machine, and are arranged on a second side that is of the second direction of the automatic minor repair operation apparatus system and that is opposite to the first side. The power slip for an oil field workover operation is arranged at the wellhead center, and is configured to switch between an open position where a pipe column is allowed to move through and a closed position where the pipe column is prevented from moving through. According to the automatic minor repair operation apparatus system of the present disclosure, the on-site practicability and the working efficiency of the oil field operation are remarkably improved, the unmanned wellhead operation is achieved, the labor intensity of workers is greatly reduced, the working environment is improved, and the safety factor is improved; and meanwhile, the wellhead center can be accurately positioned.

10 Claims, 18 Drawing Sheets

(30) Foreign Application Priority Data

| | | |
|---|---|---|
| Jan. 5, 2021 | (CN) | 202120008013.9 |
| Jan. 11, 2021 | (CN) | 202120053182.4 |
| Aug. 23, 2021 | (CN) | 202121973995.1 |

(51) Int. Cl.
*E21B 19/15* (2006.01)
*E21B 19/16* (2006.01)
*E21B 19/24* (2006.01)

(58) Field of Classification Search
USPC ..... 166/77.51
See application file for complete search history.

(56) References Cited

U.S. PATENT DOCUMENTS

| | | | | |
|---|---|---|---|---|
| 7,370,707 | B2 * | 5/2008 | McDaniel | E21B 19/004 166/380 |
| 8,935,901 | B2 | 1/2015 | Petrello et al. | |
| 10,844,674 | B2 | 11/2020 | Berry et al. | |
| 2001/0011589 | A1 * | 8/2001 | Mullins | E21B 34/063 175/218 |
| 2003/0015322 | A1 * | 1/2003 | Fotland | E21B 19/165 166/55 |
| 2014/0140791 | A1 * | 5/2014 | Yorga | E21B 7/02 414/22.52 |
| 2016/0090796 | A1 | 3/2016 | Roodenburg et al. | |
| 2017/0314346 | A1 * | 11/2017 | Hou | E21B 19/06 |
| 2022/0034176 | A1 | 2/2022 | Skibsrud et al. | |
| 2022/0178248 | A1 * | 6/2022 | Chambon | E21B 19/00 |
| 2024/0018833 | A1 * | 1/2024 | Zhang | E21B 19/20 |

FOREIGN PATENT DOCUMENTS

| | | | |
|---|---|---|---|
| CN | 103573190 | A | 2/2014 |
| CN | 203542608 | U | 4/2014 |
| CN | 203822194 | U | 9/2014 |
| CN | 104989296 | A | 10/2015 |
| CN | 204729030 | U | 10/2015 |
| CN | 105239940 | A | 1/2016 |
| CN | 205259958 | U | 5/2016 |
| CN | 205858221 | U | 1/2017 |
| CN | 106948770 | A | 7/2017 |
| CN | 206495647 | U | 9/2017 |
| CN | 107869315 | A | 4/2018 |
| CN | 109322628 | A | 2/2019 |
| CN | 109403886 | A | 3/2019 |
| CN | 109779542 | A | 5/2019 |
| CN | 209244532 | U | 8/2019 |
| CN | 209324280 | U | 8/2019 |
| CN | 110454100 | A | 11/2019 |
| CN | 110630190 | A | 12/2019 |
| CN | 110666787 | A | 1/2020 |
| CN | 110714730 | A | 1/2020 |
| CN | 110977930 | A | 4/2020 |
| CN | 111502564 | A | 8/2020 |
| CN | 212614576 | U | 2/2021 |
| CN | 212614579 | U | 2/2021 |
| CN | 212614582 | U | 2/2021 |
| CN | 112483022 | A | 3/2021 |
| CN | 213898888 | U | 8/2021 |
| CN | 214222648 | U | 9/2021 |
| WO | WO 2016/118714 | A1 | 7/2016 |
| WO | WO 2022/143559 | A1 | 7/2022 |

OTHER PUBLICATIONS

International Preliminary Report on Patentability in Application No. PCT/CN2021/141749 dated Jul. 4, 2023 in 11 pages.
International Search Report and Written Opinion in Application No. PCT/CN2021/141749 dated Mar. 17, 2022 in 17 pages.
Notification to Grant Patent Right for Invention in Application No. 202110503197.0 dated Jul. 8, 2021 in 3 pages.
Office Action in Application No. 202110503197.0 dated Jun. 28, 2021 in 10 pages.
International Preliminary Report of Patentability in Application No. PCT/CN2021/136799 dated Jun. 13, 2023 in 12 pages.
International Search Report and Written Opinion in Application No. PCT/CN2021/136799 dated Mar. 1, 2022 in 17 pages.
Office Action dated Sep. 13, 2024 in Chinese Application No. 202011463305.8, 13 pages.

* cited by examiner

AUTOMATIC SMALL REPAIR OPERATION SYSTEM FOR OIL FIELD

CROSS-REFERENCE TO RELATED APPLICATIONS

The present disclosure claims priority to Chinese Patent Application No. 202011463305.8, filed with the China National Intellectual Property Administration on Dec. 9, 2020 and entitled "MANIPULATOR AND WORKOVER OPERATION DEVICE FOR WORKOVER OPERATION", Chinese Patent Application No. 202120001464.X, filed with the China National Intellectual Property Administration on Jan. 4, 2021 and entitled "POWER SLIP FOR OIL FIELD WORKOVER OPERATION", Chinese Patent Application No. 202120053182.4, filed with the China National Intellectual Property Administration on Jan. 11, 2021 and entitled "OIL PIPE CONVEYING AND DISCHARGING DEVICE", Chinese Patent Application No. 202121973995.1, filed with the China National Intellectual Property Administration on Aug. 23, 2021 and entitled "INTEGRATED AUTOMATIC WELLHEAD OPERATION APPARATUS", and Chinese Patent Application No. 202120008013.9, filed with the China National Intellectual Property Administration on Jan. 5, 2021 and entitled "ANTI-OPENING MECHANISM FOR ELEVATOR AND TURNOVER ELEVATOR", which are incorporated herein by reference in their entireties.

TECHNICAL FIELD

The present disclosure relates to the technical field of oil field workover operation, and more specifically, to an automatic minor repair operation system for an oil field, a pipe column conveying and discharging device for use in an automatic minor repair operation apparatus system, an anti-opening mechanism for an elevator and a turnover elevator, a manipulator and a workover operation device for a workover operation, an integrated automatic wellhead operation apparatus, and a power slip for an oil field workover operation.

BACKGROUND

At present, the international oil field workover operation adopts the cooperation of a manual hydraulic clamp and a workover machine for workover, and has the defects of low automation degree, high labor intensity, and low safety factor. In the workover operation of the oil field, the pipe conveying and discharging mechanical device is required to replace manpower so as to implement the conveying of pipe columns between a wellhead and a pipe column row and the discharging of the pipe columns. However, the related pipe conveying and discharging mechanical device can only implement unidirectional pipe column conveying due to structural limitation, and after the device is placed and fixed, a conveying direction of the pipe column cannot be adjusted, so that the applicability to a well site is poor. There are a plurality of uncertain factors in the surrounding environment of the oil well, the construction environment and the consideration factors are complex, and an arrangement direction of the pipe conveying and discharging mechanical device has a limitation.

An elevator is an important apparatus for lifting and lowering a pipe column in a workover operation, and the efficiency and the safety of the workover operation are directly influenced by the performance of the elevator. With the urgent needs of an oil field on reducing the labor intensity of operating personnel and improving the operation safety and the working efficiency, the demand on the current market for a power elevator of an operation automatic matching tool is increasing day by day. In the related technology, the elevator is provided with a power locking mechanism that can be used to drive a side door to move, and the side door can be locked by power after being in place, so that the operation safety in the process of lifting and lowering the pipe column is ensured. However, in the related technology, the elevator needs to lift the pipe column vigorously and then lower the pipe column quickly in the process of use, to release the clamped pipe column in the well. During this process, the pipe column is scratched with a hook, and the power locking mechanism fails in the scratching process, which causes the risk of opening the side door, and further causes a potential safety risk.

In the related technology, a manipulator for an automatic workover operation apparatus has the following problems. A position of the manipulator has high requirements on the precision of an installation position of a pipe column conveyor, which makes the installation of on-site device more difficult and time-consuming. In addition, the manipulator is installed on a skid of a wellhead operation apparatus, and the manipulator is large in size, and the skid needs to be installed according to a pipe column pushing direction of the manipulator before operation, which affects the efficiency of on-site operation and the adaptability of automatic operation device to a great extent, consequently, the workover operation requirement cannot be met. Moreover, the manipulator in the related technology can only grip the pipe column. However, in the process of lowering the pipe column, under the action of different lowering speeds, weather and wind power, the external elevator can deflect to a certain degree, such that the condition that the elevator cannot grab the pipe in the pipe grabbing process is caused, and the stability of the whole device is poor.

In addition, an oil field wellhead operation apparatus is generally installed separately from a workover machine. A structure of the related wellhead operation apparatus to implement a horizontal pushing and withdrawing action generally relies on a horizontal slide rail and sliding components connected to the slide rail. In the operation, a shorter slide rail is convenient for storage and transportation, but has a short pushing distance, while a longer slide rail is not convenient for storage and transportation. In the process of oil field minor repair operation, for the conveying and installation processes of a pipe column, the manipulator for an automatic workover operation apparatus needs to clamp and fix an external pipe column, so that the pipe column can be connected to an elevator.

When the automatic workover operation is implemented, a traveling system of a workover machine lifts a pipe column in a pipe lifting process (i.e., pipe column lifting process), but cannot detect a lifting position of coupling. The coupling position can only be observed manually, and then the traveling system decelerates and stops, consequently, the automatic operation cannot be implemented.

According to the automatic minor repair operation system for an oil field, the pipe column conveying and discharging device for use in an automatic minor repair operation apparatus system, the integrated automatic wellhead operation apparatus, the manipulator and the workover operation device for a workover operation, the power slip for an oil field workover operation, and the anti-opening mechanism for an elevator and the turnover elevator of the present disclosure, the unmanned wellhead operation is achieved, the labor intensity of workers is greatly reduced, the working environment is improved, and the safety factor is improved; and meanwhile, the wellhead center can be positioned precisely.

SUMMARY

The present disclosure provides an automatic minor repair operation system for an oil field, where the automatic minor repair operation apparatus system includes: a workover machine, a pipe column conveying and discharging device, an elevator for a workover operation, a manipulator for a workover operation, an integrated automatic wellhead operation apparatus, and a power slip for an oil field workover operation, and the automatic minor repair operation apparatus system may be configured to implement pipe lowering and pipe lifting operations on a pipe column by the mutual cooperation of the pipe column conveying and discharging device, the elevator for a workover operation, the manipulator for a workover operation, the integrated automatic wellhead operation apparatus, and the power slip for an oil field workover operation, where the workover machine may be arranged along a first direction of the automatic minor repair operation apparatus system, such that a longitudinal direction of the workover machine is parallel to the first direction, and a tail of the workover machine may be arranged to be spaced a predetermined distance from a wellhead center in the first direction, where the first direction may be a direction passing through the wellhead center along a radial direction of the wellhead; the pipe column conveying and discharging device may be arranged on a first side of a second direction of the automatic minor repair operation apparatus system, where the second direction is a direction passing through the wellhead center and perpendicular to the first direction; the elevator for a workover operation, the manipulator for a workover operation, and the integrated automatic wellhead operation device may be arranged on the tail of the workover machine, are carried by the workover machine, and may be arranged on a second side that is of the second direction of the automatic minor repair operation apparatus system and that is opposite to the first side; the power slip for an oil field workover operation may be arranged at the wellhead center, and may be configured to switch between an open position where a pipe column is allowed to move through and a closed position where the pipe column is prevented from moving through, such that:

in the pipe lowering operation, the pipe column conveying and discharging device picks up a pipe column to be subjected to pipe lowering operation and conveys the picked pipe column to a clamping channel of the elevator for a workover operation; the elevator for a workover operation clamps the pipe column; the elevator for a workover operation lifts the pipe column, the manipulator for a workover operation grips the pipe column clamped by the elevator for a workover operation and positions the gripped pipe column at a pipe lowering position at a wellhead center; the integrated automatic wellhead operation apparatus moves to the wellhead center while the pipe column is gripped by the manipulator for a workover operation, and the elevator for a workover operation lowers the pipe column to a coupling position, thereby the pipe column is buckled up by the integrated automatic wellhead operation apparatus; the elevator for a workover operation lowers the pipe column by the opening of the power slip for an oil field workover operation; and in the pipe lifting operation, the elevator for a workover operation lifts the pipe column by opening the power slip for an oil field workover operation, such that a coupling of another pipe column is exposed to a designated position; the integrated automatic wellhead operation apparatus unbuckles the exposed coupling when the power slip for an oil field workover operation is closed; the integrated automatic wellhead operation apparatus retracts, the elevator for a workover operation lifts the pipe column, and the manipulator for a workover operation clamps the unbuckled pipe column and moves the pipe column from the wellhead center to a position where the pipe column is received by a conveying mechanism of the pipe column conveying and discharging device; the elevator for a workover operation lowers the pipe column, and the conveying mechanism receives and moves the pipe column away from the wellhead center.

Optionally, the manipulator for a workover operation may include a manipulator rotation mechanism and a clamping and pushing mechanism, where the manipulator for a workover operation may be configured as follows: in the pipe lowering operation, the manipulator rotation mechanism drives the clamping and pushing structure to rotate circumferentially in a horizontal direction to grip the pipe column clamped by the elevator and position the gripped pipe column at the pipe lowering position in the wellhead center; in the pipe lifting operation, the manipulator rotation mechanism drives the clamping and pushing structure to rotate circumferentially in a horizontal direction to clamp the unbuckled pipe column and move the pipe column from the wellhead center to a position where the pipe column is received by the conveying mechanism of the pipe column conveying and discharging device.

Optionally, the elevator for a workover operation may include an elevator body including an elevator main body and a clamping mechanism, where the clamping mechanism is capable of rotating relative to the elevator main body in a direction close to or away from the elevator main body, such that a clamping channel for clamping the pipe column is formed between the clamping mechanism and the elevator main body, and the clamping mechanism is configured to clamp the pipe column in the pipe lowering operation and the pipe lifting operation.

Optionally, the pipe column conveying and discharging device may include a conveying apparatus and a discharging apparatus, and the conveying apparatus may include the conveying mechanism. In the pipe lowering operation, the pipe column is conveyed to the clamping channel between the clamping mechanism and the elevator main body by the conveying mechanism of the conveying apparatus; in the pipe lifting operation, the pipe column is received by the conveying mechanism of the conveying apparatus and conveyed to a position where the pipe column can be held by the discharging apparatus.

Optionally, the integrated automatic wellhead operation apparatus may include an anti-splash buckling device, a hydraulic clamp, a pushing mechanism, a wellhead operation rotation mechanism, and a transferring mechanism. In the pipe lowering operation, the anti-splash buckling device of the integrated automatic wellhead operation apparatus is moved to the wellhead center by the pushing mechanism, the wellhead operation rotation mechanism, and the transferring mechanism while the pipe column is gripped by the manipulator for a workover operation, the elevator for a workover operation lowers the pipe column to a coupling position and buckle the pipe column by the hydraulic clamp; and in the pipe lifting operation, the exposed coupling is unbuckled by the hydraulic clamp.

Optionally, the power slip for an oil field workover operation may include: a slip housing and a sensor, and the power slip for an oil field workover operation may be configured to automatically detect a coupling position of the pipe column by the sensor to switch between the open position and the closed position.

Optionally, the automatic minor repair operation apparatus system may include two manipulators for a workover operation, the two manipulators for a workover operation may be respectively positioned at two sides of a tail of the workover machine, and the pipe column conveying and discharging device may be arranged at a first side of the second direction of the automatic minor repair operation apparatus system and at least one of two sides of the first direction of the automatic minor repair operation apparatus system.

According to the automatic minor repair operation apparatus system of an embodiment of the present disclosure, a position of the pipe column conveying and discharging device and a layout of the automatic minor repair operation apparatus system can be selected according to the surrounding environment of an oil well and an actual requirement, and therefore the working efficiency and the on-site practicability of oil field workover operation are greatly improved.

The present disclosure provides a pipe column conveying and discharging device, and specific technical solutions are as follows.

A pipe column conveying and discharging device may include a conveying apparatus and a discharging apparatus, where the conveying apparatus includes a first base, a rotating arm, and a conveying mechanism; the rotating arm is provided with a first end and a second end that are opposite to each other, the first end is hinged on the first base, and the second end is rotatable around the first end; the conveying mechanism is configured to drive the pipe column to move from the first end to the second end; the discharging apparatus includes a second base, a guide mechanism, a translation mechanism, a lifting mechanism, and a discharging mechanism; the guide mechanism is installed on the second base; the translation mechanism is installed on the guide mechanism and is movable along a preset direction of the guide mechanism; the lifting mechanism is installed on the translation mechanism and is configured to move a pipe column on the rotating arm to the discharging mechanism; the discharging mechanism is configured to place a pipe column, where a length direction of the second base is the same as that of the first base, the second base is provided with a third end and a fourth end that are opposite to each other, the third end is provided with a first installation portion, the fourth end is provided with a second installation portion, and one end of the first base is detachably connected to the first installation portion or the second installation portion.

Optionally, one end of the first base may be connected to the first installation portion through a distance adjusting structure, or one end of the first base may be connected to the second installation portion through a distance adjusting structure, and the distance adjusting structure may be configured to adjust a distance between the first base and the first installation portion or the second installation portion.

Optionally, the rotating arm may include an arm body, a first telescopic drive component, a first transmission component, and a second transmission component; the arm body is provided with the first end and the second end; one end of the first telescopic drive component is installed on the first base, and the other end of the first telescopic drive component is hinged to a middle portion of the first transmission component; a lower end of the first transmission component is hinged to the first base, and an upper end of the first transmission component is hinged to a lower end of the second transmission component; and an upper end of the second transmission component is hinged to the arm body.

Optionally, the rotating arm may include an arm body including a main body part, a telescopic part, and a second telescopic drive component; the main body part is connected to the telescopic part; and one end of the second telescopic drive component is connected to the main body part, and the other end of the second telescopic drive component is connected to the telescopic part and configured to drive the telescopic part to stretch and retract relative to the main body part.

Optionally, the pipe column conveying and discharging device further includes a length measuring apparatus including a displacement detection mechanism and a length measuring and limiting mechanism; the displacement detection mechanism is installed on the rotating arm and is configured to detect a moving distance of one end of the pipe column driven by the conveying mechanism; the length measuring and limiting mechanism may include a third base, a third telescopic drive component, a lifting frame, a swing arm, a compression spring, and a sensing component; the third base is installed on the first base, the lifting frame and the third telescopic drive component are installed on the third base, and the third telescopic drive component is configured to drive the lifting frame to lift and lower; one end of the swing arm is hinged to the lifting frame, and the other end of the swing arm is connected to the lifting frame through the compression spring; and the sensing component is installed on the lifting frame, and one end of the pipe column drives the swing arm to rotate and compress the compression spring to a preset state to trigger the sensing component.

Optionally, the conveying mechanism may include a traction drive component and a mobile trolley; the traction drive component is installed on the rotating arm and is connected to the mobile trolley; and the mobile trolley is configured to clamp one end of the pipe column, is installed on the rotating arm, and moves along a length direction of the rotating arm under driving of the traction drive component.

Optionally, the guide mechanism may include two guide rails separately installed on the second base, and the guide rails may include a main rail and an extension rail that are hinged to each other; the second base is provided with a fixed support, the main rail is installed on the fixed support, and the expansion rail is installed on a movable support base.

Optionally, the translation mechanism may include a gantry, traveling wheels, a first rotation drive component, and a gear; the gantry includes a cross beam and a gantry body connected to two ends of the cross beam, and the cross beam is installed on the lifting mechanism; an upper end of the gantry body is connected to the cross beam, and a lower end of the gantry body is provided with traveling wheels; the traveling wheels are installed on the guide mechanism; the gantry is configured to install the lifting mechanism, the traveling wheels are installed at a bottom of the gantry, and the traveling wheels are positioned on the guide mechanism; the first rotation drive component is installed at a bottom of the gantry body, is connected to the gear, and is configured to drive the gear to rotate; and a rack is installed on a side portion of the guide mechanism, and the gear is meshed with the rack.

Optionally, the lifting mechanism may include two support rods, two lifters, a second rotation drive component, a rotating shaft, and an attracting structure; the supporting rod is inserted in the translation mechanism, and a lower end of the supporting rod passes through the translation mechanism; the lifter is installed on a top of the translation mechanism, and the two lifts are in a one-to-one corresponding transmission connection with the two support rods; two ends of the rotating shaft are in transmission connection with the two lifters; the second rotation drive component is installed at a top of the translation mechanism, is connected to the rotating shaft, and is configured to drive the rotating shaft to rotate, and the attracting structure is installed at the lower end of the supporting rod.

Optionally, the discharging mechanism may include a cofferdam and a cross arm; the cofferdam can be connected to the second base, and the cofferdam is provided with a waste liquid recovery tank; a plurality of the cross arms are installed in the waste liquid recovery tank at intervals, the waste liquid recovery tank is divided into a plurality of tank bodies, and a height of each cross arm is greater than or equal to that of a side wall of the cofferdam.

According to the pipe column conveying and discharging device provided by the present disclosure, not only can the conveying and discharging of the pipe column be implemented, but also a conveying direction of the conveying apparatus can be changed by switching a connection between one end of the first base and the first installation portion or the second installation portion, which expands the scope of application of the device to a well site.

The present disclosure provides an anti-opening mechanism for an elevator and a turnover elevator, so as to solve the technical problems of a risk of opening a side door and a potential safety risk during the use of the elevator existing in the related technology.

The present disclosure provides an anti-opening mechanism for an elevator, which may include: an anti-opening ring, a connecting portion, and an elevator body;

the elevator body may include an elevator main body and a clamping mechanism, the clamping mechanism is connected to the elevator main body, the clamping mechanism may include a side door, and the clamping mechanism can rotate relative to the elevator main body towards a direction close to or away from the elevator main body through the side door, so that a clamping channel for clamping a pipe column can be formed between the clamping mechanism and the elevator main body; and the anti-opening ring is provided with a through hole passing through the pipe column, the anti-opening ring is concentrically arranged with the clamping channel by the through hole, and the anti-opening ring is separately connected to the elevator main body and the clamping mechanism by the connecting portion so as to fix the clamping mechanism on the elevator main body.

In a preferred embodiment of the present disclosure, the elevator main body may include a first bushing, and the clamping mechanism may include a second bushing;

the elevator main body may be provided with an arc surface, the first bushing may be positioned in the arc surface of the elevator main body, and the first bushing is connected to the arc surface of the elevator main body; and the side door may be an arc structure, the second bushing is positioned on one side that is of the side door and that is close to the elevator body, the second bushing is connected to the side door, the side door is rotatably connected to the elevator main body through a rotating shaft, and the side door is configured to drive the second bushing to abut against the first bushing to form a circular ring structure for clamping the pipe column.

In a preferred embodiment of the present disclosure, the anti-opening ring may be provided with a plurality of first connection holes, the first bushing may be provided with second connection holes, the second bushing may be provided with third connection holes, and a quantity of the first connection holes may be greater than or equal to a sum of the second connection holes and the third connection holes;

the anti-opening ring may be attached to a circular ring structure formed by the first bushing and the second bushing, the connecting portion may include first connecting portions and second connecting portions, a quantity of the first connecting portions may be set corresponding to a quantity of the second connection holes, and the first connecting portions are configured to sequentially pass through the first connection holes and the second connection holes; and a quantity of second connecting portions may be set corresponding to a quantity of the third connection holes, the second connecting portions are configured to sequentially pass through the first connection hole and the third connection hole, so as to fixedly connect the anti-opening ring with the first bushing and the second bushing.

In a preferred embodiment of the present disclosure, a quantity of the second connection holes may be at least two, and a quantity of the third connection holes may be at least two.

In a preferred embodiment of the present disclosure, a drive mechanism may be further included; and the drive mechanism is arranged on the elevator body, an output end of the drive mechanism may be in a transmission connection with the side door, and the drive mechanism is configured to drive the side door to rotate relative to the elevator main body.

In a preferred embodiment of the present disclosure, the elevator body may further include a spring bolt; and the spring bolt is connected to the elevator main body, the clamping mechanism and the spring bolt can rotate towards an opposite direction relative to the elevator main body, and the spring bolt is configured to connect to the clamping mechanism so as to fix the clamping mechanism on the elevator main body.

In a preferred embodiment of the present disclosure, the elevator body may further include a locking mechanism;

the locking mechanism may include a pin shaft and a spring; a notch is formed in one side that is of the side door and that is close to the spring bolt, and a convex lock hole matched with the notch is correspondingly formed in the spring bolt; a stepped hole is formed in the side door above the notch, the pin shaft is inserted into the stepped hole and abuts against the second bushing, and the second bushing is configured to drive the pin shaft to move in the stepped hole; and the spring is sleeved over the pin shaft, two ends of the spring respectively abut against the pin shaft and a step of the stepped hole, and the spring has an elastic trend that the pin shaft is far away from the notch.

In a preferred embodiment of the present disclosure, a turnover mechanism may be further included; and the elevator body is provided with a turnover baffle, the turnover mechanism is connected to the elevator body through the turnover baffle, and the turnover mechanism is configured to adjust an angle of the clamping channel through the elevator body.

The present disclosure provides a turnover elevator, where the turnover elevator may include the anti-opening mechanism for an elevator.

The anti-opening mechanism for an elevator provided by the present disclosure may include: an anti-opening ring, a connecting portion, and an elevator body; the elevator body includes an elevator main body and a clamping mechanism, the clamping mechanism is connected to the elevator main body, and the clamping mechanism can rotate relative to the elevator main body towards a direction close to or away from the elevator main body, so that a clamping channel for clamping a pipe column can be formed between the clamping mechanism and the elevator main body; and the anti-opening ring is provided with a through hole passing through the pipe column, the anti-opening ring is concentrically arranged with the clamping channel by the through hole, and the anti-opening ring is separately connected to the elevator main body and the clamping mechanism by the connecting portion so as to fix the clamping mechanism on the elevator main body. In the actual operation process, after the clamping channel is formed, the anti-opening ring is installed on the elevator main body and the clamping mechanism by using the connecting portion, so that the clamping mechanism and the elevator main body form an overall structure; therefore, the clamping mechanism can always be in a locked state, a risk of the clamping mechanism from being opened relative to the elevator main body is prevented, and a risk of opening a side door and a potential safety risk during the use of the elevator existing in the related technology is solved.

The present disclosure provides a manipulator for a workover operation and a workover operation device, so as to alleviate the following technology problems in the related technology: a fixed position of the manipulator leads to a high precision requirement for the installation position of the pipe column conveyor, which affects the efficiency of on-site operations, and causes poor adaptability of a workover device, inability to overcome the swing of the elevator, and poor pipe gripping stability.

The present disclosure provides a manipulator for a workover operation, where the manipulator for a workover operation may include: a rotation drive mechanism, a rotary main body, an elevator pushing mechanism, and a clamping mechanism;

the clamping mechanism and the elevator pushing mechanism are connected to the rotary main body, the rotation drive mechanism is connected to one end of the rotary main body, the rotation drive mechanism is configured to drive the clamping mechanism and the elevator pushing mechanism to rotate circumferentially in a horizontal direction by the rotary main body, such that the clamping mechanism and the elevator pushing mechanism are positioned at a pipe receiving and conveying position in a wellhead center, and the clamping mechanism is configured to clamp an external pipe column; and the elevator pushing mechanism is configured to abut against an external elevator to push the external elevator to move in the horizontal direction.

In a preferred embodiment of the present disclosure, the elevator pushing mechanism may include a pushing main body, a push plate, and an angle adjusting mechanism; and one end of the pushing main body is connected to the rotary main body, the other end of the pushing main body is hinged to the push plate, two ends of the angle adjusting mechanism are separately hinged to one sides of the pushing main body and the push plate, the angle adjusting mechanism is configured to drive the push plate to rotate relative to the pushing main body, such that the push plate abuts against the external elevator at an angle.

In a preferred embodiment of the present disclosure, the pushing main body may include a first pushing arm, a fixed support, and a second pushing arm; and the first pushing arm is connected to the second pushing arm by the fixed support, the fixed support is configured to enable the first pushing arm and the second pushing arm to be vertically arranged, one end that is of the first pushing arm and that is far away from the second pushing arm is connected to the rotary main body, and one end that is of the second pushing arm and that is far away from the first pushing arm is hinged to the push plate.

In a preferred embodiment of the present disclosure, the fixed support may include a support main body, a first adjusting pin shaft, and a second adjusting pin shaft;

the support main body may be provided with a clamping groove, both the first pushing arm and the second pushing arm are inserted into the clamping groove of the support main body, and the first pushing arm is able to rotate relative to the support main body;

the support main body may be provided with a first fixing hole, a second fixing hole, and a third fixing hole, the first fixing hole and the second fixing hole are positioned on a same straight line, the first fixing hole and the third fixing hole are positioned on a same straight line, and a connecting line of the first fixing hole and the second fixing hole is arranged vertically relative to the connecting line of the first fixing hole and the third fixing hole; and the first adjusting pin shaft is configured to sequentially pass through the first fixing hole, the first pushing arm, and the second pushing arm, so as to fix the first pushing arm and the second pushing arm in the clamping groove of the support main body, the second adjusting pin shaft is configured to be separately connected to the second fixing hole and the third fixing hole, so as to adjust the first pushing arm and the second pushing arm to be vertically arranged, or to adjust the first pushing arm and the second pushing arm to be linearly arranged.

In a preferred embodiment of the present disclosure, the clamping mechanism may include a fixed sleeve, a sliding sleeve, a telescopic drive mechanism, and a clamping assembly;

the telescopic drive mechanism is positioned in the fixed sleeve, a fixing end of the telescopic drive mechanism is connected to an inner wall of one end of the fixed sleeve, and the fixed sleeve is fixedly connected to the rotary main body; and a telescopic end of the telescopic drive mechanism is connected to one end that is of the sliding sleeve and that is positioned in the fixed sleeve, the sliding sleeve is connected to the fixed sleeve in a sliding manner, and one end that is of the sliding sleeve and that extends out of the fixed sleeve is connected to the clamping assembly.

In a preferred embodiment of the present disclosure, the clamping mechanism may further include a linear-motion-control sensing mechanism; and the linear-motion-control sensing mechanism is positioned in the fixed sleeve, the telescopic drive mechanism is in electric signal connection with the linear-motion-control sensing mechanism, and the linear-motion-control sensing mechanism is configured to control a telescopic length of the telescopic drive mechanism.

In a preferred embodiment of the present disclosure, the clamping assembly may include a fixed gripper, a movable gripper, a clamping transmission mechanism, and a clamping drive mechanism; and the fixed gripper is connected to one side of the sliding sleeve, the clamping transmission mechanism, the movable gripper, and the clamping drive mechanism are all positioned in the sliding sleeve, the clamping drive mechanism is in a transmission connection with the movable gripper through the clamping transmission mechanism, the clamping drive mechanism is configured to drive the movable gripper to rotate relative to the fixed gripper through the clamping transmission mechanism so as to adjust a clamping distance between the movable gripper and the fixed gripper.

In a preferred embodiment of the present disclosure, the clamping transmission mechanism may include a gripper connecting arm and a gripper connecting support; the clamping drive mechanism includes a clamping drive portion and an elastic portion;

the elastic portion is positioned between the gripper connecting support and the clamping drive portion, two ends of the elastic portion respectively abut against the gripper connecting support and the clamping drive portion, the clamping drive portion is configured to compress the elastic portion to drive the gripper connecting support to reciprocate along the sliding sleeve, and the elastic portion has an elastic trend such that the gripper connecting support is far away from the clamping drive portion; and the gripper connecting support is hinged to the movable gripper through the gripper connecting arm, the gripper connecting arm is in an arc-shaped structure, the gripper connecting arm is configured to convert a linear acting force of the gripper connecting support into a rotating acting force of the movable gripper.

In a preferred embodiment of the present disclosure, a rotation control sensing mechanism may be further included; and the rotation control sensing mechanism is positioned on the rotary main body, the rotation drive mechanism is in electric signal connection with the rotation control sensing mechanism, and the rotation control sensing mechanism is configured to control a rotation angle of the rotation drive mechanism.

The workover operation device provided by the present disclosure may include the manipulator for a workover operation.

The manipulator for a workover operation provided by the present disclosure may include: a rotation drive mechanism, a rotary main body, an elevator pushing mechanism, and a clamping mechanism; the clamping mechanism and the elevator pushing mechanism are connected to the rotary main body, the rotation drive mechanism is connected to one end of the rotary main body, the rotation drive mechanism drives the clamping mechanism and the elevator pushing mechanism to rotate circumferentially in a horizontal direction by the rotary main body, such that the clamping mechanism and the elevator pushing mechanism are positioned at a pipe receiving and conveying position in a wellhead center, and the manipulator is accurately positioned at the wellhead center and the pipe receiving and conveying position of a conveyor; further, the elevator pushing mechanism is configured to abut against an external elevator to push the external elevator to move in the horizontal direction; through a synchronous motion of the elevator pushing mechanism relative to the rotary main body, the elevator pushing mechanism pushes the external elevator to the wellhead center, which implements the effect that the elevator accurately clamps a pipe column, and alleviates the following technology problems in the related technology: a fixed position of the manipulator leads to a high precision requirement for the installation position of the pipe column conveyor, which affects the efficiency of on-site operations, and causes poor adaptability of a workover device, inability to overcome the swing of the elevator, and poor pipe gripping stability.

For the defects in the related technology, the present disclosure provides an integrated automatic wellhead operation apparatus, which implements a mechanized operation through the cooperation of a pushing mechanism, a rotating mechanism, and a transferring mechanism and implements more convenient transportation and storage through the pushing mechanism that may be designed and folded in a V shape.

An integrated automatic wellhead operation apparatus may include a bracket, an anti-splash buckling device, a hydraulic clamp, a transferring mechanism, a rotating mechanism, and a pushing mechanism, where the anti-splash buckling device and the hydraulic clamp are fixedly connected to the bracket;

the transferring mechanism is provided with a connecting bottom plate sliding transversely, the rotating mechanism is fixed on the connecting bottom plate, a top of the rotating mechanism is a rotating end, the rotating end is connected to a rear end of the pushing mechanism, and a front end of the pushing mechanism fixedly supports the bracket;

the pushing mechanism may include a first connecting base, a second connecting base, a second hydraulic cylinder, and a V-shaped folding arm group;

the V-shaped folding arm group may include two first support arms, two second support arms, a trapezoidal base, and a connecting rod, where the two first support arms are arranged in parallel, an upper end of each first support arm is hinged to the first connecting base, and a lower end of each first support arm is hinged to a front end of the trapezoidal base;

the two second support arms are arranged in parallel, an upper end of each second support arm is hinged to the second connecting base, and an lower end of each second support arm is hinged to the rear end of the trapezoidal base; and an extension block is arranged at a bottom of one of the second support arms, a lower end of the extension block is hinged to one end of the connecting rod, and the other end of the connecting rod is hinged to a bottom of one of the first support arms; and one end of the second hydraulic cylinder is hinged to the second connecting base, and the other end of the second hydraulic cylinder is hinged to a middle portion of one of the second support arms.

Preferably, the transferring mechanism may include a base, two transverse guide rails are fixedly connected to the base, and the two guide rails are arranged in parallel;

each of the guide rails may be connected to a slide bushing in a sliding manner, and the two slide bushings may be separately fixedly connected to two ends of the connecting bottom plate;

a support base may be arranged at a rear of the base, a first hydraulic cylinder may be arranged between the support base and the slide bushing, and two ends of the first hydraulic cylinder respectively may be hinged to the slide bushing and the support base.

Preferably, both two sets of the support bases and two sets of the first hydraulic cylinders may be provided and respectively matched with two slide bushings.

Preferably, the rotating mechanism may include a fixed base and a drive mechanism;

the fixed base may be fixed at an upper end of the connecting bottom plate, a rotary table is rotatably connected above the fixing base, a worm wheel is sleeved on a periphery of the rotary table, a support beam is connected to an upper end of the rotary table, and an upper end of the support beam may be connected to a rear end of the pushing mechanism; and the drive mechanism may include a hydraulic motor, a worm is installed on a rotating shaft of the hydraulic motor, and the worm is in meshing transmission with the worm wheel.

Preferably, the rotary table may be of a ring structure, an annular groove matched with the rotary table may be arranged above the fixed base, and a bottom of the rotary table is rotatably connected to the annular groove.

Preferably, a tail end of a rotating shaft of the hydraulic motor may be fixedly connected to a knob.

Preferably, two V-shaped folding arm groups may be arranged in parallel.

Preferably, the bracket may include a U-shaped upper floating plate and a lower bottom plate, a group of floating balls for supporting the upper floating plate is arranged on the lower bottom plate, a group of pin holes are correspondingly arranged on the upper floating plate and the lower bottom plate, and positioning pins are arranged in the pin holes.

Compared with the related technology, the present disclosure has at least the following advantages.

Through the cooperation of a pushing mechanism, a rotating mechanism, and a transferring mechanism, the present disclosure implements mechanized anti-splash buckle operation and buckling and unbuckling operation; and after the operation is completed, the hydraulic clamp and anti-splash buckling device can retract more quickly through the folding of the pushing mechanism and the backward movement of the transferring mechanism, so as to leave enough space for the elevator to fall.

Through the pushing mechanism that may be designed and folded in a V shape, the present disclosure can not only implement the steps of pushing and withdrawing during operation, but also implement more convenient transportation and storage due to a small volume of the pushing mechanism after folding during transportation and storage.

According to the present disclosure, the bracket supports the upper floating plate through floating balls, the hydraulic clamp and anti-splash buckling device are fixed on the upper floating plate, and then, through the clearance fit between the positioning pin and the pin hole, the floating ability of the hydraulic clamp and anti-splash buckling device is implemented.

The present disclosure provides a power slip for an oil field workover operation, which solves the following technical problem in the related technology: during the automatic workover operation, a lifting position of coupling cannot be detected, consequently, the coupling position can only be observed manually.

The present disclosure provides a power slip for an oil field workover operation, which may include: a slip housing and a sensor;

the slip housing may have a first center hole for the pipe column to pass through; and the sensor may be arranged in the slip housing for collecting a coupling position on the pipe column.

In an optional embodiment, the sensor may be a point sensor.

In an optional embodiment, a plurality of sensors may be provided, and the plurality of sensors may be spaced in the circumferential direction of the slip housing.

In an optional embodiment, the plurality of sensors may be arranged on the same horizontal plane.

In an optional embodiment, the slip housing may be provided with fixing holes equal in quantity to the sensors; and the sensor may be inserted into the fixing hole, and one end of the sensor may be positioned in the first center hole.

In an optional embodiment, four sensors may be provided, and an included angle between two adjacent sensors is 90°.

In an optional embodiment, the sensor may be a ring sensor.

In an optional embodiment, a self-sealing rubber core may be arranged in the first center hole, the self-sealing rubber core may have a second center hole, and the second center hole is in communication with and coaxially arranged with the first center hole; and the second center hole can be accessible for the pipe column to pass through.

In an optional embodiment, a first end portion of the self-sealing rubber core may be arranged in the first center hole, and a second end portion of the self-sealing rubber core may be positioned outside the first center hole; and the second center hole may include a tapered hole and a straight circular hole that are coaxially arranged, the tapered hole may be arranged at the first end portion, and the straight circular hole may be arranged at the second end portion.

According to the power slip for an oil field workover operation provided in the present disclosure, the slip housing is provided with a first center hole for a pipe column to pass through, and the pipe column can pass through the first center hole during specific operation; the sensor is arranged in the slip housing, therefore, when the coupling on the pipe column reaches a position of the sensor, the coupling position on the pipe column can be collected to the sensor, so that automatic detection is implemented. Compared with manual observation in the related technology, the detection mode of the power slip for an oil field workover operation may implement automatic operation, which improves the working efficiency, and meanwhile, the detection of the sensor is more accurate compared with the manual observation.

BRIEF DESCRIPTION OF DRAWINGS

To describe the technical solutions in specific embodiments of the present disclosure or in the related technology more clearly, the following briefly describes the accompanying drawings for describing the specific embodiments or the related technology. It is clear that the accompanying drawings in the following description show some embodiments of the present disclosure, and those of ordinary skill in the art may still derive other drawings from these accompanying drawings without creative efforts.

REFERENCE NUMERALS

Figure 1:
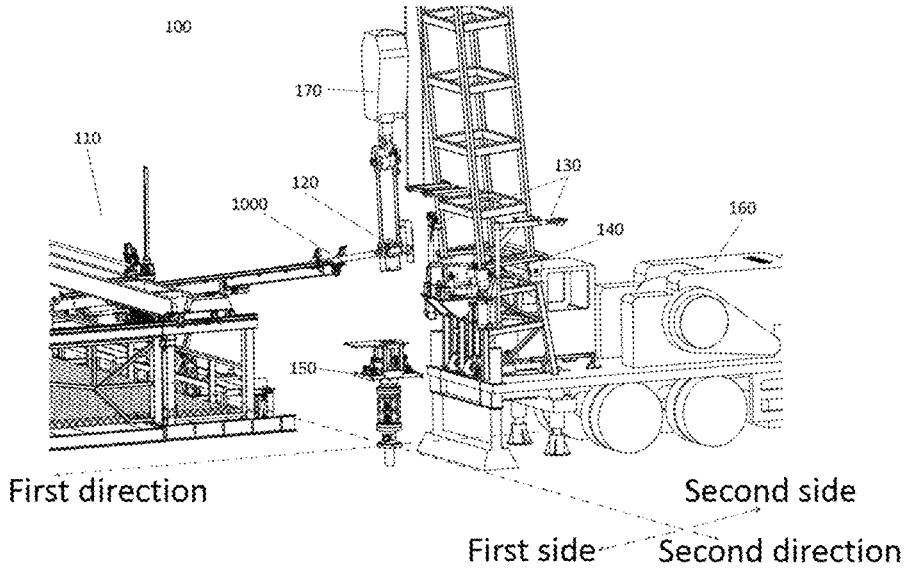
FIG. 1 is a schematic structural diagram of mutual cooperation between a pipe column conveying and discharging device and an elevator when an automatic minor repair operation apparatus system is operating.

1101: first base; 11011: distance adjusting structure; 111: screw; 112: nut;

1102: rotating arm; 11021: arm body; 211: main body part; 212: telescopic part; 213: second telescopic drive component; 11022: first telescopic drive component; 11023: first transmission component; 11024: second transmission component;

1103: conveying mechanism; 11031: traction drive component; 11032: mobile trolley;

1104: second base; 11041: first installation portion; 11042: second installation portion;

1105: guide mechanism; 11051: main rail; 11052: extension rail; 11053: rack;

1106: translation mechanism; 11061: gantry; 611: cross beam; 612: gantry body; 11062: traveling wheel; 11063: first rotation drive component;

1107: lifting mechanism; 11071: support rod; 11072: lifter; 11073: second rotation drive component; 11074: rotating shaft; 11075: attracting structure;

1108: discharging mechanism; 11081: cofferdam; 11082: cross arm;

1109: length measuring and limiting mechanism; 11091: third base; 11092: third telescopic drive component; 11093: lifting frame; 11094: swing arm; 11095 compression spring;

120100: pipe column; 120200: anti-opening ring; 120201: first connection hole; 120202: through hole; 120300: connecting portion; 120400: elevator body; 120401: elevator main body; 120411: first bushing; 120421: second connection hole; 120402: clamping mechanism; 120412: second bushing; 120422: side door; 120432: third connection hole; 120403: spring bolt; 120413: convex lock hole; 120500: drive mechanism; 120600: locking mechanism; 120700: turnover mechanism;

130100: rotation drive mechanism; 130200: rotary main body; 130300: elevator pushing mechanism; 130301: pushing main body; 130311: first pushing arm; 130321: fixed support; 3211: support main body; 3212: first adjusting pin shaft; 3213: second adjusting pin shaft; 130331: second pushing arm; 130302: push plate; 130303: angle adjusting mechanism; 130400: clamping mechanism; 130401: fixed sleeve; 130402: sliding sleeve; 130403: telescopic drive mechanism; 130404: clamping assembly; 130414: fixed gripper; 130424: movable gripper; 130434: clamping transmission mechanism; 4341: gripper connecting arm; 4342: gripper connecting support; 130444: clamping drive mechanism; 4441: clamping drive portion; 4442: elastic portion; 130405: linear-motion-control sensing mechanism; 130500: rotation control sensing mechanism;

1: transferring mechanism, 2: rotating mechanism, 3: pushing mechanism, 4: bracket, 5: anti-splash buckling device, 6: hydraulic clamp, 101: connecting bottom plate, 102: slide bushing, 103: guide rail, 104: base, 105: support base, 106: first hydraulic cylinder, 201: drive mechanism, 202: fixed base, 203: support beam, 204: rotary table, 205: worm wheel, 206: hydraulic motor, 207: worm, 208: knob, 301: first connecting base, 302: second connecting base, 303: second hydraulic cylinder, 304: second support arm, 305: first support arm, 306: connecting rod, 307: trapezoidal base, 308: extension block, 401: upper floating plate, 402: lower bottom plate, 403: floating ball, 404: positioning pin;

150100: slip housing; 150110: first center hole;

150200: sensor;

150300: self-sealing rubber core; and 150310—second center hole.

DETAILED DESCRIPTION OF EMBODIMENTS

The following clearly and completely describes technical solutions in the present disclosure with reference to embodiments. It is clear that the described embodiments are merely some but not all embodiments of the present disclosure. All other embodiments obtained by those of ordinary skill in the art based on embodiments of the present disclosure without creative efforts shall fall within the protection scope of the present disclosure.

In descriptions of the present disclosure, it should be noted that orientation or location relationships indicated by terms "center", "above", "below", "left", "right", "vertical", "horizontal", "inner", "outer", and the like are orientation or location relationships based on the accompanying drawings, and are merely intended for ease of describing the present disclosure and simplifying description, rather than indicating or implying that an apparatus or element in question needs to be in a specific orientation or needs to be constructed and operated in a specific orientation. Therefore, such terms cannot be construed as a limitation on the present disclosure. In addition, the terms "first", "second" and "third" are used herein for descriptive purposes only and should not be construed as indicating or implying relative importance.

In descriptions of the present disclosure, it should be noted that unless otherwise expressly specified and limited, terms "mount", "interconnect", and "connect" should be understood in a broad sense. For example, such terms may indicate a fixed connection, a detachable connection, or an integral connection; may indicate a mechanical connection or an electrical connection; and may indicate direct interconnection, indirect interconnection through an intermediate medium, or internal communication between two elements. Those of ordinary skill in the art may understand specific meanings of the foregoing terms in the present disclosure based on a specific situation.

An automatic minor repair operation apparatus system 100 according to some embodiments of the present disclosure is described below with reference to FIGS. 1 to 4.

According to some embodiments of the present disclosure, the automatic minor repair operation apparatus system 100 may include: a workover machine 160, a pipe column conveying and discharging device 110, an elevator for a workover operation 120, a manipulator for a workover operation 130, an integrated automatic wellhead operation apparatus 140, and a power slip for an oil field workover operation 150, and the automatic minor repair operation apparatus system 100 may be configured to implement pipe lowering and pipe lifting operations on a pipe column by the mutual cooperation of the pipe column conveying and discharging device 110, the elevator for a workover operation 120, the manipulator for a workover operation 130, the integrated automatic wellhead operation apparatus 140, and the power slip for an oil field workover operation 150.

According to some embodiments of the present disclosure, the workover machine 160 may be arranged along a first direction of the automatic minor repair operation apparatus system 100, such that a longitudinal direction of the workover machine 160 is parallel to the first direction, and a tail of the workover machine 160 may be arranged to be spaced a predetermined distance from a wellhead center in the first direction, where the first direction may be a direction passing through the wellhead center along a radial direction of the wellhead; the pipe column conveying and discharging device 110 may be arranged on a first side of a second direction of the automatic minor repair operation apparatus system 100, where the second direction is a direction passing through the wellhead center and perpendicular to the first direction; the elevator for a workover operation 120, the manipulator for a workover operation 130, and the integrated automatic wellhead operation device 140 may be arranged on the tail of the workover machine 160 and are carried by the workover machine 160, the elevator for a workover operation 120, the manipulator for a workover operation 130, and the integrated automatic wellhead operation device 140 may be arranged on a second side that is of the second direction of the automatic minor repair operation apparatus system 100 and that is opposite to the first side; the power slip for an oil field workover operation 150 may be arranged at the wellhead center, and the power slip for an oil field workover operation 150 may be configured to switch between an open position where a pipe column is allowed to move through and a closed position where the pipe column is prevented from moving through.

Figure 2:
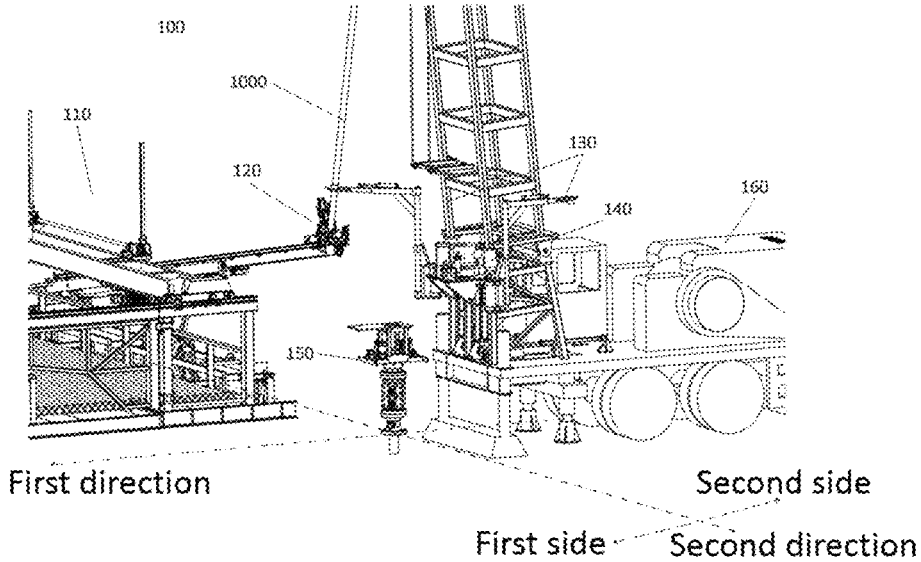
FIG. 2 is a schematic structural diagram of mutual cooperation between an elevator for a workover operation and a manipulator for a workover operation when an automatic minor repair operation apparatus system is operating.
Figure 3A:
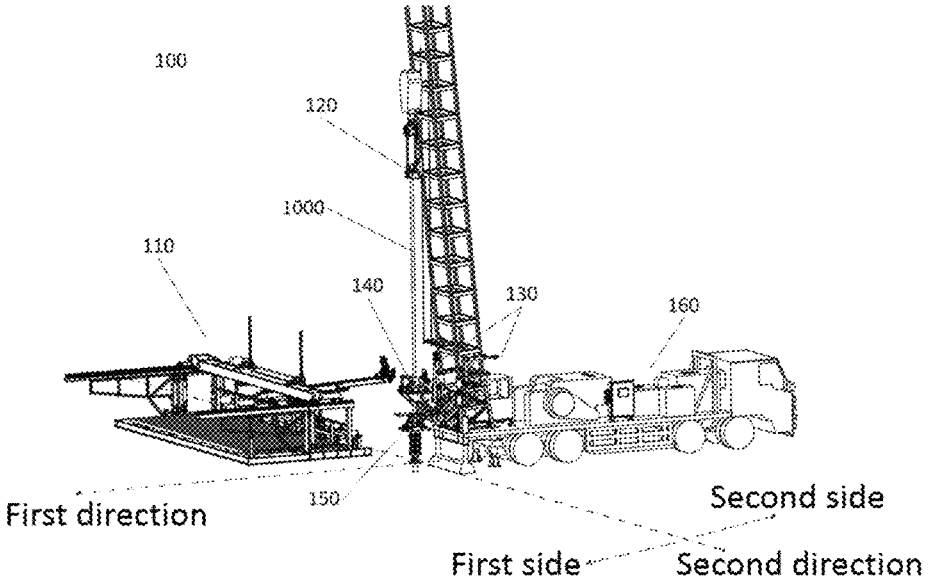
FIGS. 3A to 3C are schematic structural diagrams of mutual cooperation between an integrated automatic wellhead operation apparatus and a power slip when an automatic minor repair operation apparatus system is operating.
Figure 3B:
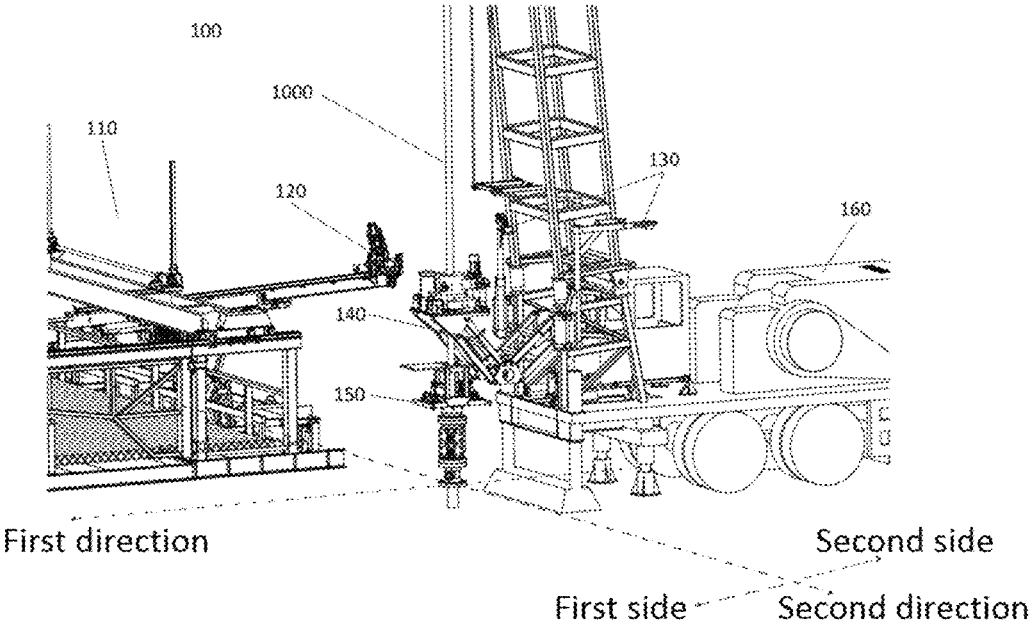
Figure 3C:
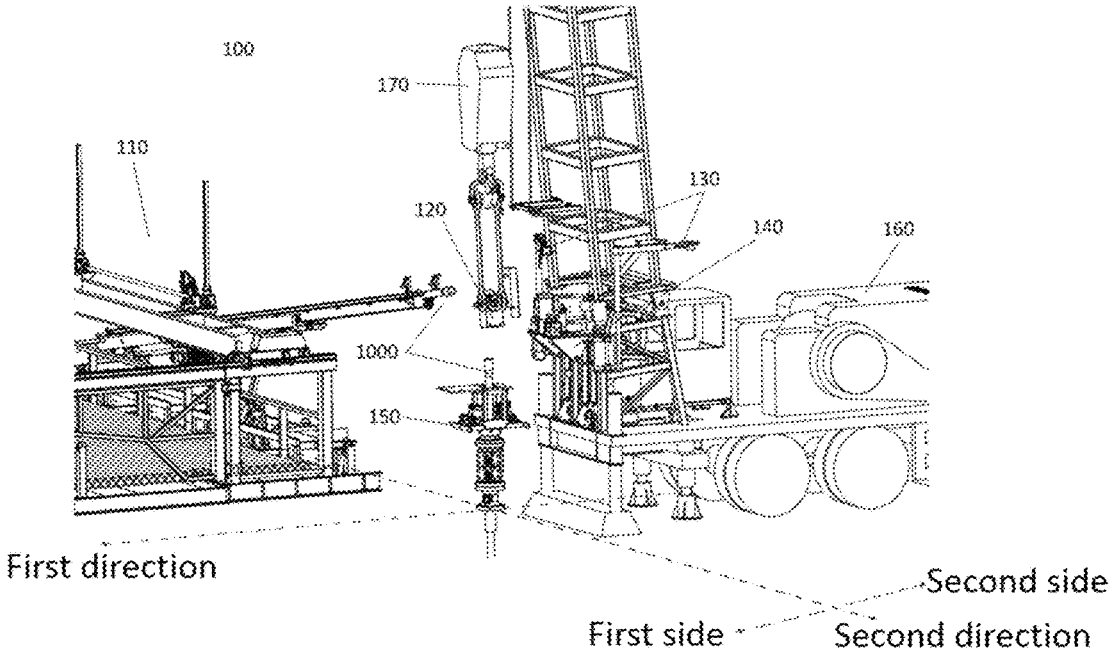

According to the automatic minor repair operation apparatus system 100 of some embodiments of the present disclosure, in the pipe lowering operation, the pipe column conveying and discharging device 110 picks up a pipe column to be subjected to pipe lowering operation and conveys the picked pipe column to a clamping channel of the elevator for a workover operation 120. Referring to FIG. 1, FIG. 1 shows the mutual cooperation between a pipe column conveying and discharging device 110 and an elevator for a workover operation 120 to implement pipe column conveying; the elevator for a workover operation clamps the pipe column; the elevator for a workover operation lifts the pipe column, the manipulator for a workover operation 130 grips the pipe column clamped by the elevator for a workover operation and positions the gripped pipe column at a pipe lowering position at a wellhead center; referring to FIG. 2, FIG. 2 shows mutual cooperation between an elevator for a workover operation 120 and a manipulator for a workover operation 130 to implement a pipe column pushing process; the anti-splash buckling device of the integrated automatic wellhead operation apparatus 140 is moved to the wellhead center while the pipe column is gripped by the manipulator for a workover operation 130, the elevator for a workover operation lowers the pipe column to a coupling position of the wellhead center and then buckle the pipe column by the integrated automatic wellhead operation apparatus 140; and the elevator for a workover operation 120 lowers the pipe column by opening the power slip for an oil field workover operation 150 and the anti-splash buckling device. Referring to FIGS. 3A, 3B, and 3C, FIGS. 3A to 3C show mutual cooperation between a pushing mechanism 3 of an integrated automatic wellhead operation apparatus and a power slip for an oil field workover operation 150 to complete the pipe lowering process (i.e., pipe column lowering process).

According to the automatic minor repair operation apparatus system 100 of some embodiments of the present disclosure, in the pipe lifting operation, the elevator for a workover operation 120 lifts the pipe column by opening the power slip for an oil field workover operation 150, such that a coupling of another pipe column is exposed to a designated position; the integrated automatic wellhead operation apparatus 140 unbuckles the exposed coupling when the power slip for an oil field workover operation 150 is closed; the integrated automatic wellhead operation apparatus retracts, the elevator for a workover operation lifts the pipe column, and the manipulator for a workover operation 130 clamps the unbuckled pipe column and moves the pipe column from the wellhead center to a position where the pipe column is received by a conveying mechanism of the pipe column conveying and discharging device 110; and the elevator for a workover operation lowers the pipe column, and the conveying mechanism receives and moves the pipe column away from the wellhead center.

In the automatic minor repair operation apparatus system 100 according to some embodiments of the present disclosure, the manipulator for a workover operation 130 may include a manipulator rotation mechanism and a clamping and pushing mechanism, where the manipulator for a workover operation 130 may be configured as follows: in the pipe lowering operation, the manipulator rotation mechanism drives the clamping and pushing structure to rotate circumferentially in a horizontal direction to grip the pipe column clamped by the elevator and position the gripped pipe column at the pipe lowering position in the wellhead center; in the pipe lifting operation, the manipulator rotation mechanism drives the clamping and pushing structure to rotate circumferentially in a horizontal direction to clamp the unbuckled pipe column and move the pipe column from the wellhead center to a position where the pipe column can be received by the conveying mechanism of the pipe column conveying and discharging device 110.

In the automatic minor repair operation apparatus system 100 according to some embodiments of the present disclosure, the elevator for a workover operation 120 may include an elevator body including an elevator main body and a clamping mechanism, where the clamping mechanism is capable of rotating relative to the elevator main body in a direction close to or away from the elevator main body, such that a clamping channel for clamping the pipe column is formed between the clamping mechanism and the elevator main body, and the clamping mechanism is configured to clamp the pipe column in the pipe lowering operation and the pipe lifting operation.

In the automatic minor repair operation apparatus system 100 according to some embodiments of the present disclosure, the pipe column conveying and discharging device 110 includes a conveying apparatus and a discharging apparatus, the conveying apparatus including the conveying mechanism. In the pipe lowering operation, the pipe column is conveyed to the clamping channel between the clamping mechanism and the elevator main body by the conveying mechanism of the conveying apparatus; in the pipe lifting operation, the pipe column is received by the conveying mechanism of the conveying apparatus and conveyed to a position where the pipe column can be held by the discharging apparatus.

In the automatic minor repair operation apparatus system 100 according to some embodiments of the present disclosure, the integrated automatic wellhead operation apparatus 140 includes a hydraulic clamp, a pushing mechanism, a wellhead operation rotation mechanism, and a transferring mechanism. In a pipe lowering operation, while a pipe column is gripped by the manipulator 130 for a workover operation, the pipe column is moved from a pipe lowering position at a wellhead center to a coupling position at the wellhead center by the pushing mechanism, the wellhead operation rotation mechanism, and the transferring mechanism, and the pipe column is buckled by the hydraulic clamp; in a pipe lifting operation, the exposed coupling of a pipe column is unbuckled by the hydraulic clamp.

In the automatic minor repair operation apparatus system 100 according to some embodiments of the present disclosure, the power slip for an oil field workover operation 150 may include: a slip housing and a sensor, and the power slip for an oil field workover operation 150 may be configured to automatically detect a coupling position of the pipe column by the sensor to switch between the open position and the closed position.

In the automatic minor repair operation apparatus system 100 according to some embodiments of the present disclosure, the automatic minor repair operation apparatus system 100 may include two manipulators for a workover operation 130, the two manipulators for a workover operation 130 may be respectively positioned at two sides of a tail of the workover machine 160, and the pipe column conveying and discharging device 110 may be arranged at a first side of the second direction of the automatic minor repair operation apparatus system 100 and at least one of two sides of the first direction of the automatic minor repair operation apparatus system 100 to increase the on-site practicability of the automatic minor repair operation apparatus system. There are a plurality of uncertain factors in the surrounding environment of the oil well, and the construction environment and the consideration factors are complex. According to the automatic minor repair operation apparatus system 100 of an embodiment of the present disclosure, a position of the pipe column conveying and discharging device 110 and a layout of the automatic minor repair operation apparatus system 100 can be selected according to the surrounding environment of an oil well and an actual requirement, and therefore the working efficiency and the on-site practicability of oil field workover operation are greatly improved.

The pipe column conveying and discharging device 110, the elevator for a workover operation 120, the manipulator for a workover operation 130, the integrated automatic wellhead operation apparatus 140, and the power slip for an oil field workover operation 150 for use in the automatic minor repair operation apparatus system 100 are described in detail below with reference to the accompanying drawings. The following embodiments and features in the embodiments can be combined with each other without conflict.

The pipe column conveying and discharging device in the related field can only implement unidirectional pipe column conveying because a conveying apparatus and a discharging apparatus of this device are of an integrated structure, and a direction of the conveying apparatus cannot be independently adjusted after this device is fixed in the field. In view of this, an embodiment proposes a pipe column conveying and discharging device, which aims at solving the above problem by improving a structural form and connection manner of the conveying apparatus and the discharging apparatus.

Figure 4:
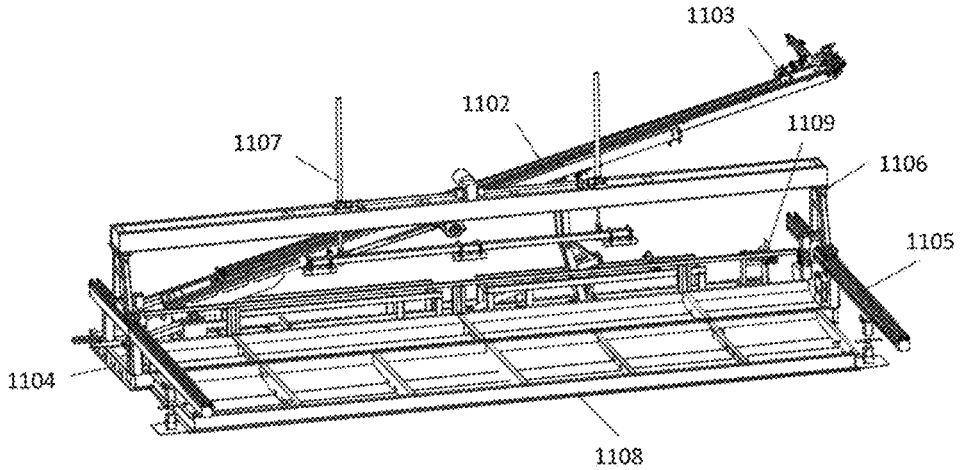
FIG. 4 is a schematic diagram of a structure of a pipe column conveying and discharging device according to an embodiment of the present disclosure in a first state.
Figure 5:
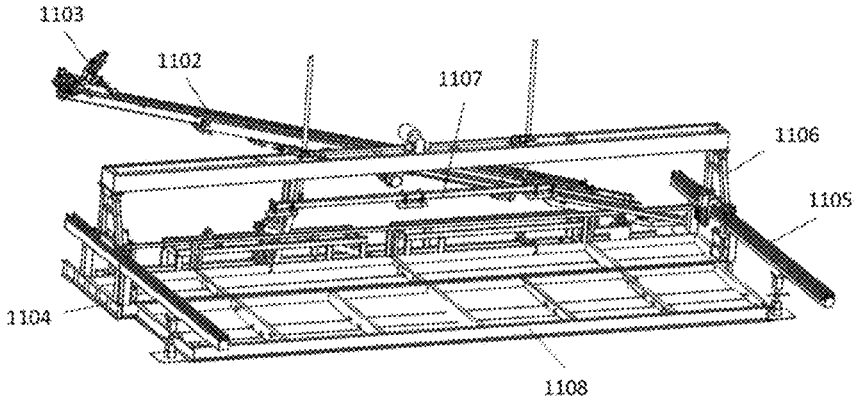
FIG. 5 is a schematic diagram of a structure of a pipe column conveying and discharging device according to an embodiment of the present disclosure in a second state.
Figure 6:
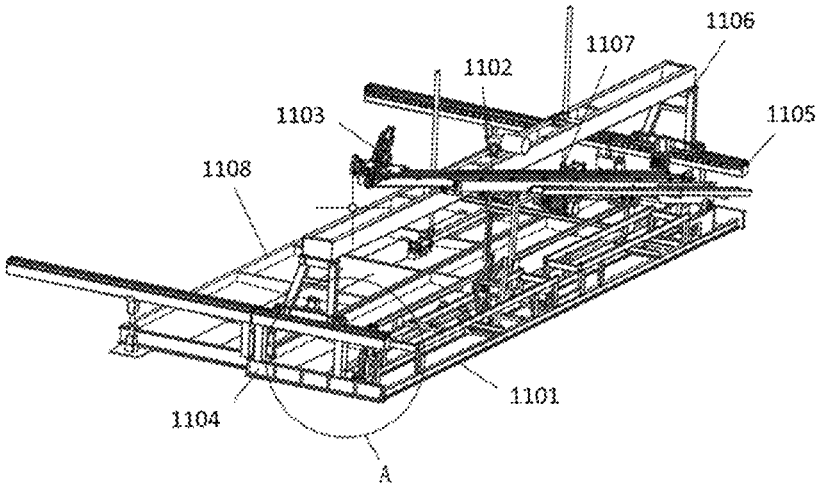
FIG. 6 is a schematic diagram of a structure of a pipe column conveying and discharging device according to an embodiment of the present disclosure.

Specifically, as shown in FIGS. 4, 5, and 6, the pipe column conveying and discharging device provided by this embodiment includes a conveying apparatus and a discharging apparatus, where the conveying apparatus of this embodiment includes a first base 1101, a rotating arm 1102, and a conveying mechanism 1103; the rotating arm 1102 has a first end and a second end opposite to each other, the first end is hinged to the first base 1101, and the second end may rotate around the first end, and the specific implementation of rotation is provided in the following descriptions; and the conveying mechanism 1103 of this embodiment is configured to clamp and drive the pipe column to move from the first end to the second end, and after the pipe column is completely positioned in the conveying apparatus, the pipe column is driven to a lifting station through the rotation of the rotating arm 1102, and then a discharging operation is performed through the discharging apparatus.

The discharging apparatus of this embodiment includes a second base 1104, a guide mechanism 1105, a translation mechanism 1106, a lifting mechanism 1107, and a discharging mechanism 1108, where the guide mechanism 1105 of this embodiment is installed on the second base 1104, and the translating mechanism 1106 is installed on the guide mechanism 1105 and may move along a preset direction of the guide mechanism 1105; and the lifting mechanism 1107 of this embodiment is installed on the translation mechanism 1106 and is configured to move the pipe column at a lifting station to the discharging mechanism 1108, then the pipe column is discharged by the discharging mechanism 1108, and a position where the pipe column is lowered to the discharging mechanism 1108 is adjusted during lowering by the lifting mechanism 1107 and the translation mechanism 1106.

A length direction of the second base 1104 of this embodiment is the same as that of the first base 1101, or the first base and the second base are arranged in parallel, and a length of the first base 1101 is similar to that of the second base 1104. The second base 1104 of this embodiment has a third end and a fourth end that are opposite to each other, the third end is close to the first end, the fourth end is close to the second end, the third end of this embodiment is provided with a first installation portion 11041, and the fourth end is provided with a second installation portion 11042. As shown in FIG. 4, one end of the first base 1101 of this embodiment can be selectively detachably connected to the first installation portion 11041 on one side, or as shown in FIG. 5, one end of the first base 1101 can be detachably connected to the second installation portion 11042 on the other side. There are various specific detachable connection modes, as long as the stability of one end of the first base 1101 can be implemented. In addition, the other end of the first base 1101 of this embodiment can also be connected to the second base 1104. For example, when one end of the first base 1101 is connected to the first installation portion 11041 and the other end of the first base 1101 is connected to the second installation portion 11042, the stability of the connection is improved.

Through the foregoing structure improvement, not only can the conveying and discharging functions for the pipe column be implemented, but also a conveying direction of the conveying apparatus can be changed by switching a connection between one end of the first base 1101 and the first installation portion 11041 or the second installation portion 11042, which expands the scope of application of the device to a well site.

Figure 7:
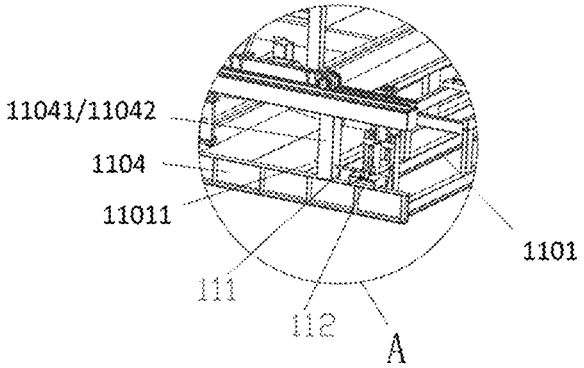
FIG. 7 is an enlarged view of part A in FIG. 6.

As shown in FIGS. 6 and 7, to further increase the applicability of the device to the well site, in this embodiment, a position of the conveying apparatus on the second base 1104 is also designed to be adjustable. Specifically, the first base 1101 and the first installation portion 11041 of this embodiment are connected by a distance adjusting structure 11011, or the first base 1101 and the first installation portion 11041 of this embodiment are connected by a distance adjusting structure 11011, and the distance adjusting structure 11011 of this embodiment is configured to adjust a distance between the first base 1101 and the first installation portion 11041 or the second installation portion 11042; the distance adjusting structure 11011 of this embodiment may include screws 111 and nuts 112, the screws 111 may be separately connected to the first base 1101 of this embodiment and the first installation portion 11041 or the second installation portion 11042 of this embodiment, and a distance between the first base 1101 and the first installation portion 11041 or the second installation portion 11042 may be adjusted by adjusting a position at which the first base 1101 is connected to the screw 111.

Figure 8:
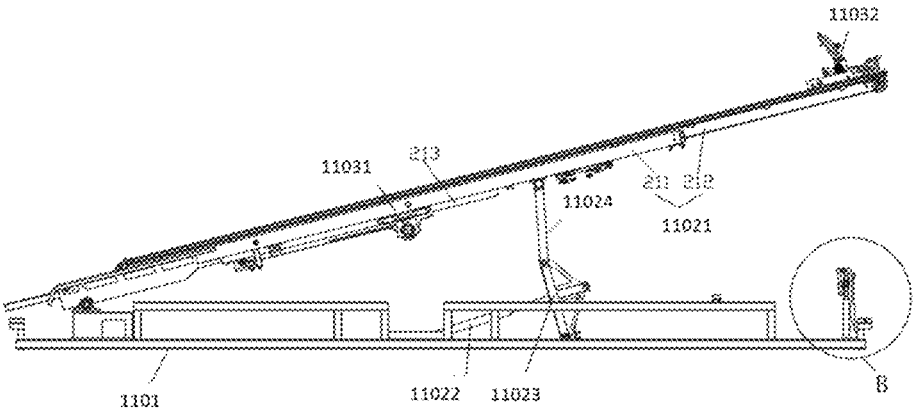
FIG. 8 is a schematic diagram of a structure of a conveying apparatus according to an embodiment of the present disclosure.

Referring to FIG. 8, to implement stable rotation of the rotating arm 1102, this embodiment improves the structure thereof. Specifically, the rotating arm 1102 of this embodiment includes an arm body 11021, a first telescopic drive component 11022, a first transmission component 11023, and a second transmission component 11024.

The arm body 11021 of this embodiment has the first end and the second end, one end of the first telescopic drive component 11022 of this embodiment is installed on the first base 1101, and the other end of the first telescopic drive component is hinged to a middle portion of the first transmission component 11023. Preferably, the first transmission component 11023 of this embodiment is in an isosceles triangular frame structure to ensure the structural strength of the first transmission component. A lower end of the first transmission component 11023 of this embodiment is hinged to the first base 1101, and an upper end of the first transmission component 11023 is hinged to a lower end of the second transmission component 11024; and an upper end of the second transmission component 11024 of this embodiment is hinged to the arm body 11021.

During the action, the first telescopic drive component 11022 telescopically drives the first transmission component 11023 to move, and then drives the second transmission portion 11024 and the arm body 11021 to rotate, and the rotation process is stable and reliable. The first telescopic drive component 11022 of this embodiment, the second telescopic drive component 213 described below, and the like may be of a linear reciprocating structure such as a hydraulic cylinder or an air cylinder.

In addition, to enable the rotating arm 1102 to accommodate pipe columns with different lengths, this embodiment optimizes a structure of the arm body 11021, and as shown in FIG. 8, the arm body 11021 of this embodiment includes a main body part 211, a telescopic part 212, and a second telescopic drive component 213; the main body part 211 is connected to the telescopic part 212; the second telescopic drive component 213 of this embodiment has one end connected to the main body part 211 and the other end connected to the telescopic part 212, and is configured to drive the telescopic part 212 to stretch and retract relative to the main body part 211, so as to adjust a length of the rotating arm 1102.

The conveying mechanism 1103 of this embodiment includes a traction drive component 11031 and a mobile trolley 11032, where the traction drive component 11031 is installed on the rotating arm 1102 and connected to the mobile trolley 11032, and the traction drive component 11031 may have any traction structure capable of driving the mobile trolley 11032 to move; and the mobile trolley 11032 of this embodiment is configured to grip one end of a pipe column, the gripping mode is a mechanical automatic gripping mode, and the mobile trolley 11032 is installed on the rotating arm 1102 and moves in a length direction of the rotating arm 1102 under driving of the traction drive component 11031.

In addition, to measure a length of a pipe column, the pipe column conveying and discharging device of this embodiment further includes a length measuring apparatus including a displacement detection mechanism (not shown in the figure) and a length measuring and limiting mechanism 1109, where the displacement detecting mechanism of this embodiment is installed on the rotating arm 1102 and is configured to detect a displacement amount of the mobile trolley 11032, and the displacement detecting mechanism may be a displacement sensor or the like.

Figure 9:
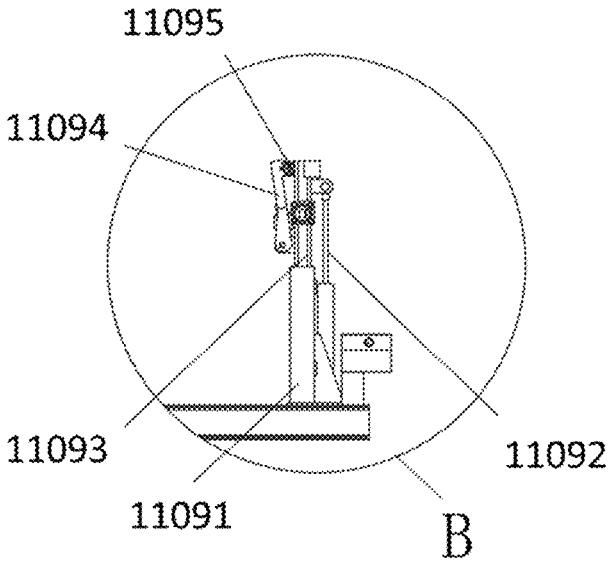
FIG. 9 is an enlarged view of part B in FIG. 8.

Referring to FIG. 9, the length measuring and limiting mechanism 1109 of this embodiment includes a third base 11091, a third telescopic drive component 11092, a lifting frame 11093, a swing arm 11094, a compression spring 11095, and a sensing component (not shown in the figure), where the third base 11091 of this embodiment is installed on the first base 1101 and is arranged close to a second end of the rotating arm 1102, the lifting frame 11093 and the third telescopic drive component 11092 of this embodiment are installed on the third base 11091, and the third telescopic drive component 11092 of this embodiment is configured to drive the lifting frame 11093 to lift and lower; one end of the swing arm 11094 of this embodiment is hinged to the lifting frame 11093, and the other end of the swing arm is connected to the lifting frame 11093 through the compression spring 11095; and the sensing component of this embodiment is installed on the lifting frame 11093, when the pipe column is moved to the second end by the mobile trolley 11032, the pipe column abuts against the swing arm 11094, which drives the swing arm 11094 to rotate and compresses the compression spring 11095 to a preset state to trigger the sensing component, and the sensing component may be of a structure such as a contact sensor.

The pipe column is provided to the mobile trolley by a pipe column feeding apparatus (not shown in the figure), and the mobile trolley drives one end of the pipe column to move. During detection, the rotating arm 1102 needs to be rotated to a horizontal state, and based on the length of the pipe column, the rotating arm 1102 of this embodiment can drive the rotating arm 1102 to extend to a length equal to the pipe column through the forgoing second telescopic drive component 213. When one end of the pipe column moves to abut against the swing arm 11094 of this embodiment, the sensing component sends out an sensing signal, and the pipe column is limited by the length measuring and limiting mechanism 1109. A control apparatus (not shown in the figure) of the device receives the signal and obtains the length of the pipe column. The specific length calculation is based on a moving distance of the mobile trolley 11032. The entire length measurement process of this embodiment is implemented by the control apparatus of this embodiment, and the control apparatus may be a controller or a processor or the like that can receive signals, process data, and send control instructions.

Figure 10:
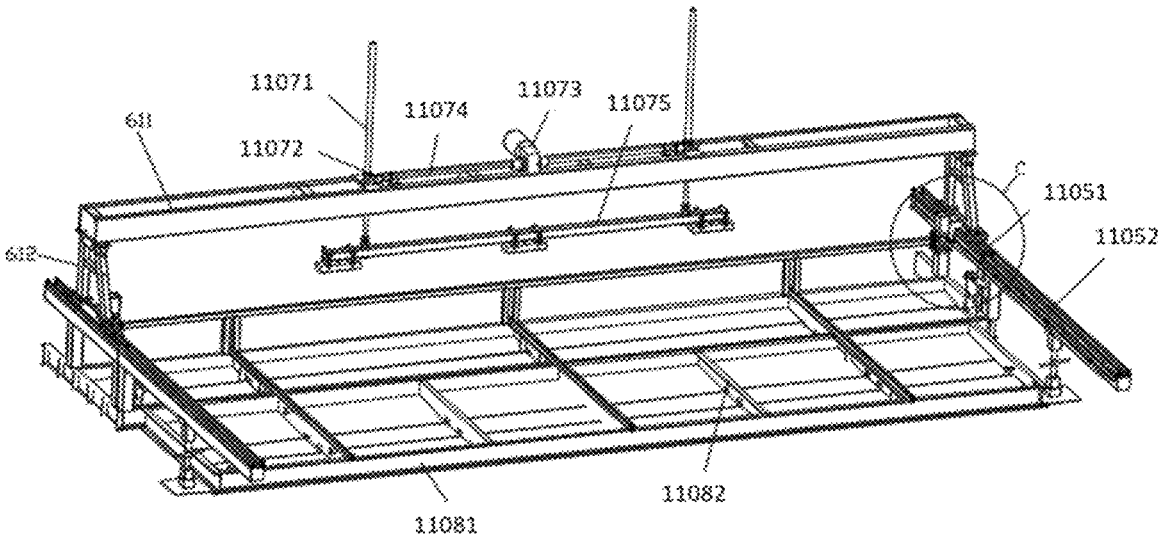
FIG. 10 is a schematic diagram of a structure of a discharging apparatus according to an embodiment of the present disclosure.
Figure 11:
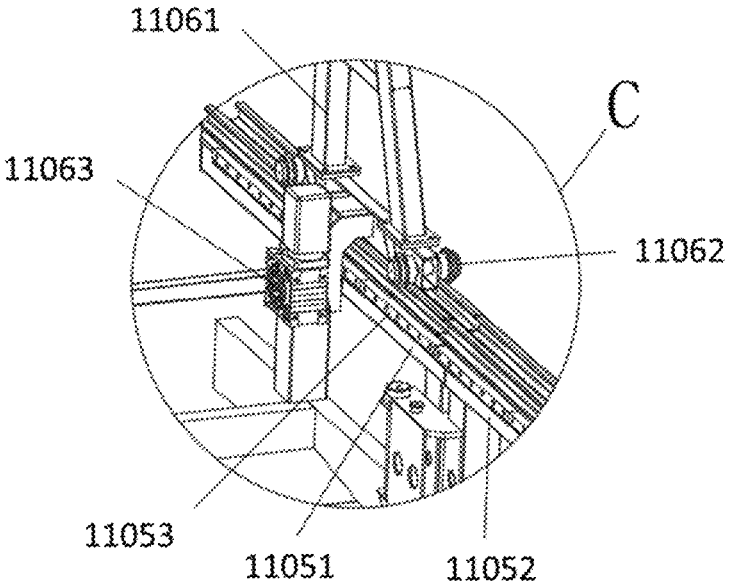
FIG. 11 is an enlarged view of part C in FIG. 10.
Figure 12:
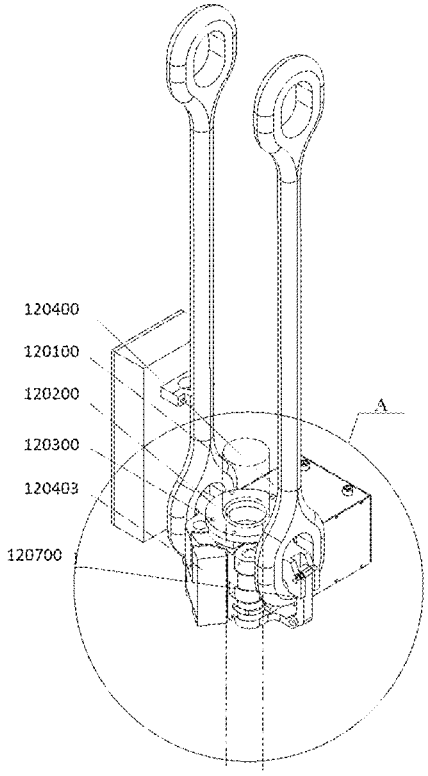
FIG. 12 is a schematic diagram of an overall structure of an anti-opening mechanism for an elevator according to an embodiment of the present disclosure.
Figure 13:
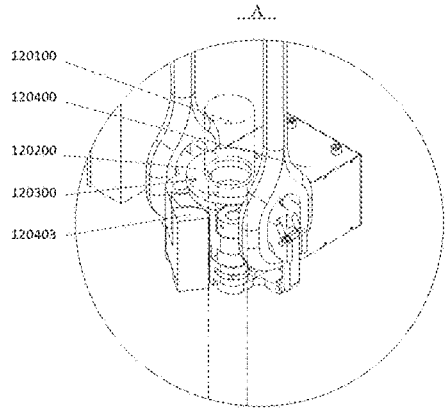
FIG. 13 is a schematic diagram of an enlarged partial structure of the anti-opening mechanism for an elevator at A part according to the embodiment of FIG. 1.
Figure 14:
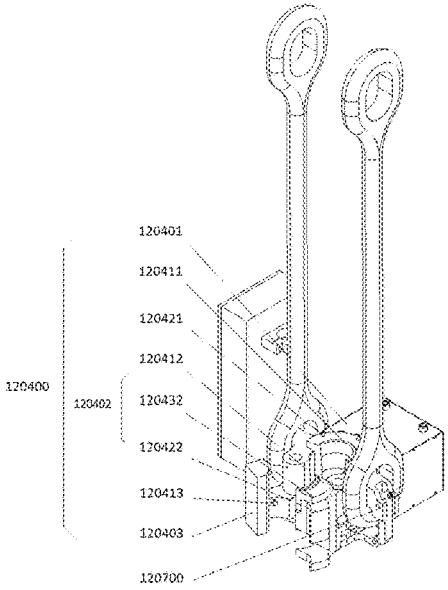
FIG. 14 is a schematic diagram of a structure of an elevator body of an anti-opening mechanism for an elevator according to an embodiment of the present disclosure.
Figure 15:
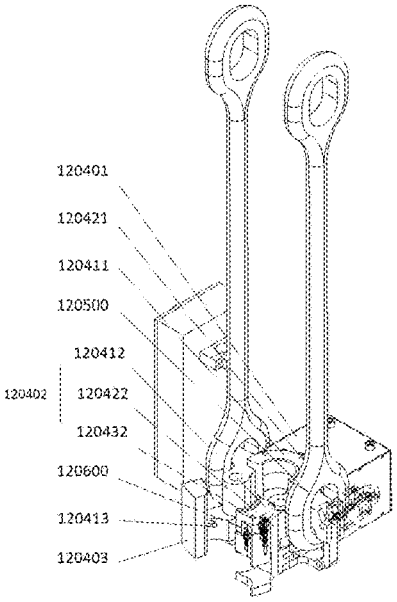
FIG. 15 is a schematic diagram of an internal structure of an elevator body of an anti-opening mechanism for an elevator according to an embodiment of the present disclosure.
Figure 16:
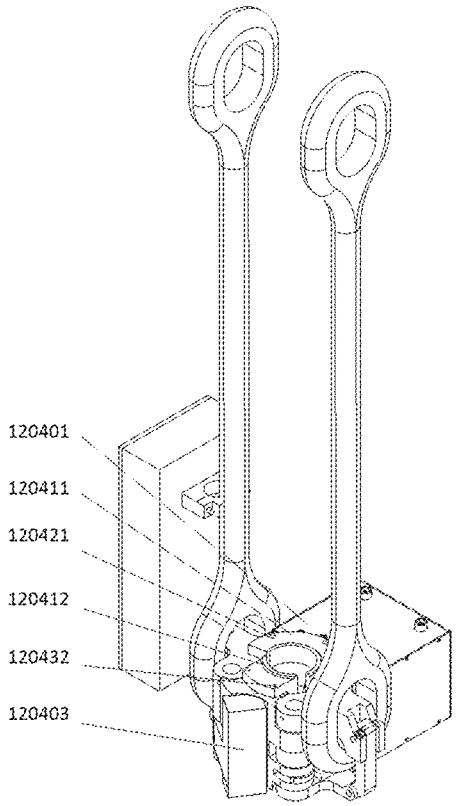
FIG. 16 is a schematic diagram of a structure of an elevator body, in a closed state, of an anti-opening mechanism for an elevator according to an embodiment of the present disclosure.
Figure 17:
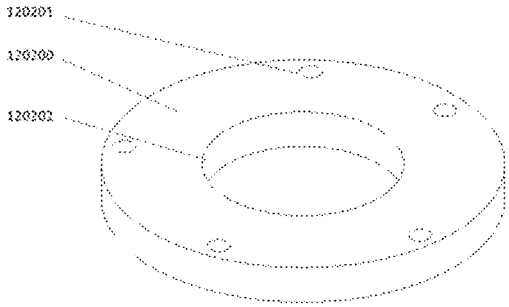
FIG. 17 is a schematic diagram of a structure of an anti-opening ring of an anti-opening mechanism for an elevator according to an embodiment of the present disclosure.
Figure 18:
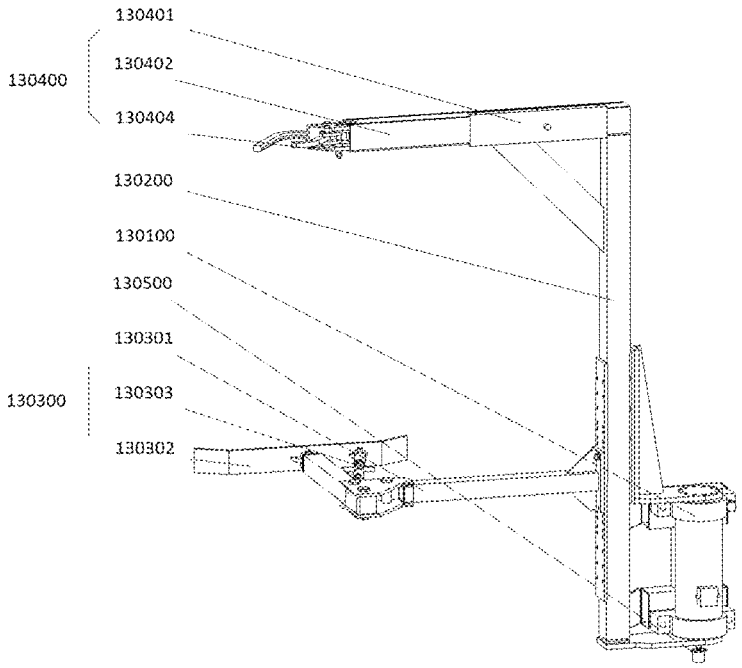
FIG. 18 is a schematic diagram of an overall structure of a manipulator for a workover operation according to an embodiment of the present disclosure.
Figure 19:
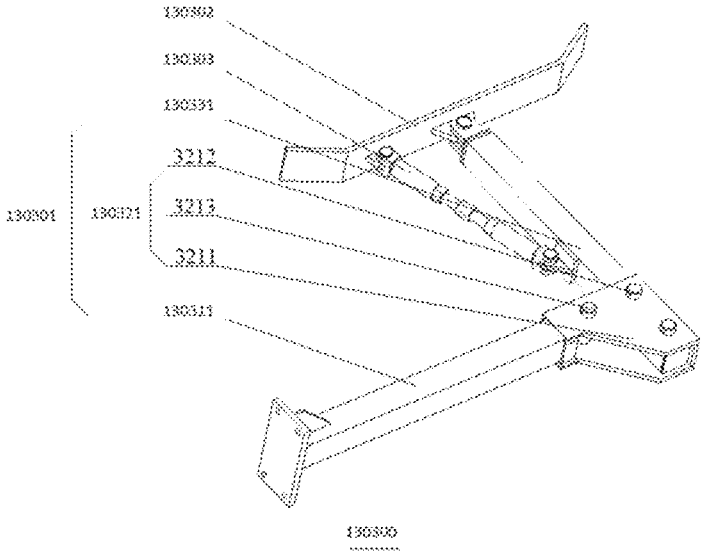
FIG. 19 is a schematic diagram of a structure of an elevator pushing mechanism of a manipulator for a workover operation according to an embodiment of the present disclosure.
Figure 20:
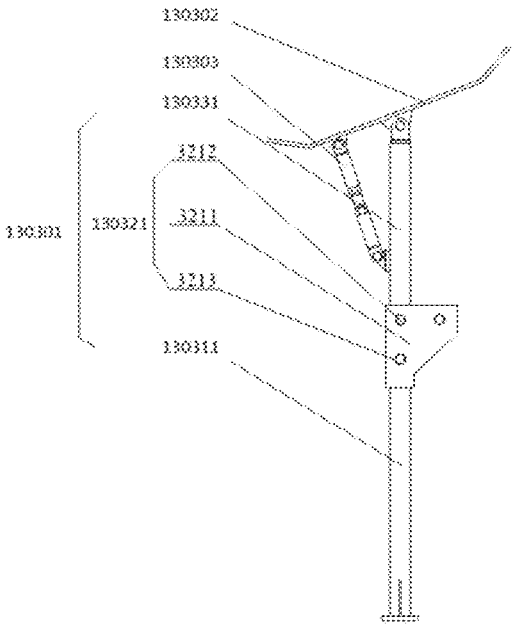
FIG. 20 is a schematic diagram of a structure of an elevator pushing mechanism of a manipulator for a workover operation according to an embodiment of the present disclosure in a retraction state.
Figure 21:
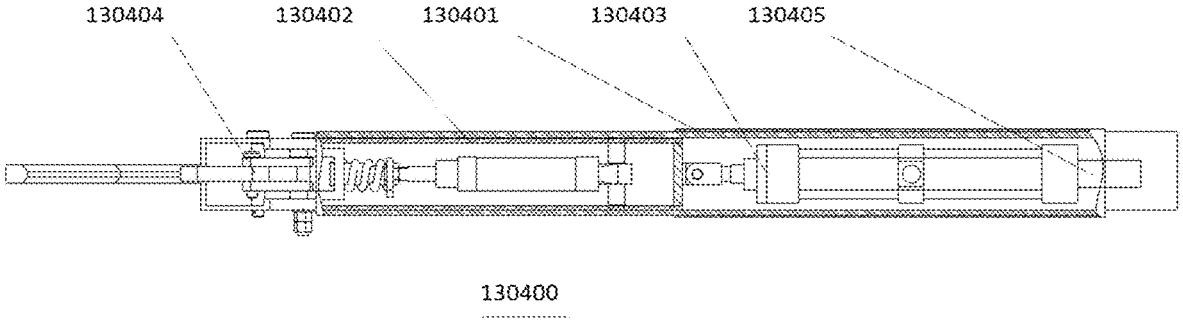
FIG. 21 is a schematic diagram of a structure of a clamping mechanism of a manipulator for a workover operation according to an embodiment of the present disclosure.
Figure 22:
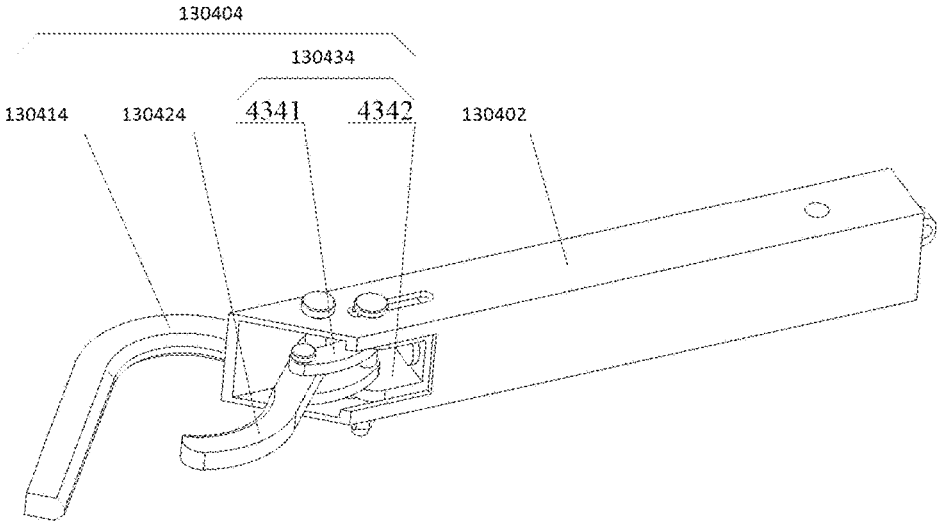
FIG. 22 is a schematic diagram of a structure of a clamping component of a clamping mechanism of a manipulator for a workover operation according to an embodiment of the present disclosure.
Figure 23:
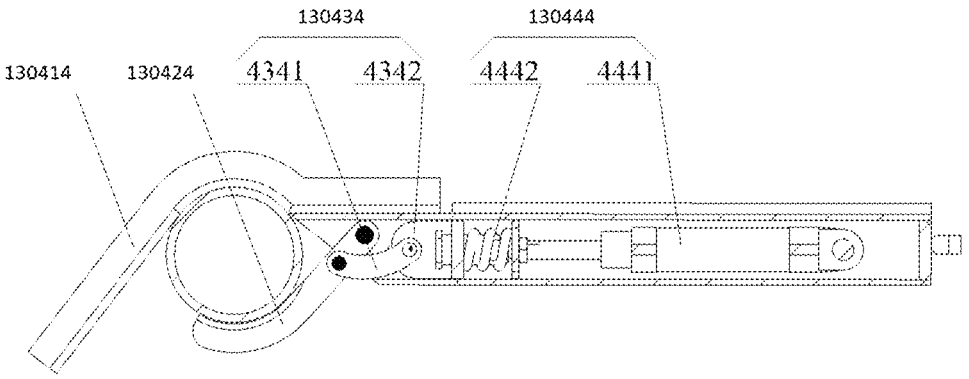
FIG. 23 is a schematic diagram of an internal structure of a sliding sleeve of a clamping mechanism of a manipulator for a workover operation according to an embodiment of the present disclosure.
Figure 24:
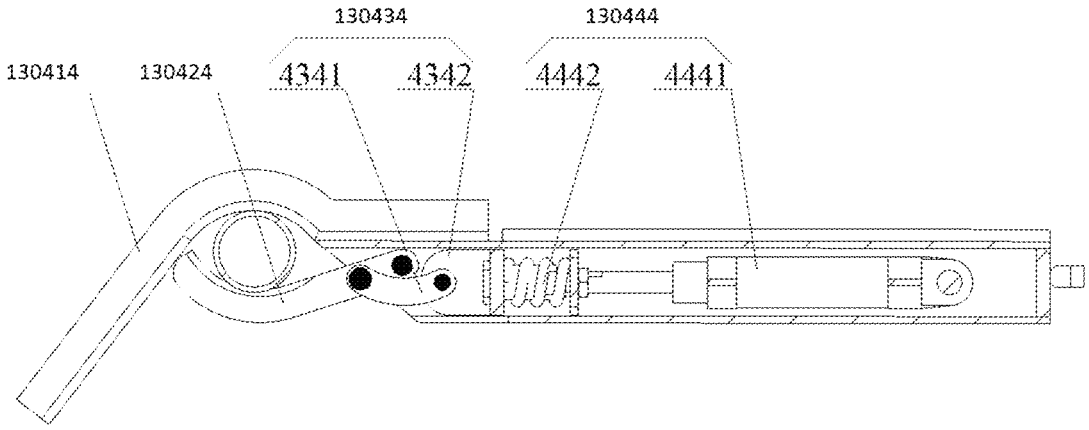
FIG. 24 is a schematic diagram of a sectional structure of a clamping component that clamps a pipe column and that is of a clamping mechanism of a manipulator for a workover operation according to an embodiment of the present disclosure.

As shown in FIGS. 10 and 11, the guide mechanism 1105 of this embodiment includes two guide rails separately installed on the second base 1104. To facilitate transportation of the device, the guide rail of this embodiment is designed to be foldable. Specifically, the guide rail of this embodiment includes a main rail 11051 and an extension rail 11052 that are hinged to each other; the second base 1104 of this embodiment is provided with a fixed support, two sides of which are the foregoing first installation portion 11041 and second installation portion 11042, and the main rail 11051 of this embodiment is installed on the fixed support, and the extension rail 11052 is installed on a movable support base.

To improve the structural stability and the traveling stability of the translation mechanism 1106, the translation mechanism 1106 of this embodiment includes a gantry 11061, a traveling wheel 11062, a first rotation drive component 11063, and a gear (not shown in the figure). Specifically, the gantry 11061 of this embodiment includes a cross beam 611 and a gantry body 612 connected to both ends of the cross beam 611, and the cross beam 611 is installed on the lifting mechanism 1107; an upper end of the gantry body 612 is connected to the cross beam 611, and a lower end of the gantry body 612 is provided with a traveling wheel 11062; and the traveling wheel 11062 is installed on the guide mechanism 1105. The whole height of the device is raised by the gantry 11061, and the height requirement on the guide mechanism 1105 is further reduced.

The first rotation drive component 11063 of this embodiment is installed at a bottom of the gantry 11061, and the first rotation drive component 11063 is connected to a gear and configured to drive the gear to rotate; a rack 11053 is installed to a side portion of the guide rail of guide mechanism 1105, and the gear engages with rack 11053; and the gear is driven to rotate by the first rotation drive component 11063 of this embodiment, and then drives the traveling wheel 11062 and the gantry 11061 as well as the lifting mechanism 1107 of this embodiment to move, so that not only translation is implemented, but also the traveling wheel 11062 and the gantry 11061 can be limited to a certain extent through a connection between the rack 11053 at the side portion and the gear, so as to improve the stability during traveling.

Referring to FIG. 10, the lifting mechanism 1107 of this embodiment includes two support rods 11071, two lifters 11072, a second rotation drive component 11073, a rotating shaft 11074, and an attracting structure 11075. The support rods 11071 of this embodiment are inserted into the translation mechanism 1106, and a lower end of the support rod 11071 passes through the translation mechanism 1106. The lifters 11072 of this embodiment are installed on a top of the translation mechanism 1106, and the two lifters 11072 are in one-to-one transmission connection with the two support rods 11071 respectively. Two ends of the rotating shaft 11074 are respectively in transmission connection with two lifters 11072. The second rotation drive component 11073 of this embodiment is installed on the top of the translation mechanism 1106, the second rotation drive component 11073 is connected to the rotating shaft 11074 and is configured to drive the rotating shaft 11074 to rotate, and both the second rotation drive component 11073 and the first rotation drive component 11063 include a structure that outputs torque, such as a motor.

During lifting and lowering, the second rotation drive component 11073 drives the rotating shaft 11074 to rotate, the rotating shaft 11074 drives the lifter 11072 to move, and the telescopic part 212 in the supporting rod 11071 is lifted to drive the attracting structure 11075 of this embodiment to lift, and the lifter 11072 of this embodiment may have any structure that converts a rotary motion into a linear motion, such as a gear and a rack 11053.

The attracting structure 11075 of this embodiment is installed at a lower end of the supporting rod 11071, and the attracting structure 11075 is configured to magnetically attract the pipe column. The attracting structure 11075 includes an electromagnetic attracting disc, and the electromagnetic attracting disc is magnetic when the power is off, but not magnetic when the power is on, which ensures the safety of the operation process.

The discharging mechanism 1108 of this embodiment includes a cofferdam 11081 and a cross arm 11082; the cofferdam 11081 is box-shaped, a shape of the cofferdam is close to second base 1104, the cofferdam 11081 is connected to the second base 1104, and the cofferdam 11081 is provided with a waste liquid recovery tank; and a plurality of cross arms 11082 are arranged in the waste liquid recovery tank at intervals and divide the waste liquid recovery tank into a plurality of tank bodies, and a height of each cross arm 11082 is greater than or equal to a height of a side wall of the cofferdam 11081. When the pipe is discharged, after each layer of pipe columns are arranged, a layer of cross arm 11082 is additionally arranged, and the case that the waste liquid discharge is influenced when the pipe columns are stacked together is prevented.

An elevator for a workover operation 120 for use in the automatic minor repair operation apparatus system 100 is described in detail below with reference to FIGS. 12 to 17. The following embodiments and features in the embodiments can be combined with each other without conflict.

As shown in FIGS. 12, 13, 14, 15, 16, and 17, the anti-opening mechanism for an elevator according to this embodiment includes: an anti-opening ring 120200, a connecting portion 120300, and an elevator body 120400; the elevator body 120400 includes an elevator main body 120401 and a clamping mechanism 120402, the clamping mechanism 120402 is connected to the elevator main body 120401, the clamping mechanism 120402 includes a side door 120422, and the clamping mechanism 120402 can rotate relative to the elevator main body 120401 in a direction close to or away from the elevator main body 120401 through the side door 120422, so that a clamping channel for clamping the pipe column 1000 can be formed between the clamping mechanism 120402 and the elevator main body 120401; the anti-opening ring 120200 has a through hole 120202 passing through the pipe column 1000, the anti-opening ring 120200 is concentrically arranged with the clamping channel through the through hole 120202, and the anti-opening ring 120200 is connected to the elevator main body 120401 and the clamping mechanism 120402 separately through the connecting portion 120300 to fix the clamping mechanism 120402 to the elevator main body 120401.

It should be noted that the anti-opening mechanism for an elevator provided by this embodiment is a structure for suspending the pipe column 1000 in the automatic workover operation in the oil field, and the clamping mechanism 120402 can move relative to the elevator main body 120401, so that the clamping of the pipe column 1000 by the clamping mechanism 120402 and the elevator main body 120401 is implemented. In addition, after the clamping mechanism 120402 is locked and positioned on the elevator main body 120401, the anti-opening ring 120200 can be connected to the elevator main body 120401 and the clamping mechanism 120402 through the connecting portion 120300, so that the clamping mechanism 120402 can be always in the locked state. In this case, the elevator main body 120401, the clamping mechanism 120402, and the anti-opening ring 120200 form an overall structure, and the stability of clamping the pipe column 1000 is ensured.

Optionally, the anti-opening ring 120200 may be a metal structure ring, where the anti-opening ring 120200 may be a structure sleeved outside a bushing of the clamping mechanism 120402 and the elevator main body 120401, or may be a structure attached to a bushing end portion of the clamping mechanism 120402 and the elevator main body 120401, and the anti-opening ring 120200 makes the clamping mechanism 120402 and the elevator main body 120401 form a whole by using the connecting portion 120300, so that the locking mechanism 120600 of the clamping mechanism 120402 can be always in a locked state, thereby preventing the clamping mechanism 120402 from being opened relative to the elevator main body 120401.

The anti-opening mechanism for an elevator provided by this embodiment may include: an anti-opening ring 120200, a connecting portion 120300, and an elevator body 120400; the elevator body 120400 includes an elevator main body 120401 and a clamping mechanism 120402, the clamping mechanism 120402 is connected to the elevator main body 120401, and the clamping mechanism 120402 can rotate relative to the elevator main body 120401 towards a direction close to or away from the elevator main body 120401, so that a clamping channel for clamping a pipe column 1000 can be formed between the clamping mechanism 120402 and the elevator main body 120401; and the anti-opening ring 120200 is provided with a through hole 120202 passing through the pipe column 1000, the anti-opening ring 120200 is concentrically arranged with the clamping channel by the through hole 120202, and the anti-opening ring 120200 is separately connected to the elevator main body 120401 and the clamping mechanism 120402 by the connecting portion 120300 so as to fix the clamping mechanism 120402 on the elevator main body 120401. In the actual operation process, after the clamping channel is formed, the anti-opening ring

120200 is installed on the elevator main body 120401 and the clamping mechanism 120402 by using the connecting portion 120300, so that the clamping mechanism 120402 and the elevator main body 120401 form an overall structure. Therefore, the clamping mechanism 120402 can always be in a locked state, such that a risk of the clamping mechanism 120402 from being opened relative to the elevator main body 120401 is prevented, and a risk of opening a side door 120422 and a potential safety risk during the use of the elevator existing in the related technology is solved.

Based on the foregoing embodiment, further, in a preferred embodiment of the present disclosure, the elevator main body 120401 includes a first bushing 120411, and the clamping mechanism 120402 includes a second bushing 120412 and a side door 120422; the elevator main body 120401 is provided with an arc surface, the first bushing 120411 is positioned in the arc surface of the elevator main body 120401, and the first bushing 120411 is connected to the arc surface of the elevator main body 120401; the side door 120422 is in an arc structure, and second bushing 120412 is positioned at one side that is of the side door 120422 and that is close to the elevator body 120400, the second bushing 120412 is connected to the side door 120422, the side door 120422 is rotationally connected to the elevator main body 120401 through the rotating shaft, and the side door 120422 is configured to drive the second bushing 120412 to abut against the first bushing 120411 to form a ring structure for clamping the pipe column 1000.

In a preferred embodiment of the present disclosure, a drive mechanism 120500 is further included, where the drive mechanism 120500 is arranged on the elevator body 120400, an output end of the drive mechanism 120500 is in transmission connection with the side door 120422, and the drive mechanism 120500 is configured to drive the side door 120422 to rotate relative to the elevator main body 120401.

Optionally, the elevator main body 120401 is provided with an open slot, and the elevator main body 120401 is in an arc structure. The side door 120422 may be an arc door, where the side door 120422 and one side of the elevator main body 120401 may be connected through a rotating shaft, and the side door 120422 can rotate around the rotating shaft relative to the elevator main body 120401 by the rotating action of the rotating shaft. When the pipe column 1000 needs to be clamped, the drive mechanism 120500 is used to drive the side door 120422 to rotate until the side door 120422 completely abuts against an edge of the other side of the elevator main body 120401, and in this case, the second bushing 120412 on the side door 120422 and the first bushing 120411 on the elevator main body 120401 complete the closing of the clamping channel. Because the pipe column 1000 needs to be clamped by the clamping channel, to ensure the reliability in the clamping process, the end portions of the first bushing 120411 sequentially abut against the end portions of the second bushing 120412, so that a circular ring structure for clamping the pipe column 1000 is formed, and in this case, the first bushing 120411 and the second bushing 120412 can apply a more stable clamping force to the pipe column 1000.

Optionally, the drive mechanism 120500 may be driven by a hydraulic cylinder. Specifically, a piston rod of the drive mechanism 120500 drives the side door 120422 to rotate relative to the rotating shaft. When the second bushing 120412 completely abuts against the first bushing 120411, the hydraulic cylinder reaches a full stroke, and the hydraulic cylinder can maintain the locking clamping of the side door 120422 in a locked state; and under the action of the locking clamping state, the anti-opening ring 120200 is fixedly connected to the circular ring structure formed by the first bushing 120411 and the second bushing 120412, so that the stability of the clamping channel can be better maintained.

In a preferred embodiment of the present disclosure, the anti-opening ring 120200 is provided with a plurality of first connection holes 120201, the first bushing 120411 is provided with second connection holes 120421, the second bushing 120412 is provided with third connection holes 120432, and a quantity of the first connection holes 120201 is greater than or equal to a sum of the second connection holes 120421 and the third connection holes 120432; the anti-opening ring 120200 is attached to a circular ring structure formed by the first bushing 120411 and the second bushing 120412, the connecting portion 120300 includes first connecting portions and second connecting portions, a quantity of the first connecting portions is set corresponding to a quantity of the second connection holes 120421, and the first connecting portions are configured to sequentially pass through the first connection holes 120201 and the second connection holes 120421; and a quantity of second connecting portions is set corresponding to a quantity of the third connection holes 120432, and the second connecting portions are configured to sequentially pass through the first connection hole 120201 and the third connection hole 120432, so as to fixedly connect the anti-opening ring 120200 with the first bushing 120411 and the second bushing 120412.

In a preferred embodiment of the present disclosure, a quantity of the second connection holes 120421 may be at least two, and a quantity of the third connection holes 120432 may be at least two.

In this embodiment, the connecting portion 120300 may be a connecting bolt, that is, both the first connecting portion and the second connecting portion may be bolts, and threaded segments are arranged in the second connection hole 120421 and the third connection hole 120432 of the first bushing 120411 and the second bushing 120412. When the anti-opening ring 120200 is attached to the first bushing 120411 and the second bushing 120412, a position of the first connection hole 120201 corresponds to positions of the second connection hole 120421 and the third connection hole 120432, and after the connecting bolts pass through the first connection hole 120201, the connecting bolt can be separately in threaded connection with the threaded segments inside the second connection hole 120421 or the third connection hole 120432, so as to ensure that the anti-opening rings 120200 may be separately in integral connection with the first bushing 120411 and the second bushing 120412. In addition, the connecting portion 120300 may also be in the form of a pin shaft. Details are not described herein again.

Optionally, a quantity of the first connection holes 120201 may be five, a quantity of the second connection holes 120421 may be three, and a quantity of the third connection holes 120432 may be two. The second connection holes 120421 are uniformly arranged along an end portion of the first bushing 120411, the third connection holes 120432 are uniformly arranged along an end portion of the second bushing 120412, and the first connection holes 120201 are uniformly arranged along a surface of the anti-opening ring 120200, so that the first connection holes 120201 may be separately attached to and correspond to the second connection holes 120421 and the third connection holes 120432.

In a preferred embodiment of the present disclosure, the elevator body 120400 further includes a spring bolt 120403; and the spring bolt 120403 is connected to the elevator main body 120401, the clamping mechanism 120402 and the spring bolt 120403 can rotate towards an opposite direction relative to the elevator main body 120401, and the spring bolt 120403 is configured to connect to the clamping mechanism 120402, so as to fix the clamping mechanism 120402 on the elevator main body 120401.

In a preferred embodiment of the present disclosure, the elevator body 120400 further includes a locking mechanism 120600; the locking mechanism 120600 includes a pin shaft and a spring; a notch is formed in one side that is of the side door 120422 and that is close to the spring bolt 120403, and a convex lock hole 120413 configured to be matched with the notch is correspondingly formed in the spring bolt 120403; a stepped hole is formed in the side door 120422 above the notch, the pin shaft is inserted into the stepped hole and abuts against the second bushing 120412, and the second bushing 120412 is configured to drive the pin shaft to move in the stepped hole; and the spring is sleeved over the pin shaft, two ends of the spring respectively abut against the pin shaft and the step of the stepped hole, and the spring has an elastic trend so that the pin shaft is far away from the notch.

In this embodiment, because the pipe column 1000 has its own weight, the pipe column 1000 exerts a downward acting force on the first bushing 120411 and the second bushing 120412, and the movement of the second bushing 120412 in a vertical direction can drive the pin shaft to move in the vertical direction.

Optionally, the spring may be a telescopic spring. Without the action of the pipe column 1000, the pin shaft ejects under the action of the spring, and pushes up the second bushing 120412. When the pipe column 1000 enters the clamping channel, the side door 120422 is already in a closed state relative to the elevator main body 120401, and the convex lock hole 120413 of the spring bolt 120403 extends into the notch of the side door 120422. When a hoisting mechanism of the pipe column 1000 is removed, the pipe column 1000 presses the second bushing 120412 downward under the action of its own weight, and the second bushing 120412 can further overcome the acting force of the spring, so that the pin shaft is inserted into the convex lock hole 120413, and the mechanical locking between the side door 120422 and the spring bolt 120403 is achieved.

In a preferred embodiment of the present disclosure, a turnover mechanism 120700 is further included; and the elevator body 120400 is provided with a turnover baffle, the turnover mechanism 120700 is connected to the elevator body 120400 through the turnover baffle, and the turnover mechanism 120700 is configured to adjust an angle of the clamping channel through the elevator body 120400.

Optionally, the turnover mechanism 120700 may be secured to the turnover baffle by a plurality of bolts. Optionally, the turnover mechanism 120700 may include a turnover housing, an installation mechanism, a turnover hydraulic drive mechanism, a transmission mechanism, a hanging ring locking block, and a swing bar; the hanging ring locking block is connected to the turnover housing, the turnover housing is connected to an external hanging ring through the hanging ring locking block, the swing bar is positioned at one end that is of the turnover housing and that is far away from the hanging ring locking block, and the swing bar is configured to be connected to the turnover baffle on the elevator body 120400; the installation mechanism, the turnover hydraulic drive mechanism and the transmission mechanism are all positioned in the turnover housing, the turnover hydraulic drive mechanism is connected to an end surface of the turnover housing through the installation mechanism, the installation mechanism is configured to adjust a position of the turnover hydraulic drive mechanism on the turnover housing, and an output end of the turnover hydraulic drive mechanism is in transmission connection with the swing bar through the transmission mechanism, so as to drive the swing bar to rotate relative to the turnover housing.

One end of the turnover housing is connected to an external hanging ring through a hanging ring locking block, and the other end of the turnover housing is connected to the elevator body 120400 through a swing bar. The turnover hydraulic drive mechanism is connected to an inner wall of the turnover housing through an installation mechanism, where the installation mechanism may include a screw and a fixed base, the turnover hydraulic drive mechanism may be a hydraulic cylinder, the fixed base is connected to a fixed end of the turnover hydraulic drive mechanism, and one side of the fixed base far away from the turnover hydraulic drive mechanism is fixedly connected to the screw. The screw can extend out of the turnover housing to be connected to an adjusting nut, and a position of the turnover hydraulic drive mechanism in the turnover housing can be adjusted by movement using a thread of the adjusting nut.

The turnover elevator provided by this embodiment includes an anti-opening mechanism for an elevator. Since the technical effect of the turnover elevator provided by this embodiment is the same as that of the anti-opening mechanism for an elevator provided by the foregoing embodiment, details are not described herein again.

A manipulator for a workover operation 130 for use in the automatic minor repair operation apparatus system 100 is described in detail below with reference to FIGS. 18 to 24. The following embodiments and features in the embodiments can be combined with each other without conflict.

As shown in FIGS. 18 to 24, the manipulator for a workover operation provided by this embodiment includes: a rotation drive mechanism 130100, a rotary main body 130200, an elevator pushing mechanism 130300, and a clamping mechanism 130400; the clamping mechanism 130400 and the elevator pushing mechanism 130300 are both connected to the rotary main body 130200, the rotation drive mechanism 130100 is connected to one end of the rotary main body 130200, and the rotation drive mechanism 130100 is configured to drive the clamping mechanism 130400 and the elevator pushing mechanism 130300 to rotate circumferentially in a horizontal direction through the rotary main body 130200, so that the clamping mechanism 130400 and the elevator pushing mechanism 130300 are positioned at a pipe receiving and conveying position in a wellhead center, and the clamping mechanism 130400 is configured to clamp an external pipe column; and the elevator pushing mechanism 130300 is configured to abut against an external elevator to push the external elevator to move in a horizontal direction.

It should be noted that the manipulator for a workover operation provided by this embodiment belongs to a structure of an automatic workover device, the rotary main body 130200 is a support main body of an overall structure and the elevator pushing mechanism 130300 and the clamping mechanism 130400 are connected to the rotary main body 130200. When the rotary main body 130200 is driven by the rotation drive mechanism 130100 to rotate, the elevator pushing mechanism 130300 and the clamping mechanism 130400 can rotate in the horizontal direction along with the rotation of the rotary main body 130200, where the rotary main body 130200 can drive the clamping mechanism 130400 to move to the wellhead center, and simultaneously, the elevator pushing mechanism 130300 can abut against an external elevator in the moving process, that is, the elevator is synchronously driven to move to the wellhead center, so that the pipe column in the elevator is clamped and fixed by the clamping mechanism 130400.

Optionally, the rotary main body 130200 may include a rotary lower support, a rotary fixed support 130321, a rotary upper support, and an upright arm; and the rotation drive mechanism 130100 may be a drive motor or a rotary hydraulic cylinder, and preferably, the rotation drive mechanism 130100 is a rotary hydraulic cylinder.

In this embodiment, the rotary lower support is connected to a first drive end of the rotation drive mechanism 130100, the rotary fixed support 130321 is fixedly connected to an outer cylinder wall of the rotation drive mechanism 130100, the rotary upper support is connected to a second drive end of the rotation drive mechanism 130100, and the upright arm can be connected to the rotary upper support and the rotary lower support separately; and when the rotation drive mechanism 130100 rotates relative to the rotary fixed support 130321, the first drive end and the second drive end of the rotation drive mechanism 130100 drive the rotary upper support and the rotary lower support to rotate synchronously, so that the upright arm can rotate in a circumferential direction. The rotary main body is connected to the elevator pushing mechanism 130300 and the clamping mechanism 130400 separately along an extension direction of the upright arm.

In a preferred embodiment of the present disclosure, a rotation control sensing mechanism 130500 may be further included; and the rotation control sensing mechanism 130500 is positioned on the rotary main body 130200, the rotation drive mechanism 130100 is in electric signal connection with the rotation control sensing mechanism 130500, and the rotation control sensing mechanism 130500 is configured to control a rotation angle of the rotation drive mechanism 130100.

Optionally, the rotation control sensing mechanism 130500 may include a rotation sensor and a controller electrically connected to each other, where the rotation sensor is configured to detect a rotation angle of the upright arm and transmit the rotation angle information to the controller, the controller can control the rotation angle of the rotation drive mechanism according to a control instruction, and by using the precise control of the rotation angle of the rotation drive mechanism by the rotation control sensing mechanism 130500, the manipulator can be accurately positioned at the wellhead center and the pipe receiving and conveying position of a conveyor.

The manipulator for a workover operation provided by this embodiment includes: a rotation drive mechanism 130100, a rotary main body 130200, an elevator pushing mechanism 130300, and a clamping mechanism 130400; the clamping mechanism 130400 and the elevator pushing mechanism 130300 are connected to the rotary main body 130200, the rotation drive mechanism 130100 is connected to one end of the rotary main body 130200, and the rotation drive mechanism 130100 drives the clamping mechanism 130400 and the elevator pushing mechanism 130300 to rotate circumferentially in a horizontal direction by the rotary main body 130200, such that the clamping mechanism 130400 and the elevator pushing mechanism 130300 are positioned at a pipe receiving and conveying position in a wellhead center, and the manipulator is accurately positioned at the wellhead center and the pipe receiving and conveying position of a conveyor. Further, the elevator pushing mechanism 130300 is configured to abut against an external elevator to push the external elevator to move in the horizontal direction; through a synchronous motion of the elevator pushing mechanism 130300 relative to the rotary main body 130200, the elevator pushing mechanism 130300 pushes the external elevator to the wellhead center, which implements the effect that the elevator accurately clamps a pipe column, and solves the following technology problems in the related technology: a fixed position of the manipulator leads to a high precision requirement for the installation position of the pipe column conveyor, which affects the efficiency of on-site operations, and causes poor adaptability of a workover device, inability to overcome the swing of the elevator, and poor pipe gripping stability.

Based on the foregoing embodiment, further, in a preferred embodiment of the present disclosure, the elevator pushing mechanism 130300 includes a pushing main body 130301, a push plate 130302, and an angle adjusting mechanism 130303; one end of the pushing main body 130301 is connected to the rotary main body 130200, the other end of the pushing main body 130301 is hinged to the push plate 130302, two ends of the angle adjusting mechanism 130303 are respectively hinged to one sides of the pushing main body 130301 and one side of the push plate 130302, and the angle adjusting mechanism 130303 is configured to drive the push plate 130302 to rotate relative to the pushing main body 130301, so that the push plate 130302 abuts against the external elevator at an angle.

In this embodiment, since the external elevator is subjected to positional deviation under the influence of wind force and lowering speed, the angle adjusting mechanism 130303 may be configured to rotate the push plate 130302 relative to the pushing main body 130301, so that the push plate 130302 can be completely attached to the elevator by using the push plate 130302 in an open structure.

Optionally, the angle adjusting mechanism 130303 may be a telescopic hydraulic cylinder, a center position of the push plate 130302 may be hinged to the pushing main body 130301, the telescopic hydraulic cylinder is obliquely arranged between the push plate 130302 and the pushing main body 130301, and two ends of the telescopic hydraulic cylinder are respectively hinged to the push plate 130302 and the pushing main body 130301. When the telescopic hydraulic cylinder pushes one side of the push plate 130302, the push plate 130302 can rotate relative to the pushing main body 130301, so that the push plate 130302 can adapt to the change of the deflection angle of the elevator.

In a preferred embodiment of the present disclosure, the pushing main body 130301 includes a first pushing arm 130311, a fixed support 130321, and a second pushing arm 130331; the first pushing arm 130311 and the second pushing arm 130331 are connected through a fixed support 130321, the fixed support 130321 is configured to vertically arrange the first pushing arm 130311 and the second pushing arm 130331, one end that is of the first pushing arm 130311 and that is far away from the second pushing arm 130331 is connected to the rotary main body 130200, and one end that is of the second pushing arm 130331 and that is far away from the first pushing arm 130311 is hinged to the push plate 130302.

Optionally, the connection of the first pushing arm 130311 to the rotary main body 130200 can be of various forms. For example, the first pushing arm 130311 can be detachably connected to the rotary main body 130200 by a fixed plate and a fixed bolt, or can be directly fixedly connected to the rotary main body 130200 by welding. Preferably, one end of the first pushing arm 130311 is fixedly connected to a fixed plate, the fixed plate is provided with connection holes, and a plurality of rows of connection holes are arranged along an extending direction of the rotary main body 130200. When the first pushing arm 130311 needs to be connected to the rotary main body 130200, the height adjustment of the pushing main body 130301 on the rotary main body 130200 is implemented by bolts passing through the connection holes on the fixed plate and the connection holes at a predetermined position of the rotary main body 130200, so that the push plate 130302 can better adapt to coupling at elevator positions with different heights.

In a preferred embodiment of the present disclosure, the fixed support 130321 includes a support main body 3211, a first adjusting pin shaft 3212, and a second adjusting pin shaft 3213; the support main body 3211 is provided with clamping grooves, the first pushing arm 130311 and the second pushing arm 130331 are inserted into the clamping grooves of the support main body 3211, and the first pushing arm 130311 can rotate relative to the support main body 3211; the support main body 3211 is provided with a first fixing hole, a second fixing hole, and a third fixing hole; the first fixing hole and the second fixing hole are positioned on a same straight line, the first fixing hole and the third fixing hole are positioned on a same straight line, and a connecting line of the first fixing hole and the second fixing hole is arranged vertically relative to a connecting line of the first fixing hole and the third fixing hole. The first adjusting pin shaft 3212 is configured to sequentially pass through the first fixing hole, the first pushing arm 130311, and the second pushing arm 130331, so as to fix the first pushing arm 130311 and the second pushing arm 130331 in the clamping groove of the support main body 3211; and the second adjusting pin shaft 3213 is configured to be separately connected to the second fixing hole and the third fixing hole, so as to adjust the first pushing arm 130311 and the second pushing arm 130331 to be vertically arranged, or to adjust the first pushing arm 130311 and the second pushing arm 130331 to be linearly arranged.

In this embodiment, the pushing main body 130301 has two use states, to meet a transportation requirement during transportation. When the first pushing arm 130311 and the second pushing arm 130331 are set in a straight line, the first pushing arm 130311 is rotated along the clamping groove of the support main body 3211, and when the first pushing arm 130311 and the second pushing arm 130331 are set in a straight line, the second adjusting pin shaft 3213 is sequentially inserted into the second fixing hole and the fixing hole of the first pushing arm 130311, so that the first pushing arm 130311 is fixed. In a use state, the first pushing arm 130311 and the second pushing arm 130331 are vertically arranged, in this case, the first pushing arm 130311 rotates along the clamping groove of the support main body 3211, and when the first pushing arm 130311 and the second pushing arm 130331 are vertically arranged, the second adjusting pin shaft 3213 is sequentially inserted into the third fixing hole and the fixing hole of the first pushing arm 130311, so that the first pushing arm 130311 is fixed.

It should be noted that the first adjusting pin shaft 3212 serves as a rotation center of the first pushing arm 130311, the first adjusting pin shaft 3212 is connected to the first fixing hole, and the first adjusting pin shafts 3212 can be separately connected to the first pushing arm 130311 and the second pushing arm 130331; and when the second adjusting pin shaft 3213 is connected to the third fixing hole, an adjusting pin shaft needs to be arranged in the second fixing hole to ensure stability of the second pushing arm 130331, so that the second pushing arm 130331 can be fixed in the clamping groove of the fixed support 130321.

In a preferred embodiment of the present disclosure, the clamping mechanism 130400 includes a fixed sleeve 130401, a sliding sleeve 130402, a telescopic drive mechanism 130403, and a clamping assembly 130404; the telescopic drive mechanism 130403 is positioned in the fixed sleeve 130401, a fixed end of the telescopic drive mechanism 130403 is connected to an inner wall of one end of the fixed sleeve 130401, and the fixed sleeve 130401 is fixedly connected to the rotary main body 130200; and a telescopic end of the telescopic drive mechanism 130403 is connected to one end that is of the sliding sleeve 130402 and that is at the fixed sleeve 130401, the sliding sleeve 130402 is connected to the fixed sleeve 130401 in a sliding manner, and one end that is of the sliding sleeve 130402 and that extends out of the fixed sleeve 130401 is connected to the clamping assembly 130404.

In a preferred embodiment of the present disclosure, the clamping mechanism 130400 further includes a linear-motion-control sensing mechanism 130405; the linear-motion-control sensing mechanism 130405 is positioned in the fixed sleeve 130401, the telescopic drive mechanism 130403 is in electric signal connection with the linear-motion-control sensing mechanism 130405, and the linear-motion-control sensing mechanism 130405 is configured to control a telescopic length of the telescopic drive mechanism 130403.

In this embodiment, an end portion of the fixed sleeve 130401 is fixedly connected to the rotary main body 130200, and the telescopic drive mechanism 130403 can drive the sliding sleeve 130402 to slide relative to the fixed sleeve 130401, where the sliding sleeve 130402 and the fixed sleeve 130401 can be connected through cooperation between a slide rail and a sliding groove.

Optionally, the telescopic drive mechanism 130403 may be a telescopic hydraulic cylinder, and the linear-motion-control sensing mechanism 130405 may include a linear sensor and a controller that are electrically connected to each other, where the linear sensor is configured to detect telescopic length information of the telescopic hydraulic cylinder and transmit the telescopic length information to the controller, the controller may control the telescopic length of the telescopic hydraulic cylinder according to a control instruction, and the clamping assembly 130404 may be accurately positioned at the wellhead center and the pipe receiving and conveying position of a conveyor by accurately controlling the telescopic length of the telescopic drive mechanism 130403 by using a linear sensor.

In a preferred embodiment of the present disclosure, the clamping assembly 130404 may include a fixed gripper 130414, a movable gripper 130424, a clamping transmission mechanism 130434, and a clamping drive mechanism 130444; and the fixed gripper 130414 is connected to one side of the sliding sleeve 130402, the clamping transmission mechanism 130434, the movable gripper 130424, and the clamping drive mechanism 130444 are all positioned in the sliding sleeve 130402, the clamping drive mechanism 130444 is in a transmission connection with the movable gripper 130424 through the clamping transmission mechanism 130434, and the clamping drive mechanism 130444 is configured to drive the movable gripper 130424 to rotate relative to the fixed gripper 130414 through the clamping transmission mechanism 130434, so as to adjust a clamping distance between the movable gripper 130424 and the fixed gripper 130414.

In a preferred embodiment of the present disclosure, the clamping transmission mechanism 130434 includes a gripper connecting arm 4341 and a gripper connecting support 4342; the clamping drive mechanism 130444 includes a clamping drive portion 4441 and an elastic portion 4442; the elastic portion 4442 is positioned between the gripper connecting support 4342 and the gripping drive portion 4441, and two ends of the elastic portion 4442 abut against the gripper connecting support 4342 and the gripping drive portion 4441, respectively; the gripping drive portion 4441 is configured to compress the elastic portion 4442 to drive the gripper connecting support 4342 to reciprocate along the sliding sleeve 130402, and the elastic portion 4442 has an elastic trend such that the gripper connecting support 4342 is far away from the clamping drive portion 4441; and the gripper connecting arm 4342 is hinged to the movable gripper 130424 through the gripper connecting arm 4341, where the gripper connecting arm 4341 is in an arc shape, and the gripper connecting arm 4341 is configured to convert a linear force of the gripper connecting arm 4342 into a rotational force of the movable gripper 130424.

In this embodiment, the fixed gripper 130414 is in an arc structure, and one end of the fixed gripper 130414 is fixedly connected to one side of the sliding sleeve 130402, and the movable gripper 130424 pushes the gripper connecting support 4342 through the clamping drive portion 4441 to drive the gripper connecting arm 4341 to perform an arc motion. Optionally, the clamping drive portion 4441 may be a hydraulic cylinder, and the hydraulic cylinder can reciprocate inside the sliding sleeve 130402 along an extending direction of the sliding sleeve 130402. When the hydraulic cylinder drives the gripper connecting support 4342 to reciprocate in a linear direction, the gripper connecting arm 4341 is in an arc structure, so that the gripper connecting arm 4341 can convert a linear acting force into an opening-and-closing drive force of the movable gripper 130424.

In this embodiment, since the fixed gripper 130414 and the movable gripper 130424 grip a pipe column, when a pipe column with a large pipe diameter needs to be gripped, the gripping drive portion 4441 is used to drive the movable gripper 130424 to perform clamping rotation towards the fixed gripper 130414, so that the pipe column can be gripped and fixed. Optionally, the elastic portion 4442 may be a compression spring, when the clamping drive portion 4441 is extended, the clamping drive portion 4441 will compress the compression spring, and when the movable gripper 130424 and the fixed gripper 130414 clamp the pipe column, the compression spring will apply an elastic force close to the fixed gripper 130414 to the movable gripper 130424, so as to ensure the stability of clamping the pipe column. Further, when a pipe column with a large diameter needs to be clamped, the clamping drive portion 4441 is used to drive the movable gripper 130424 to perform clamping rotation towards the fixed gripper 130414, and when the clamping drive portion 4441 reaches a full stroke, it is still impossible to ensure that the movable gripper 130424 and the fixed gripper 130414 perform stable clamping on the pipe column. In this case, the compression spring continues to drive the movable gripper 130424 to move towards the fixed gripper 130414 under the action force of an elastic trend, so that an elastic action force close to the fixed gripper 130414 is applied to the movable gripper 130424, and the stability of clamping the pipe column can be further ensured. The clamping mechanism 130400 can stably clamp the pipe columns with various specifications through the matching structures of the clamping drive portion 4441 and the elastic portion 4442, so that the design is more reasonable.

The workover operation device provided by this embodiment includes the manipulator for a workover operation. Since the technical effect of the workover operation device provided by this embodiment is the same as that of the manipulator for a workover operation provided by the foregoing embodiment, details are not described herein again.

An integrated automatic wellhead operation apparatus 140 for use in the automatic minor repair operation apparatus system 100 is described in detail below with reference to FIGS. 25 to 33. The following embodiments and features in the embodiments can be combined with each other without conflict.

Figure 25:
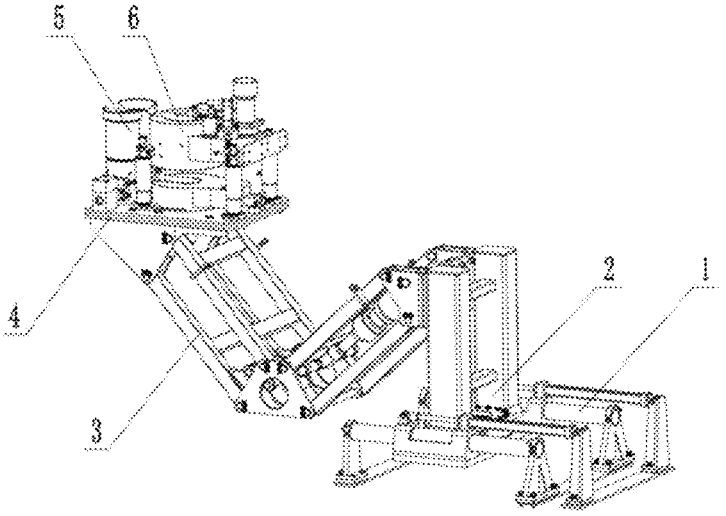
FIG. 25 is a schematic diagram of a structure of the present disclosure in an expanded state.
Figure 26:
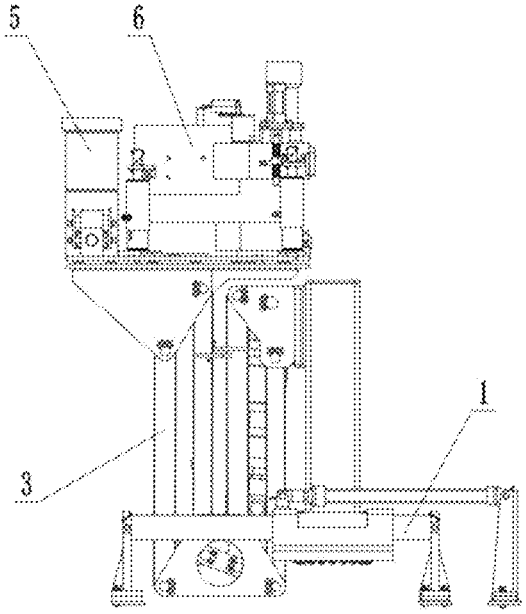
FIG. 26 is a schematic diagram of a structure of the present disclosure in a folded state.
Figure 27:
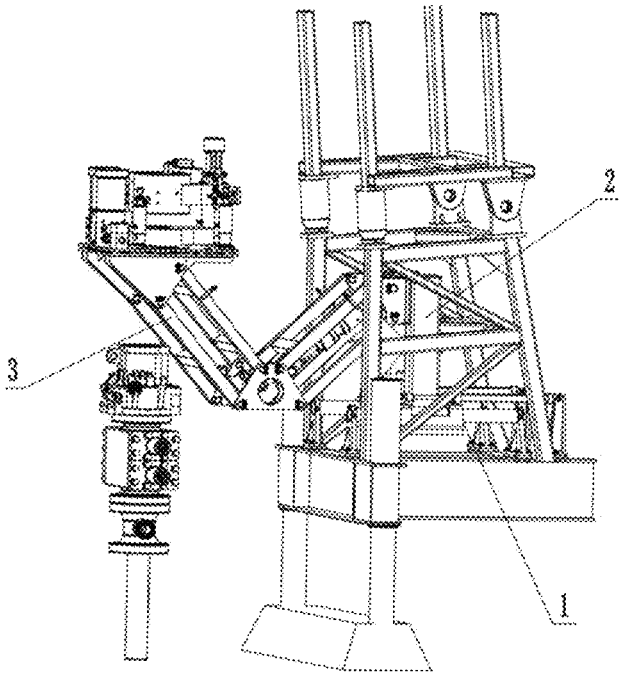
FIG. 27 is a schematic diagram of a structure of the present disclosure in a use state.

Some embodiments of the present disclosure are described below with reference to FIGS. 25 to 27. Referring to FIGS. 25 to 27, the integrated automatic wellhead operation apparatus includes a bracket 4, an anti-splash buckling device 5, a hydraulic clamp 6, a transferring mechanism 1, a rotating mechanism 2, and a pushing mechanism 3, where the anti-splash buckling device 5 and the hydraulic clamp 6 are fixedly connected to the bracket 4.

The transferring mechanism 1 is provided with a connecting bottom plate 101 sliding transversely, the rotating mechanism 2 is fixed on the connecting bottom plate 101, a top of the rotating mechanism 2 is a rotating end, the rotating end is connected to a rear end of the pushing mechanism 3, and a front end of the pushing mechanism 3 fixedly supports the bracket 4.

During operation, a bottom of the transferring mechanism 1 is fixed on a chassis of a workover machine, a derrick is erected after the workover machine reaches a proper position of a wellhead, and the anti-splash buckling device 5 or the hydraulic clamp 6 is pushed to a position close to a wellhead center through the transferring mechanism 1.

Then an angle of the bracket 4 is adjusted through the rotating mechanism 2, so that the anti-splash buckling device 5 or the hydraulic clamp 6 can be accurately aligned to the wellhead center during operation for performing operation.

After the operation is completed, the pushing mechanism 3 and the transferring mechanism 1 are controlled to retract the bracket 4, so that enough space is provided for the elevator lowering in a next process.

The present disclosure implements mechanized anti-splash buckle operation and buckling and unbuckling operation through the cooperation of the transferring mechanism 1, the rotating mechanism 2, and the pushing mechanism 3.

Some other embodiments of the present disclosure are described below with reference to FIG. 28.

This embodiment is further optimized based on the foregoing embodiments, specifically as shown below.

Figure 28:
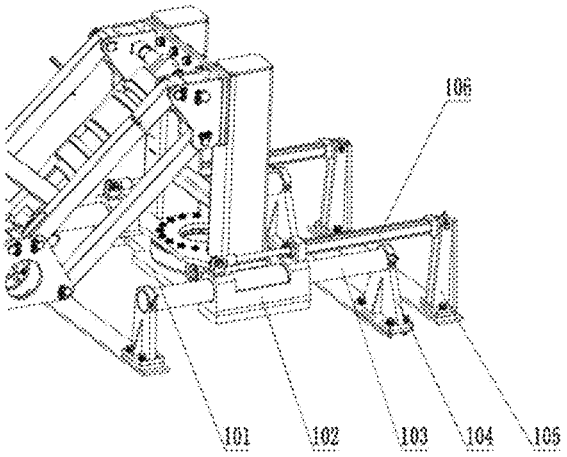
FIG. 28 is a schematic diagram of a structure of a transferring mechanism.

Referring to FIG. 28, the transferring mechanism 1 includes a base 104, two transverse guide rails 103 are fixedly connected to the base 104, and the two guide rails 103 are arranged in parallel.

Each of the guide rails 103 is connected to a slide bushing 102 in a sliding manner, and the two slide bushings 102 are separately fixedly connected to two ends of the connecting bottom plate 101.

A support base 105 is arranged at a rear of the base 104, a first hydraulic cylinder 106 is arranged between the support base 105 and the slide bushing 102, and two ends of the first hydraulic cylinder 106 respectively are hinged to the slide bushing 102 and the support base 105.

Both two sets of the support bases 105 and two sets of the first hydraulic cylinders 106 are provided and respectively matched with two slide bushings 102, and the support base 105 and the base 104 are separately connected to a chassis bolt of the workover machine in use.

In this embodiment, the first hydraulic cylinder 106 drives the slide bushing 102 to move back and forth, and then the rotating mechanism 2 and the pushing mechanism 3 are driven to move back and forth by the connecting bottom plate 101 connected to the slide bushing 102.

Still some other embodiments of the present disclosure are described below with reference to FIGS. 29 to 31.

This embodiment is further optimized based on the foregoing embodiments, specifically as shown below.

Figure 29:
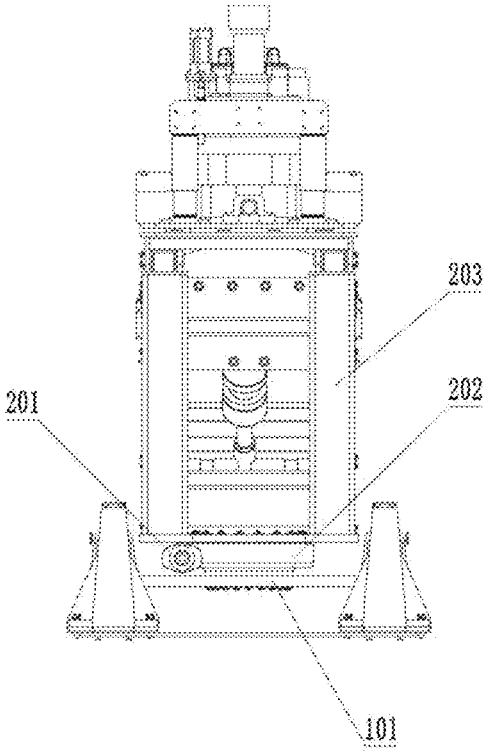
FIG. 29 is a schematic diagram of a structure of a rotating mechanism.
Figure 30:
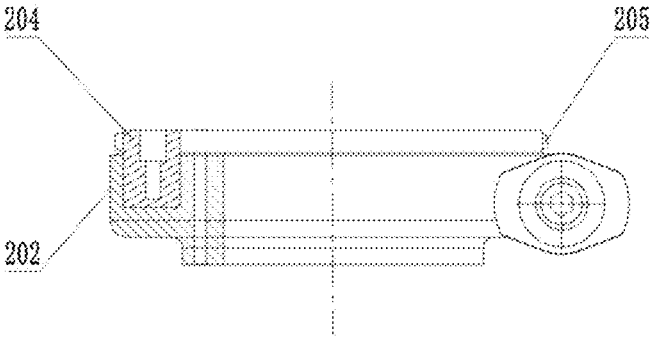
FIG. 30 is a schematic diagram of a fitting structure of a fixed base and a rotary table.
Figure 31:
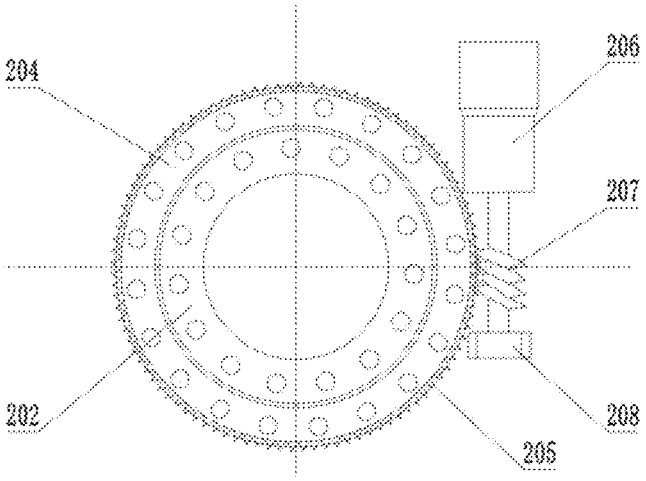
FIG. 31 is a schematic diagram of a fitting structure of a worm wheel and a worm.

Referring to FIGS. 29 to 31, the rotating mechanism 2 includes a fixed base 202 and a drive mechanism 201.

The fixed base 202 is fixed at an upper end of the connecting bottom plate 101, a rotary table 204 is rotatably connected above the fixed base 202, a worm wheel 205 is sleeved on a periphery of the rotary table 204, a support beam 203 is connected to an upper end of the rotary table 204, and an upper end of the support beam 203 is connected to a rear end of the pushing mechanism 3.

The drive mechanism 201 includes a hydraulic motor 206, a worm 207 is installed on a rotating shaft of the hydraulic motor 206, and the worm 207 is in meshing transmission with the worm wheel 205.

The rotary table 204 may be of a ring structure, an annular groove matched with the rotary table 204 may be arranged above the fixed base 202, and a bottom of the rotary table 204 is rotatably connected to the annular groove.

In this embodiment, the hydraulic motor 206 rotates and drives the support beam 203 as a rotating end to rotate, thereby driving the pushing mechanism 3 to rotate.

In addition, a knob 208 is fixedly connected to a tail end of the rotating shaft of the hydraulic motor 206, manual operation can be implemented by adding the knob 208, and an extension rod is detachably connected to the knob 208, so that the knob 208 can be rotated more easily.

Yet some other embodiments of the present disclosure are described below with reference to FIG. 32.

This embodiment is further optimized based on the foregoing embodiments, specifically as shown below.

Figure 32:
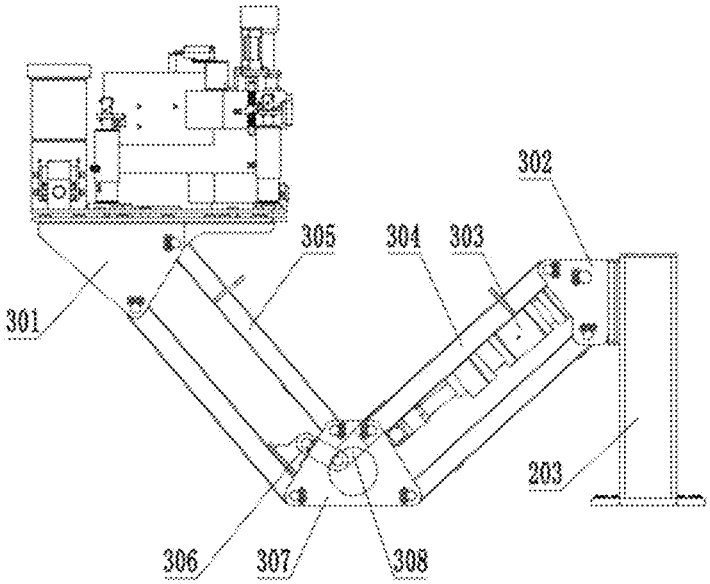
FIG. 32 is a schematic diagram of a structure of a pushing mechanism.

Referring to FIG. 32, the pushing mechanism 3 includes a first connecting base 301, a second connecting base 302, a second hydraulic cylinder 303, and V-shaped folding arm groups, and two V-shaped folding arm groups are preferably arranged in parallel.

The V-shaped folding arm group includes a first support arm 305, a second support arm 304, a trapezoidal base 307, and a connecting rod 306, where the two first support arms 305 are arranged in parallel, an upper end of each first support arm 305 is hinged to the first connecting base 301, and a lower end of each first support arm 305 is hinged to a front end of the trapezoidal base 307.

The two second support arms 304 are arranged in parallel, an upper end of each second support arm 304 is hinged to the second connecting base 302, and an lower end of each second support arm 304 is hinged to the rear end of the trapezoidal base 307; and an extension block 308 is arranged at a bottom of one of the second support arms 304, a lower end of the extension block 308 is hinged to one end of the connecting rod 306, and the other end of the connecting rod 306 is hinged to a bottom of one of the first support arms 305.

One end of the second hydraulic cylinder 303 is hinged to the second connecting base 302, and the other end of the second hydraulic cylinder is hinged to a middle portion of one of the second support arms 304.

When the pushing mechanism 3 is in an unfolded state, the second hydraulic cylinder 303 drives the second support arm 304 to rotate counterclockwise around the second connecting base 302, and the second support arm 304 is rotated to be in a vertical state.

At the same time, the extension block 308 at a bottom of the second support arm 304 pulls the connecting rod 306 backward, so that the first support arm 305 rotates clockwise around the trapezoidal base 307, and folds the V-shaped folding arm.

In this embodiment, the pushing and withdrawing steps during the operation are implemented through the pushing mechanism 3 that can be designed and folded in a V shape. After the operation is completed, the pushing mechanism 3 is folded and matched with the transferring mechanism 1 to move backwards, so that the bracket 4 is quickly withdrawn, and a space is provided for the elevator lowering.

In addition, this embodiment implements more convenient transportation and storage due to a small volume of the pushing mechanism after folding during transportation and storage.

Yet some other embodiments of the present disclosure are described below with reference to FIG. 33.

This embodiment is further optimized based on the foregoing embodiments, specifically as shown below.

Figure 33:
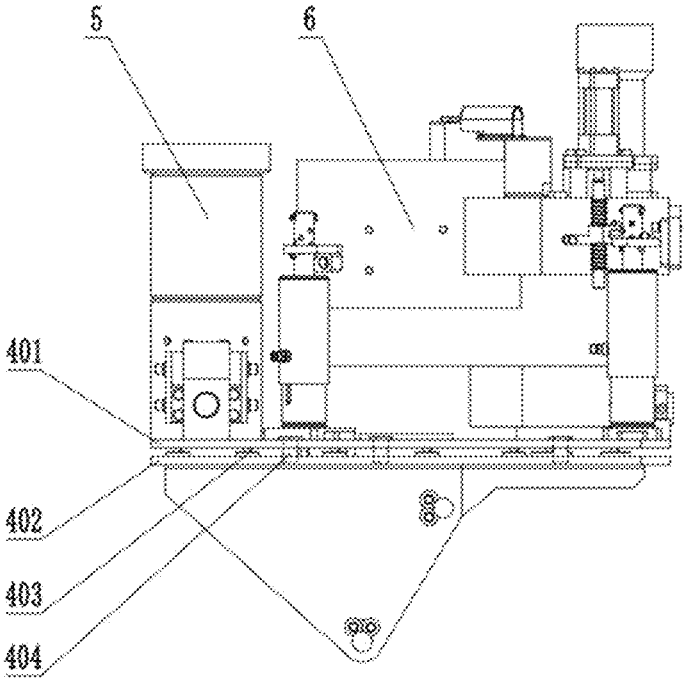
FIG. 33 is a schematic diagram of a structure of a bracket.

Referring to FIG. 33, the bracket 4 may include a U-shaped upper floating plate 401 and a lower bottom plate 402, a group of floating balls 403 for supporting the upper floating plate 401 is arranged on the lower bottom plate 402, a group of pin holes are correspondingly arranged on the upper floating plate 401 and the lower bottom plate 402, and positioning pins 404 are arranged in the pin holes.

In use, the lower bottom plate 402 is fixedly connected to the first connecting base 301, and supports the upper floating plate 401 by floating balls 403, and the hydraulic clamp 6 and the anti-splash buckling device 5 are fixed to the upper floating plate 401.

The floating capacity of the hydraulic clamp 6 and the anti-splash buckling device 5 is implemented through clearance fit between the positioning pin 404 and the pin hole and rolling between the floating ball 403 and the upper floating plate 401.

A power slip for an oil field workover operation 150 for use in the automatic minor repair operation apparatus system 100 is described in detail below with reference to FIGS. 34 to 36. The following embodiments and features in the embodiments can be combined with each other without conflict.

Figure 34:
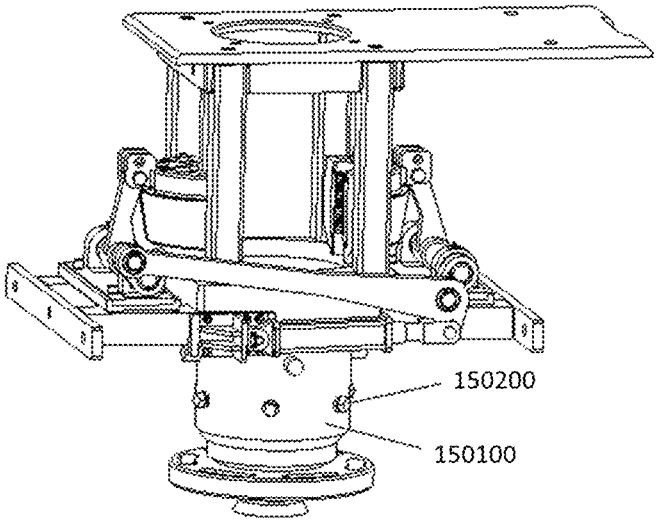
FIG. 34 is a schematic diagram of a structure of a power slip for an oil field workover operation according to an embodiment of the present disclosure.
Figure 35:
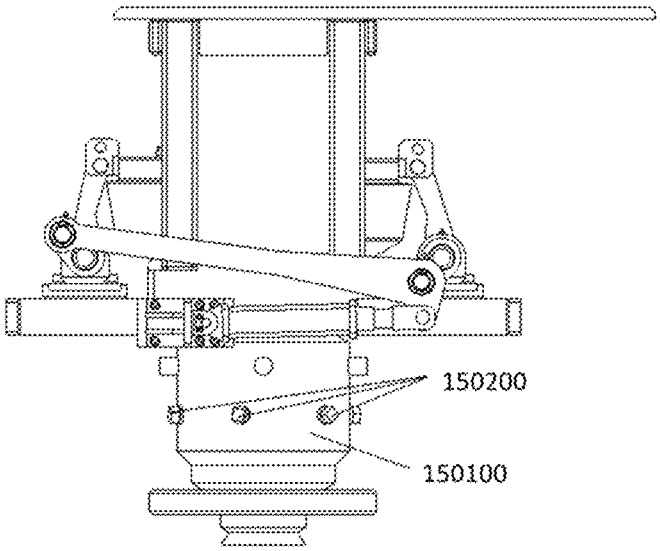
FIG. 35 is a front view of a power slip for an oil field workover operation according to an embodiment of the present disclosure.
Figure 36:
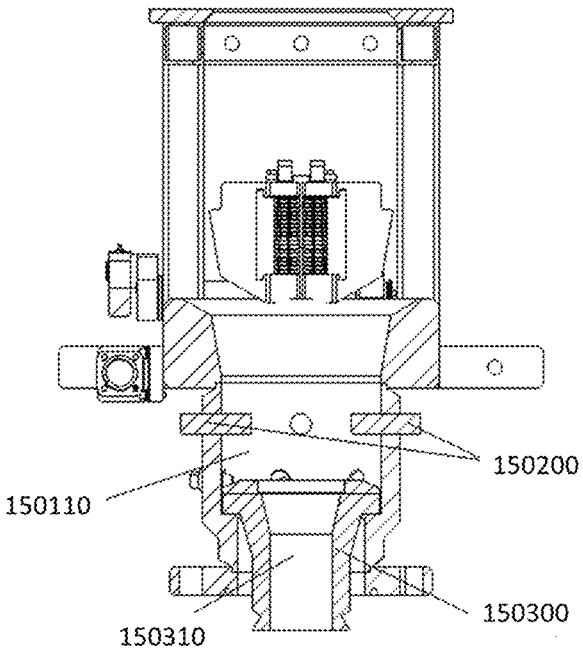
FIG. 36 is a sectional view of a power slip for an oil field workover operation according to an embodiment of the present disclosure.

This embodiment provides a power slip for an oil field workover operation, as shown in FIGS. 34 to 36. The power slip for an oil field workover operation includes a slip housing 150100 and a sensor 150200, where the slip housing 150100 has a first center hole 150110 for a pipe column to pass through, and the sensor 150200 is arranged in the slip housing 150100 for collecting coupling positions on the pipe column.

According to the power slip for an oil field workover operation provided in this embodiment, the slip housing 150100 is provided with a first center hole 150110 for a pipe column to pass through, and the pipe column can pass through the first center hole 150110 during specific operation; the sensor 150200 is arranged in the slip housing 150100, so that when the coupling on the pipe column reaches a position of the 150200, the coupling position on the pipe column can be collected to the sensor 150200, so that automatic detection is implemented. Compared with manual observation in the related technology, the detection mode of the power slip for an oil field workover operation may implement automatic operation, which improves the working efficiency, and meanwhile, the detection of the sensor 150200 is more accurate compared with the manual observation.

Specifically, the sensor 150200 is a point sensor; or, the sensor 150200 is a ring sensor that can be fixedly sleeved on an outer peripheral side of the slip housing 150100.

The sensor 150200 mat have various types. For example, the model of the sensor 150200 that may be used is Turck NI10-G18-Y1X; OMRON: HL-5300; or PEPPERL-FUCHS: NCB4-12GM40-N0.

The Turck NI10-G18-Y1X is taken as an example, this model of sensor 150200 is a proximity switch, also known as a non-contact proximity switch, which is an electronic switch sensor. For example, when a metal detection body (such as a coupling) approaches a sensing area of the switch, the switch can rapidly send out an electric command without contact, pressure, and spark, and accurately reflect a position and a stroke of a motion mechanism.

In this embodiment, when the sensor 150200 is a point sensor, a plurality of sensors 150200 are provided, and the plurality of sensors 150200 are spaced in the circumferential direction of the slip housing 150100.

One or more of the plurality of sensors 150200 collects the coupling position information, which represents that the coupling on the pipe column has reached a set setting.

In this embodiment, a plurality of sensors 150200 are arranged on the same horizontal plane; in this way, the plurality of sensors 150200 can collect the position information of the coupling on the pipe column at the same time.

In other embodiments, the plurality of sensors 150200 may not be arranged on the same horizontal plane, and in this case, when one of the sensors 150200 positioned below fails and cannot be detected, the other sensors 150200 positioned above may collect the position information of the coupling on the pipe column, so as to reduce the occurrence of the missed alarm.

As shown in FIG. 36, the slip housing 150100 is provided with fixing holes equal in quantity to the sensors 150200; and the sensor 150200 may be inserted into the fixing hole, and one end of the sensor 150200 may be positioned in the first center hole 150110 so as to detect the coupling.

Optionally, four sensors 150200 may be provided, and an included angle between two adjacent sensors 150200 is 90°.

In other embodiments, six sensors 150200 may be provided, and an included angle between two adjacent sensors 150200 is 60°.

Referring to FIG. 36, a self-sealing rubber core 150300 may be arranged in the first center hole 150110, the self-sealing rubber core 150300 may have a second center hole 150310, and the second center hole 150310 is in communication with and coaxially arranged with the first center hole 150110; and the second central opening 150310 is accessible for the pipe column to pass through.

The self-sealing rubber core 150300 is added, and the second center hole 150310 is coaxially arranged with the first center hole 150110, so that the oil column can be positioned at a wellhead center.

Referring to FIG. 36 again, a first end of the self-sealing rubber core 150300 is clamped in the first center hole 150110, and a second end of the self-sealing rubber core 150300 is positioned outside the first center hole 150110; and the second center hole 150310 includes a tapered hole and a straight circular hole coaxially arranged, the tapered hole is provided at the first end portion, and the straight circular hole is provided at the second end portion.

This embodiment further provides a workover machine. The workover machine includes a traveling system and a control system, where the traveling system is in transmission connection with the pipe column and is configured to lift the pipe column, and both the sensor 150200 and the traveling system are electrically connected to the control system.

During specific operation, when the sensor 150200 detects the position of a coupling on a pipe column, a signal is sent to the control system, the control system receives the signal, and the traveling system is controlled to decelerate or stop, so that automatic operation is completed.

The automatic minor repair operation apparatus system of some embodiments of the present disclosure accomplishes the pipe lowering process and pipe lifting process by the mutual cooperation of the pipe column conveying and discharging device 110, the anti-opening mechanism for an elevator and the turnover elevator 120, the manipulator for a workover operation 130, the integrated automatic wellhead operation apparatus 140, and the power slip for an oil field workover operation 150.

The pipe lowering process by the automatic minor repair operation apparatus system will be described in detail below with reference to FIGS. 1 to 3C and FIG. 37.

The pipe lowering process by the automatic minor repair operation apparatus system according to some embodiments may include the following steps.

Preparation: the positions of a pipe column conveying and discharging device 110, an elevator for a workover operation 120, a manipulator for a workover operation 130, an integrated automatic wellhead operation apparatus 140, and a power slip for an oil field workover operation 150 for an oil field workover operation for use in the automatic minor repair operation apparatus system are accurately positioned relative to a wellhead center.

Initialization: the pipe column conveying and discharging device 110, the elevator for a workover operation 120, the manipulator for a workover operation 130, the integrated automatic wellhead operation apparatus 140, and the power slip for an oil field workover operation 150 after the positions have been adjusted are initialized, so that these apparatuses are adjusted to an initial state.

Pipe column conveying process: a first pipe column is attracted and held by an attracting structure 11075 of a discharging apparatus of the pipe column conveying and discharging device 110, lifted to a predetermined height by the lifting mechanism 1107, and translated onto a conveying apparatus of the pipe column conveying and discharging device 110 by the translation mechanism 1106. The mobile trolley 11032 of the conveying mechanism 1103 grips one end of the first pipe column and moves in a length direction of the rotating arm 1102 by the traction drive component 11031, so that the first pipe column is exposed by a predetermined length to reach to a clamping channel between the clamping mechanism 120402 and the elevator main body 120401 of the elevator 120 for gripping the pipe column 1000. Referring to FIG. 1, FIG. 1 shows the mutual cooperation between a pipe column conveying and discharging device 110 and an elevator 120 for implementing a pipe column conveying process.

Pipe column lifting process: after the elevator main body 120401 is locked and positioned by the clamping mechanism 120402 of the elevator 120 for a workover operation, the anti-opening ring 120200 is connected to the elevator main body 120401 and the clamping mechanism 120402 separately through the connecting portion 120300, so that the clamping mechanism 120402 can be always in a locked state to maintain stable clamping on the first pipe column, and in this case, the mobile trolley 11032 of the conveying mechanism 1103 is switched from an active pushing state to a follow-up state. The first pipe column is then lifted by a lifting system 170.

Pipe column pushing process: after the lifting system 170 rises to a certain height, the manipulator 130 for a workover operation gradually rotates to a set position from an initial state. A lower end of the first pipe column is connected through the elevator pushing mechanism 130300 and the clamping mechanism 130400, the rotary main body 130200 of the manipulator drives the clamping mechanism 130400 to move to a position of a wellhead center, and meanwhile, the elevator pushing mechanism 130300 can abut against an external elevator in the moving process, that is, the elevator is synchronously driven to move to the wellhead center. Referring to FIG. 2, FIG. 2 shows the mutual cooperation between an elevator for a workover operation 120 and a manipulator for a workover operation 130 for completing the pipe column pushing process.

Pipe lowering process: the V-shaped folding arm mechanism of the pushing mechanism 3 of the integrated automatic wellhead operation apparatus moves from an initial position to a preset wellhead position and closes the buckling waiting of the first pipe column. When the manipulator for a workover operation grips the pipe column, the anti-splash buckling device in the integrated automatic wellhead operation apparatus moves to the wellhead center, the elevator is lowered, and the pipe column is lowered to the position of a coupling. Through the opening of the power slip for an oil field workover operation, the anti-splash buckling device is opened, and the hydraulic clamp removes the wellhead position and implements coupling and buckling. The integrated automatic wellhead operation apparatus retracts to the initial position through the V-shaped folding arm mechanism of the pushing mechanism 3. The power slip for an oil field workover operation is switched to an open position, and then the lifting system 170 lowers the first pipe column to a height above the power slip, such that the exposed coupling of a second pipe column can be buckled up by the hydraulic clamp, and the power slip for an oil field workover operation is switched to a closed position. Referring to FIGS. 3A, 3B, and 3C, FIGS. 3A-3C show the mutual cooperation between the pushing mechanism 3 of the integrated automatic wellhead operation apparatus and the power slip 150 for completing the pipe lowering process.

Figure 37:
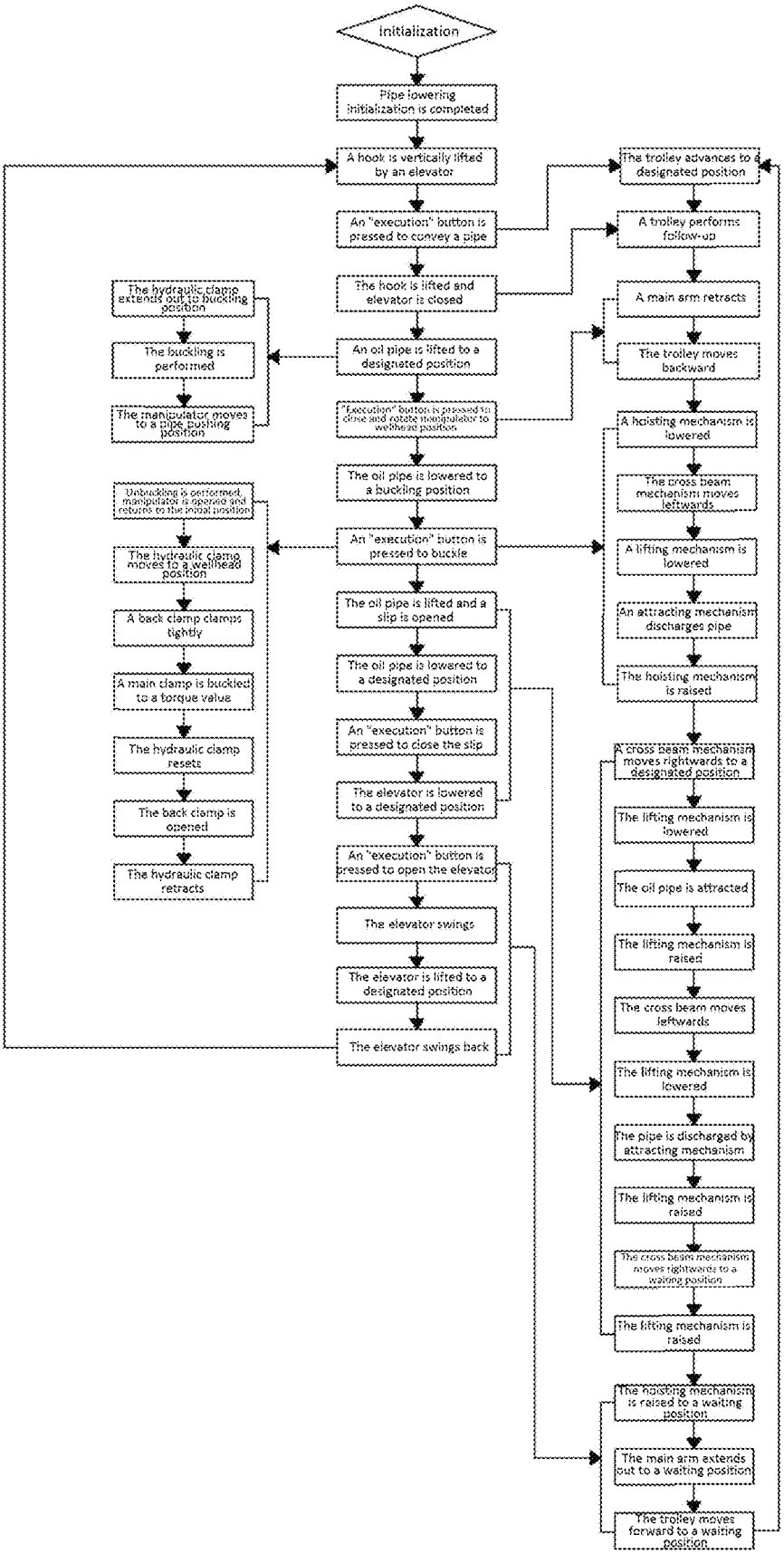
FIG. 37 is a flowchart of a pipe lowering process implemented by an automatic minor repair operation system for an oil field according to an embodiment of the present disclosure.

The specific pipe lowering process by the automatic minor repair operation apparatus system according to some embodiments may refer to FIG. 37.

The pipe lifting process by the automatic minor repair operation apparatus system will be described in detail below with reference to FIG. 38. The mutual cooperation relationship among the pipe column conveying and discharging device 110, the anti-opening mechanism for an elevator and the turnover elevator 120, the manipulator for a workover operation 130, the integrated automatic wellhead operation apparatus 140, and the power slip for an oil field workover operation 150 in the pipe lifting process of the automatic minor repair operation apparatus system is similar to that in the pipe lowering process of the automatic minor repair operation apparatus system.

The pipe lifting process by the automatic minor repair operation apparatus system according to some embodiments may include the following steps.

Preparation: the positions of a pipe column conveying and discharging device 110, an elevator for a workover operation 120, a manipulator for a workover operation 130, an integrated automatic wellhead operation apparatus 140, and a power slip for an oil field workover operation 150 for an oil field workover operation for use in the automatic minor repair operation apparatus system are accurately positioned relative to a wellhead center.

Initialization: the pipe column conveying and discharging device 110, the elevator for a workover operation 120, the manipulator for a workover operation 130, the integrated automatic wellhead operation apparatus 140, and the power slip for an oil field workover operation 150 after the positions have been adjusted are initialized, so that these apparatuses are adjusted to an initial state.

Buckling and lifting: the elevator laterally swings to a vertical position and falls to a position that is positioned at an upper end of the power slip for an oil field workover operation and positioned at a lower end of the pipe column coupling. The elevator swings back to a horizontal position, after the elevator main body 120401 is locked and positioned by the clamping mechanism 120402 of the elevator, the anti-opening ring 120200 is connected to the elevator main body 120401 and the clamping mechanism 120402 separately through the connecting portion 120300, so that the clamping mechanism 120402 can be always in a locked state to maintain stable clamping on the first pipe column. The power slip for an oil field workover operation is switched to an open position, then the first pipe column is lifted to a position that the coupling of the second pipe column is exposed above the power slip for an oil field workover operation by a preset height under the driving of the lifting system 170, and the power slip for an oil field workover operation is switched to a closed position to clamp the second pipe column.

Decoupling process: the V-shaped folding arm mechanism of the pushing mechanism 3 of the integrated automatic wellhead operation apparatus moves from an initial position to a predetermined wellhead position (or coupling position). The anti-splash buckling device is opened, and the hydraulic clamp removes the wellhead position and implements decoupling and unbuckling. In a case that there is a liquid in the wellhead, the anti-splash buckling device moves to a center position of the wellhead and is closed to clamp the first pipe column; and the liquid in the first pipe column is introduced into a storage apparatus of the platform through the anti-splash buckling device, so as to collect the liquid in the pipe column and implement the protection of the environment. Then the anti-splash buckling device is opened, and the V-shaped folding arm mechanism of the pushing mechanism 3 of the integrated automatic wellhead operation apparatus retracts to the initial position. If there is no liquid in the wellhead, the V-shaped folding arm mechanism of the pushing mechanism 3 of the integrated automatic wellhead operation apparatus retracts to the initial position, and the elevator is lifted.

Pipe column pushing process: the manipulator for a workover operation gradually rotates to a wellhead position from an initial state, a lower end of the first pipe column is connected through the elevator pushing mechanism 130300 and the clamping mechanism 130400, and the rotary main body 130200 of the manipulator drives the clamping mechanism 130400 to move to a preset position of the mobile trolley 3 of the conveying mechanism 1103. Meanwhile, the elevator pushing mechanism 130300 can be connected to an external elevator in the moving process, that is, the elevator is synchronously driven to move to a preset position of the mobile trolley 3 of the conveying mechanism 1103.

Pipe column conveying process: the mobile trolley 3 of the conveying mechanism 1103 closes to clamp one end that is of the first pipe column and that passes through the pipe column and moves in a length direction of the rotating arm 1102 by the traction drive component 11031 to convey the first pipe column to the conveying apparatus of the pipe column conveying and discharging device 110. The manipulator moves to the initial position and the elevator is opened. The first pipe column is attracted and held by an attracting structure 11075 of a discharging apparatus of the pipe column conveying and discharging device 110, and lowered to a predetermined position by the lifting mechanism 1107.

Figure 38:
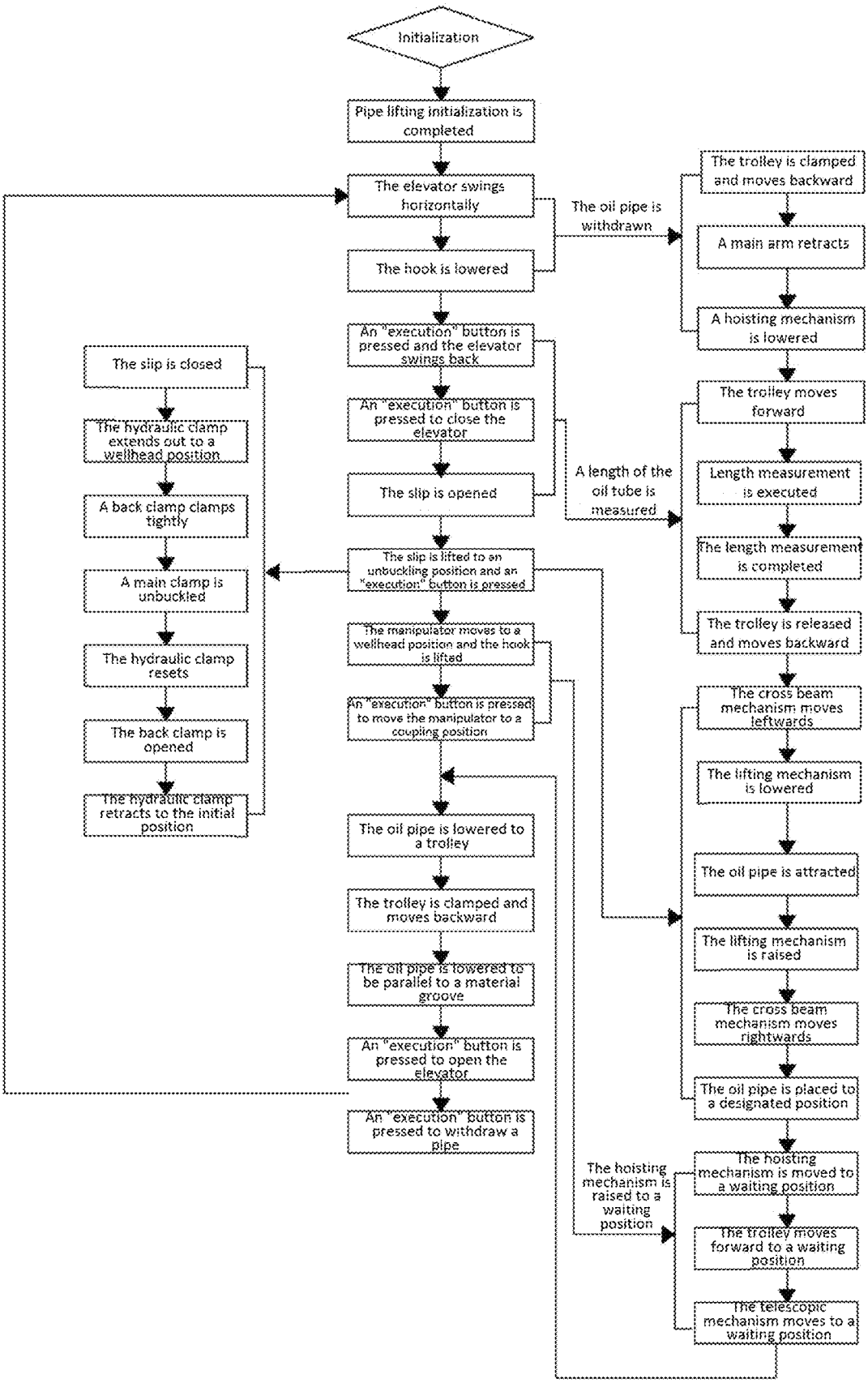
FIG. 38 is a flowchart of a pipe lifting process implemented by an automatic minor repair operation system for an oil field according to an embodiment of the present disclosure.

A specific pipe lifting process by the automatic minor repair operation apparatus system according to some embodiments may refer to FIG. 38.

Finally, it should be noted that the foregoing embodiments are merely intended for describing the technical solutions of the present disclosure other than limiting the present disclosure. Although the present disclosure is described in detail with reference to the foregoing embodiments, those of ordinary skill in the art should understand that they may still make modifications to the technical solutions described in the foregoing embodiments or make equivalent replacements to some or all technical features thereof, and these modifications and replacements do not make essence of the corresponding technical solutions depart from the scope of the technical solutions of embodiments of the present disclosure.

INDUSTRIAL APPLICABILITY

The present disclosure provides an automatic minor repair operation system for an oil field, a pipe column conveying and discharging device for use in an automatic minor repair operation apparatus system, an anti-opening mechanism for an elevator and a turnover elevator, a manipulator and a workover operation device for a workover operation, an integrated automatic wellhead operation apparatus, and a power slip for an oil field workover operation. The automatic minor repair operation apparatus system includes: a workover machine, a pipe column conveying and discharging device, an elevator for a workover operation, a manipulator for a workover operation, an integrated automatic wellhead operation apparatus, and a power slip for an oil field workover operation. The workover machine is arranged along a first direction of the automatic minor repair operation apparatus system, such that a longitudinal direction of the workover machine is parallel to the first direction, and a tail of the workover machine is arranged to be spaced a predetermined distance from a wellhead center in the first direction, where the first direction is a direction passing through the wellhead center along a radial direction of the wellhead. The pipe column conveying and discharging device is arranged on a first side of a second direction of the automatic minor repair operation apparatus system, where the second direction is a direction passing through the wellhead center and perpendicular to the first direction. The elevator for a workover operation, the manipulator for a workover operation, and the integrated automatic wellhead operation apparatus are arranged on the tail of the workover machine, are carried by the workover machine, and are arranged on a second side that is of the second direction of the automatic minor repair operation apparatus system and that is opposite to the first side. The power slip for an oil field workover operation is arranged at the wellhead center, and is configured to switch between an open position where a pipe column is allowed to move through and a closed position where the pipe column is prevented from moving through. According to the automatic minor repair operation apparatus system of the present disclosure, the on-site practicability and the working efficiency of the oil field operation are remarkably improved, the unmanned wellhead operation is achieved, the labor intensity of workers is greatly reduced, the working environment is improved, and the safety factor is improved; and meanwhile, the wellhead center can be positioned precisely.

In addition, it can be understood that the automatic minor repair operation system for an oil field, the pipe column conveying and discharging device for use in the automatic minor repair operation apparatus system, the anti-opening mechanism for an elevator and the turnover elevator, the manipulator and the workover operation device for a workover operation, the integrated automatic wellhead operation apparatus, and the power slip for an oil field workover operation of the present disclosure are reproducible and can be used in a variety of industrial applications. For example, the automatic minor repair operation system for an oil field, the pipe column conveying and discharging device for use in the automatic minor repair operation apparatus system, the anti-opening mechanism for an elevator and the turnover elevator, the manipulator and the workover operation device for a workover operation, the integrated automatic wellhead operation apparatus, and the power slip for an oil field workover operation of the present disclosure can be used in the technical field of oil field workover operation.

What is claimed is:

1. A pipe column conveying and discharging device, for use in an automatic minor repair operation system for an oil field, comprising: a conveying apparatus and a discharging apparatus, wherein the conveying apparatus comprises a first base, a rotating arm, and a conveying mechanism; the rotating arm is provided with a first end and a second end that are opposite to each other, the first end is hinged on the first base, and the second end is rotatable around the first end; and the conveying mechanism is configured to drive a pipe column to move from the first end to the second end;

the rotating arm comprises an arm body comprising a main body part, a telescopic part, and a second telescopic drive component;

the main body part is connected to the telescopic part;

one end of the second telescopic drive component is connected to the main body part, and the other end of the second telescopic drive component is connected to the telescopic part and configured to drive the telescopic part to stretch and retract relative to the main body part;

the discharging apparatus comprises a second base, a guide mechanism, a translation mechanism, a lifting mechanism, and a discharging mechanism; the guide mechanism is installed on the second base; the translation mechanism is installed on the guide mechanism and is movable along a preset direction of the guide mechanism; the lifting mechanism is installed on the translation mechanism and is configured to move the pipe column on the rotating arm to the discharging mechanism; and the discharging mechanism is configured to place the pipe column, wherein the second base is provided with a third end and a fourth end that are opposite to each other, the third end is provided with a first installation portion, the fourth end is provided with a second installation portion, and one end of the first base is detachably connected to the first installation portion or the second installation portion;

the pipe column conveying and discharging device further comprises a length measuring apparatus, wherein the length measuring apparatus comprises a displacement detection mechanism and a length measuring and limiting mechanism;

the displacement detection mechanism is installed on the rotating arm and is configured to detect a moving distance of one end of the pipe column driven by the conveying mechanism; and the length measuring and limiting mechanism comprises a third base, a third telescopic drive component, a lifting frame, a swing arm, a compression spring, and a sensing component;

the third base is installed on the first base, the lifting frame and the third telescopic drive component are installed on the third base, and the third telescopic drive component is configured to drive the lifting frame to lift and lower; one end of the swing arm is hinged to the lifting frame, and the other end of the swing arm is connected to the lifting frame through the compression spring; and the sensing component is installed on the lifting frame, and one end of the pipe column drives the swing arm to rotate and compress the compression spring to a preset state to trigger the sensing component, wherein the automatic minor repair operation system for the oil field comprises:

a workover machine, the pipe column conveying and discharging device, an elevator for a workover operation, a manipulator for the workover operation, an integrated automatic wellhead operation apparatus, and a power slip for an oil field workover operation, wherein the automatic minor repair operation system is configured to implement pipe lowering operation and pipe lifting operation on the pipe column by mutual cooperation of the pipe column conveying and discharging device, the elevator for the workover operation, the manipulator for the workover operation, the integrated automatic wellhead operation apparatus, and the power slip for the oil field workover operation, wherein the workover machine is arranged along a first direction of the automatic minor repair operation system, such that a longitudinal direction of the workover machine is parallel to the first direction, and a tail of the workover machine is arranged to be spaced a predetermined distance from a wellhead center in the first direction, wherein the first direction is a direction passing through the wellhead center along a radial direction of a wellhead; the pipe column conveying and discharging device is arranged on a first side of a second direction of the automatic minor repair operation system, wherein the second direction is a direction passing through the wellhead center and perpendicular to the first direction;

the elevator for the workover operation, the manipulator for the workover operation, and a integrated automatic wellhead operation device are arranged on the tail of the workover machine, are carried by the workover machine, and are arranged on a second side that is of the second direction of the automatic minor repair operation system and that is opposite to the first side; and the power slip for the oil field workover operation is arranged at the wellhead center, and is configured to switch between an open position where the pipe column is allowed to move through and a closed position where the pipe column is prevented from moving through, such that:

in the pipe lowering operation, the pipe column conveying and discharging device picks up the pipe column to be subjected to the pipe lowering operation and conveys the picked pipe column to a clamping channel of the elevator for the workover operation; the elevator for the workover operation clamps the pipe column; the elevator for the workover operation lifts the pipe column, the manipulator for the workover operation grips the pipe column clamped by the elevator for the workover operation and positions the gripped pipe column at a pipe lowering position at the wellhead center;

the integrated automatic wellhead operation apparatus moves to the wellhead center while the pipe column is gripped by the manipulator for the workover operation, and the elevator for the workover operation lowers the pipe column to a coupling position, such that the pipe column is buckled up by the integrated automatic wellhead operation apparatus; and the elevator for the workover operation lowers the pipe column by opening the power slip for the oil field workover operation; and in the pipe lifting operation, the elevator for the workover operation lifts the pipe column by opening the power slip for the oil field workover operation, such that a coupling of another pipe column is exposed to a designated position; the integrated automatic wellhead operation apparatus unbuckles the exposed coupling when the power slip for the oil field workover operation is closed; the integrated automatic wellhead operation apparatus retracts, the elevator for the workover operation lifts the pipe column, and the manipulator for the workover operation clamps the unbuckled pipe column and moves the pipe column from the wellhead center to a position where the pipe column is received by a conveying mechanism of the pipe column conveying and discharging device; and the elevator for the workover operation lowers the pipe column, and the conveying mechanism receives and moves the pipe column away from the wellhead center.

2. A pipe column conveying and discharging device for use in an automatic minor repair operation system for an oil field, comprising: a conveying apparatus and a discharging apparatus, wherein the conveying apparatus comprises a first base, a rotating arm, and a conveying mechanism;

the rotating arm is provided with a first end and a second end that are opposite to each other, the first end is hinged on the first base, and the second end is rotatable around the first end; and the conveying mechanism is configured to drive a pipe column to move from the first end to the second end;

the conveying mechanism comprises a traction drive component and a mobile trolley;

the traction drive component is installed on the rotating arm and is connected to the mobile trolley;

the mobile trolley is configured to clamp one end of the pipe column, is installed on the rotating arm, and moves along a length direction of the rotating arm under driving of the traction drive component;

the discharging apparatus comprises a second base, a guide mechanism, a translation mechanism, a lifting mechanism, and a discharging mechanism;

the guide mechanism is installed on the second base; the translation mechanism is installed on the guide mechanism and is movable along a preset direction of the guide mechanism;

the lifting mechanism is installed on the translation mechanism and is configured to move the pipe column on the rotating arm to the discharging mechanism;

the discharging mechanism is configured to place the pipe column, wherein the second base is provided with a third end and a fourth end that are opposite to each other, the third end is provided with a first installation portion, the fourth end is provided with a second installation portion, and one end of the first base is detachably connected to the first installation portion or the second installation portion, wherein the automatic minor repair operation system for the oil field comprises:

a workover machine, the pipe column conveying and discharging device, an elevator for a workover operation, a manipulator for the workover operation, an integrated automatic wellhead operation apparatus, and a power slip for an oil field workover operation, wherein the automatic minor repair operation system is configured to implement pipe lowering operation and pipe lifting operation on the pipe column by mutual cooperation of the pipe column conveying and discharging device, the elevator for the workover operation, the manipulator for the workover operation, the integrated automatic wellhead operation apparatus, and the power slip for the oil field workover operation, and wherein the workover machine is arranged along a first direction of the automatic minor repair operation system, such that a longitudinal direction of the workover machine is parallel to the first direction, and a tail of the workover machine is arranged to be spaced a predetermined distance from a wellhead center in the first direction, wherein the first direction is a direction passing through the wellhead center along a radial direction of a wellhead; the pipe column conveying and discharging device is arranged on a first side of a second direction of the automatic minor repair operation system, wherein the second direction is a direction passing through the wellhead center and perpendicular to the first direction;

the elevator for the workover operation, the manipulator for the workover operation, and a integrated automatic wellhead operation device are arranged on the tail of the workover machine, are carried by the workover machine, and are arranged on a second side that is of the second direction of the automatic minor repair operation system and that is opposite to the first side; and the power slip for the oil field workover operation is arranged at the wellhead center, and is configured to switch between an open position where the pipe column is allowed to move through and a closed position where the pipe column is prevented from moving through, such that:

in the pipe lowering operation, the pipe column conveying and discharging device picks up the pipe column to be subjected to the pipe lowering operation and conveys the picked pipe column to a clamping channel of the elevator for the workover operation; the elevator for the workover operation clamps the pipe column; the elevator for the workover operation lifts the pipe column, the manipulator for the workover operation grips the pipe column clamped by the elevator for the workover operation and positions the gripped pipe column at a pipe lowering position at the wellhead center;

the integrated automatic wellhead operation apparatus moves to the wellhead center while the pipe column is gripped by the manipulator for the workover operation, and the elevator for the workover operation lowers the pipe column to a coupling position, such that the pipe column is buckled up by the integrated automatic wellhead operation apparatus; and the elevator for the workover operation lowers the pipe column by opening the power slip for the oil field workover operation; and in the pipe lifting operation, the elevator for the workover operation lifts the pipe column by opening the power slip for the oil field workover operation, such that a coupling of another pipe column is exposed to a designated position; the integrated automatic wellhead operation apparatus unbuckles the exposed coupling when the power slip for the oil field workover operation is closed; the integrated automatic wellhead operation apparatus retracts, the elevator for the workover operation lifts the pipe column, and the manipulator for the workover operation clamps the unbuckled pipe column and moves the pipe column from the wellhead center to a position where the pipe column is received by the conveying mechanism of the pipe column conveying and discharging device; and the elevator for the workover operation lowers the pipe column, and the conveying mechanism receives and moves the pipe column away from the wellhead center.

3. A manipulator for a workover operation, for use in an automatic minor repair operation system for an oil field, wherein the manipulator for the workover operation comprises a manipulator rotation mechanism and a clamping and pushing mechanism, wherein the manipulator rotation mechanism comprises a rotation drive mechanism and a rotary main body, and the clamping and pushing mechanism comprises a clamping mechanism and an elevator pushing mechanism;

the clamping mechanism and the elevator pushing mechanism are connected to the rotary main body, the rotation drive mechanism is connected to one end of the rotary main body, the rotation drive mechanism is configured to drive the clamping mechanism and the elevator pushing mechanism to rotate circumferentially in a horizontal direction by the rotary main body, such that the clamping mechanism and the elevator pushing mechanism are positioned at a pipe receiving and conveying position in a wellhead center, and the clamping mechanism is configured to clamp an external pipe column;

the elevator pushing mechanism is configured to abut against an external elevator to push the external elevator to move in the horizontal direction;

the elevator pushing mechanism comprises a pushing main body, a push plate, and an angle adjusting mechanism;

one end of the pushing main body is connected to the rotary main body, the other end of the pushing main body is hinged to the push plate, two ends of the angle adjusting mechanism are separately hinged to one sides of the pushing main body and the push plate, and the angle adjusting mechanism is configured to drive the push plate to rotate relative to the pushing main body, such that the push plate abuts against the external elevator at an angle, wherein the automatic minor repair operation system for the oil field comprises:

a workover machine, a pipe column conveying and discharging device, an elevator for the workover operation, the manipulator for the workover operation, an integrated automatic wellhead operation apparatus, and a power slip for an oil field workover operation, wherein the automatic minor repair operation system is configured to implement pipe lowering operation and pipe lifting operation on a pipe column by mutual cooperation of the pipe column conveying and discharging device, the elevator for the workover operation, the manipulator for the workover operation, the integrated automatic wellhead operation apparatus, and the power slip for the oil field workover operation, wherein the workover machine is arranged along a first direction of the automatic minor repair operation system, such that a longitudinal direction of the workover machine is parallel to the first direction, and a tail of the workover machine is arranged to be spaced a predetermined distance from the wellhead center in the first direction, wherein the first direction is a direction passing through the wellhead center along a radial direction of a wellhead; the pipe column conveying and discharging device is arranged on a first side of a second direction of the automatic minor repair operation system, wherein the second direction is a direction passing through the wellhead center and perpendicular to the first direction;

the elevator for the workover operation, the manipulator for the workover operation, and an integrated automatic wellhead operation device are arranged on the tail of the workover machine, are carried by the workover machine, and are arranged on a second side that is of the second direction of the automatic minor repair operation system and that is opposite to the first side; and the power slip for the oil field workover operation is arranged at the wellhead center, and is configured to switch between an open position where the pipe column is allowed to move through and a closed position where the pipe column is prevented from moving through, such that:

in the pipe lowering operation, the pipe column conveying and discharging device picks up the pipe column to be subjected to the pipe lowering operation and conveys the picked pipe column to a clamping channel of the elevator for the workover operation; the elevator for the workover operation clamps the pipe column; the elevator for the workover operation lifts the pipe column, the manipulator for the workover operation grips the pipe column clamped by the elevator for the workover operation and positions the gripped pipe column at a pipe lowering position at the wellhead center;

the integrated automatic wellhead operation apparatus moves to the wellhead center while the pipe column is gripped by the manipulator for the workover operation, and the elevator for the workover operation lowers the pipe column to a coupling position, such that the pipe column is buckled up by the integrated automatic wellhead operation apparatus; and the elevator for the workover operation lowers the pipe column by opening the power slip for the oil field workover operation; and in the pipe lifting operation, the elevator for the workover operation lifts the pipe column by opening the power slip for the oil field workover operation, such that a coupling of another pipe column is exposed to a designated position; the integrated automatic wellhead operation apparatus unbuckles the exposed coupling when the power slip for the oil field workover operation is closed; the integrated automatic wellhead operation apparatus retracts, the elevator for the workover operation lifts the pipe column, and the manipulator for the workover operation clamps the unbuckled pipe column and moves the pipe column from the wellhead center to a position where the pipe column is received by a conveying mechanism of the pipe column conveying and discharging device; and the elevator for the workover operation lowers the pipe column, and the conveying mechanism receives and moves the pipe column away from the wellhead center.

4. The manipulator for the workover operation according to claim 1, wherein the pushing main body comprises a first pushing arm, a fixed support, and a second pushing arm; and the first pushing arm is connected to the second pushing arm by the fixed support, the fixed support is configured to enable the first pushing arm and the second pushing arm to be vertically arranged, one end that is of the first pushing arm and that is far away from the second pushing arm is connected to the rotary main body, and one end that is of the second pushing arm and that is far away from the first pushing arm is hinged to the push plate.

5. The manipulator for the workover operation according to claim 4, wherein the fixed support comprises a support main body, a first adjusting pin shaft, and a second adjusting pin shaft;

the support main body is provided with a clamping groove, both the first pushing arm and the second pushing arm are inserted into the clamping groove of the support main body, and the first pushing arm is able to rotate relative to the support main body; and the support main body is provided with a first fixing hole, a second fixing hole, and a third fixing hole, wherein the first fixing hole and the second fixing hole are positioned on a same straight line, the first fixing hole and the third fixing hole are positioned on a same straight line, and a connecting line of the first fixing hole and the second fixing hole is arranged vertically relative to a connecting line of the first fixing hole and the third fixing hole; the first adjusting pin shaft is configured to sequentially pass through the first fixing hole, the first pushing arm, and the second pushing arm, so as to fix the first pushing arm and the second pushing arm in the clamping groove of the support main body; and the second adjusting pin shaft is configured to be separately connected to the second fixing hole and the third fixing hole, so as to adjust the first pushing arm and the second pushing arm to be vertically arranged, or to adjust the first pushing arm and the second pushing arm to be linearly arranged.

6. A manipulator for a workover operation for use in an automatic minor repair operation system for an oil field, wherein the manipulator for the workover operation comprises a manipulator rotation mechanism and a clamping and pushing mechanism, wherein the manipulator rotation mechanism comprises a rotation drive mechanism and a rotary main body, and the clamping and pushing mechanism comprises a clamping mechanism and an elevator pushing mechanism;

the clamping mechanism and the elevator pushing mechanism are connected to the rotary main body, the rotation drive mechanism is connected to one end of the rotary main body, the rotation drive mechanism is configured to drive the clamping mechanism and the elevator pushing mechanism to rotate circumferentially in a horizontal direction by the rotary main body, such that the clamping mechanism and the elevator pushing mechanism are positioned at a pipe receiving and conveying position in a wellhead center, and the clamping mechanism is configured to clamp an external pipe column; and the elevator pushing mechanism is configured to abut against an external elevator to push the external elevator to move in the horizontal direction, wherein the clamping mechanism comprises a fixed sleeve, a sliding sleeve, a telescopic drive mechanism, and a clamping assembly;

the telescopic drive mechanism is positioned in the fixed sleeve, a fixing end of the telescopic drive mechanism is connected to an inner wall of one end of the fixed sleeve, and the fixed sleeve is fixedly connected to the rotary main body; and a telescopic end of the telescopic drive mechanism is connected to one end that is of the sliding sleeve and that is positioned in the fixed sleeve, the sliding sleeve is connected to the fixed sleeve in a sliding manner, and one end that is of the sliding sleeve and that extends out of the fixed sleeve is connected to the clamping assembly, wherein the automatic minor repair operation system for the oil field comprises:

a workover machine, a pipe column conveying and discharging device, an elevator for the workover operation, the manipulator for the workover operation, an integrated automatic wellhead operation apparatus, and a power slip for an oil field workover operation, wherein the automatic minor repair operation system is configured to implement pipe lowering operation and pipe lifting operation on a pipe column by mutual cooperation of the pipe column conveying and discharging device, the elevator for the workover operation, the manipulator for the workover operation, the integrated automatic wellhead operation apparatus, and the power slip for the oil field workover operation, and wherein the workover machine is arranged along a first direction of the automatic minor repair operation system, such that a longitudinal direction of the workover machine is parallel to the first direction, and a tail of the workover machine is arranged to be spaced a predetermined distance from the wellhead center in the first direction, wherein the first direction is a direction passing through the wellhead center along a radial direction of a wellhead; the pipe column conveying and discharging device is arranged on a first side of a second direction of the automatic minor repair operation system, wherein the second direction is a direction passing through the wellhead center and perpendicular to the first direction;

the elevator for the workover operation, the manipulator for the workover operation, and a integrated automatic wellhead operation device are arranged on the tail of the workover machine, are carried by the workover machine, and are arranged on a second side that is of the second direction of the automatic minor repair operation system and that is opposite to the first side; and the power slip for the oil field workover operation is arranged at the wellhead center, and is configured to switch between an open position where the pipe column is allowed to move through and a closed position where the pipe column is prevented from moving through, such that:

in the pipe lowering operation, the pipe column conveying and discharging device picks up the pipe column to be subjected to the pipe lowering operation and conveys the picked pipe column to a clamping channel of the elevator for the workover operation; the elevator for the workover operation clamps the pipe column; the elevator for the workover operation lifts the pipe column, the manipulator for the workover operation grips the pipe column clamped by the elevator for the workover operation and positions the gripped pipe column at a pipe lowering position at the wellhead center;

the integrated automatic wellhead operation apparatus moves to the wellhead center while the pipe column is gripped by the manipulator for the workover operation, and the elevator for the workover operation lowers the pipe column to a coupling position, such that the pipe column is buckled up by the integrated automatic wellhead operation apparatus; and the elevator for the workover operation lowers the pipe column by opening the power slip for the oil field workover operation; and in the pipe lifting operation, the elevator for the workover operation lifts the pipe column by opening the power slip for the oil field workover operation, such that a coupling of another pipe column is exposed to a designated position; the integrated automatic wellhead operation apparatus unbuckles the exposed coupling when the power slip for the oil field workover operation is closed; the integrated automatic wellhead operation apparatus retracts, the elevator for the workover operation lifts the pipe column, and the manipulator for the workover operation clamps the unbuckled pipe column and moves the pipe column from the wellhead center to a position where the pipe column is received by a conveying mechanism of the pipe column conveying and discharging device; and the elevator for the workover operation lowers the pipe column, and the conveying mechanism receives and moves the pipe column away from the wellhead center.

7. An integrated automatic wellhead operation apparatus for use in an automatic minor repair operation system for an oil field, comprising: a bracket, an anti-splash buckling device, a hydraulic clamp, a transferring mechanism, a rotating mechanism, and a pushing mechanism, wherein the anti-splash buckling device and the hydraulic clamp are fixedly connected to the bracket;

the transferring mechanism is provided with a connecting bottom plate sliding transversely, the rotating mechanism is fixed on the connecting bottom plate, a top of the rotating mechanism is a rotating end, the rotating end is connected to a rear end of the pushing mechanism, and a front end of the pushing mechanism fixedly supports the bracket;

the pushing mechanism comprises a first connecting base, a second connecting base, a second hydraulic cylinder, and a V-shaped folding arm group;

the V-shaped folding arm group comprises two first support arms, two second support arms, a trapezoidal base, and a connecting rod, wherein the two first support arms are arranged in parallel, an upper end of each first support arm is hinged to the first connecting base, and a lower end of each first support arm is hinged to a front end of the trapezoidal base;

the two second support arms are arranged in parallel, an upper end of each second support arm is hinged to the second connecting base, and an lower end of each second support arm is hinged to a rear end of the trapezoidal base; and an extension block is arranged at a bottom of one of the second support arms, a lower end of the extension block is hinged to one end of the connecting rod, and the other end of the connecting rod is hinged to a bottom of one of the first support arms; and one end of the second hydraulic cylinder is hinged to the second connecting base, and the other end of the second hydraulic cylinder is hinged to a middle portion of one of the second support arms, wherein the automatic minor repair operation system for the oil field comprises:

a workover machine, a pipe column conveying and discharging device, an elevator for a workover operation, a manipulator for the workover operation, the integrated automatic wellhead operation apparatus, and a power slip for an oil field workover operation, wherein the automatic minor repair operation system is configured to implement pipe lowering operation and pipe lifting operation on a pipe column by mutual cooperation of the pipe column conveying and discharging device, the elevator for the workover operation, the manipulator for the workover operation, the integrated automatic wellhead operation apparatus, and the power slip for the oil field workover operation, and wherein the workover machine is arranged along a first direction of the automatic minor repair operation system, such that a longitudinal direction of the workover machine is parallel to the first direction, and a tail of the workover machine is arranged to be spaced a predetermined distance from a wellhead center in the first direction, wherein the first direction is a direction passing through the wellhead center along a radial direction of a wellhead; the pipe column conveying and discharging device is arranged on a first side of a second direction of the automatic minor repair operation system, wherein the second direction is a direction passing through the wellhead center and perpendicular to the first direction;

the elevator for the workover operation, the manipulator for the workover operation, and a integrated automatic wellhead operation device are arranged on the tail of the workover machine, are carried by the workover machine, and are arranged on a second side that is of the second direction of the automatic minor repair operation system and that is opposite to the first side; and the power slip for the oil field workover operation is arranged at the wellhead center, and is configured to switch between an open position where the pipe column is allowed to move through and a closed position where the pipe column is prevented from moving through, such that:

in the pipe lowering operation, the pipe column conveying and discharging device picks up the pipe column to be subjected to the pipe lowering operation and conveys the picked pipe column to a clamping channel of the elevator for the workover operation; the elevator for the workover operation clamps the pipe column; the elevator for the workover operation lifts the pipe column, the manipulator for the workover operation grips the pipe column clamped by the elevator for the workover operation and positions the gripped pipe column at a pipe lowering position at the wellhead center;

the integrated automatic wellhead operation apparatus moves to the wellhead center while the pipe column is gripped by the manipulator for the workover operation, and the elevator for the workover operation lowers the pipe column to a coupling position, such that the pipe column is buckled up by the integrated automatic wellhead operation apparatus; and the elevator for the workover operation lowers the pipe column by opening the power slip for the oil field workover operation; and in the pipe lifting operation, the elevator for the workover operation lifts the pipe column by opening the power slip for the oil field workover operation, such that a coupling of another pipe column is exposed to a designated position; the integrated automatic wellhead operation apparatus unbuckles the exposed coupling when the power slip for the oil field workover operation is closed; the integrated automatic wellhead operation apparatus retracts, the elevator for the workover operation lifts the pipe column, and the manipulator for the workover operation clamps the unbuckled pipe column and moves the pipe column from the wellhead center to a position where the pipe column is received by a conveying mechanism of the pipe column conveying and discharging device; and the elevator for the workover operation lowers the pipe column, and the conveying mechanism receives and moves the pipe column away from the wellhead center.

8. The integrated automatic wellhead operation apparatus according to claim 7, wherein the transferring mechanism comprises a base, two transverse guide rails are fixedly connected to the base, and the two guide rails are arranged in parallel;

each of the guide rails is connected to a slide bushing in a sliding manner, and two slide bushings are separately fixedly connected to two ends of the connecting bottom plate; and a support base is arranged at a rear of the base, a first hydraulic cylinder is arranged between the support base and the slide bushing, and two ends of the first hydraulic cylinder respectively hinged to the slide bushing and the support base.

9. The integrated automatic wellhead operation apparatus according to claim 8, wherein both two sets of support bases and two sets of first hydraulic cylinders are provided and are respectively matched with the two slide bushings.

10. The integrated automatic wellhead operation apparatus according to claim 7, wherein the rotating mechanism comprises a fixed base and a drive mechanism;

the fixed base is fixed at an upper end of the connecting bottom plate, a rotary table is rotatably connected above the fixed base, a worm wheel is sleeved on a periphery of the rotary table, a support beam is connected to an upper end of the rotary table, and an upper end of the support beam is connected to a rear end of the pushing mechanism; and the drive mechanism comprises a hydraulic motor, a worm is installed on a rotating shaft of the hydraulic motor, and the worm is in meshing transmission with the worm wheel.

* * * * *